US008591094B2

(12) United States Patent
Rasper

(10) Patent No.: US 8,591,094 B2
(45) Date of Patent: Nov. 26, 2013

(54) DIVERSE CONTAINER MATERIAL REMOVAL MACHINE

(76) Inventor: Darryl Terrence Rasper, Washington, MI (US)

( * ) Notice: Subject to any disclaimer, the term of this patent is extended or adjusted under 35 U.S.C. 154(b) by 399 days.

(21) Appl. No.: 12/884,156

(22) Filed: Sep. 16, 2010

(65) Prior Publication Data

US 2011/0069577 A1 Mar. 24, 2011

Related U.S. Application Data

(60) Provisional application No. 61/244,119, filed on Sep. 21, 2009, provisional application No. 61/288,075, filed on Dec. 18, 2009.

(51) Int. Cl.
*B01F 11/00* (2006.01)

(52) U.S. Cl.
USPC ..... 366/110; 366/111; 141/371

(58) Field of Classification Search
USPC ..... 366/110–112; 141/371
See application file for complete search history.

(56) References Cited

U.S. PATENT DOCUMENTS

| | | | | | |
|---|---|---|---|---|---|
| 1,328,379 | A * | 1/1920 | Johnson | 74/61 |
| 1,607,811 | A * | 11/1926 | Blum | 366/110 |
| 2,116,367 | A * | 5/1938 | Smith | 366/110 |
| 2,191,529 | A * | 2/1940 | Holm | 177/74 |
| 2,247,978 | A * | 7/1941 | Van Arkel | 366/110 |
| 2,536,419 | A * | 1/1951 | Brunell et al. | 141/341 |
| 2,728,562 | A * | 12/1955 | Bailey | 366/112 |
| 2,846,201 | A * | 8/1958 | Mermelstein | 366/110 |
| 3,061,280 | A * | 10/1962 | Kraft et al. | 366/110 |
| 4,207,933 | A * | 6/1980 | Howson | 141/106 |
| 4,217,941 | A * | 8/1980 | Catalano | 141/372 |
| 2007/0201301 | A1 * | 8/2007 | Klepinger | 366/110 |

* cited by examiner

*Primary Examiner* — David Sorkin

(57) ABSTRACT

A machine used for maximizing the extraction of otherwise wasted material in diverse containers by shaking and vibrating the inverted containers consequently causing the material to flow to the caps of the containers for use. All the embodiments described use a motor to shake and/or vibrate the opening and the container so the contents flow to the cap. They are composed of an opening within a housing to allow for container insertion, a housing to elevate the opening and container off of a surface to allow movement, a holding assembly to keep the container in place during a cycle, a motor or motors, and the necessary components to energize and control the motor(s). With the exception of the vibration only embodiment (FIGS. 7-7G) which simply vibrates the container, the other embodiments (FIGS. 1-6H and FIGS. 8-12A) use the motor and cam assembly to shake and vibrate the opening and the container causing the remaining material in the container to flow to the cap. All the embodiments are described and shown.

2 Claims, 50 Drawing Sheets

DIVERSE CONTAINER MATERIAL REMOVAL MACHINE

CROSS-REFERENCE TO RELATED APPLICATIONS

This application claims the benefit of provisional patent application Ser. No. 61/244,119 filed 2009 Sep. 21 by the present inventor.

This application claims the benefit of provisional patent application Ser. No. 61/288,075 filed 2009 Dec. 18 by the present inventor.

FEDERALLY SPONSORED RESEARCH

None.

SEQUENCE LISTING

None.

BACKGROUND OF THE INVENTION

1. Field

This invention generally relates to a product used for vibrating and/or shaking the remaining material content of diverse, inverted household containers inserted into its opening and held in place, maximizing the amount of usable product to be obtained from the containers.

2. Prior Art

None

SUMMARY

In accordance with one embodiment the diverse container material removal machine is comprised of a container hold down capable of holding a container in an opening within the main housing, a housing which elevates the containers off the surface and contains the opening, a motor or motors with cam driven assemblies, a timer to initiate and end a shaking and/or vibration cycle, and a bottom cover to safely enclose the machine while allowing any spilled contents to be cleaned.

DRAWINGS

Figures

DRAWINGS

Reference Numerals

Figure 1:
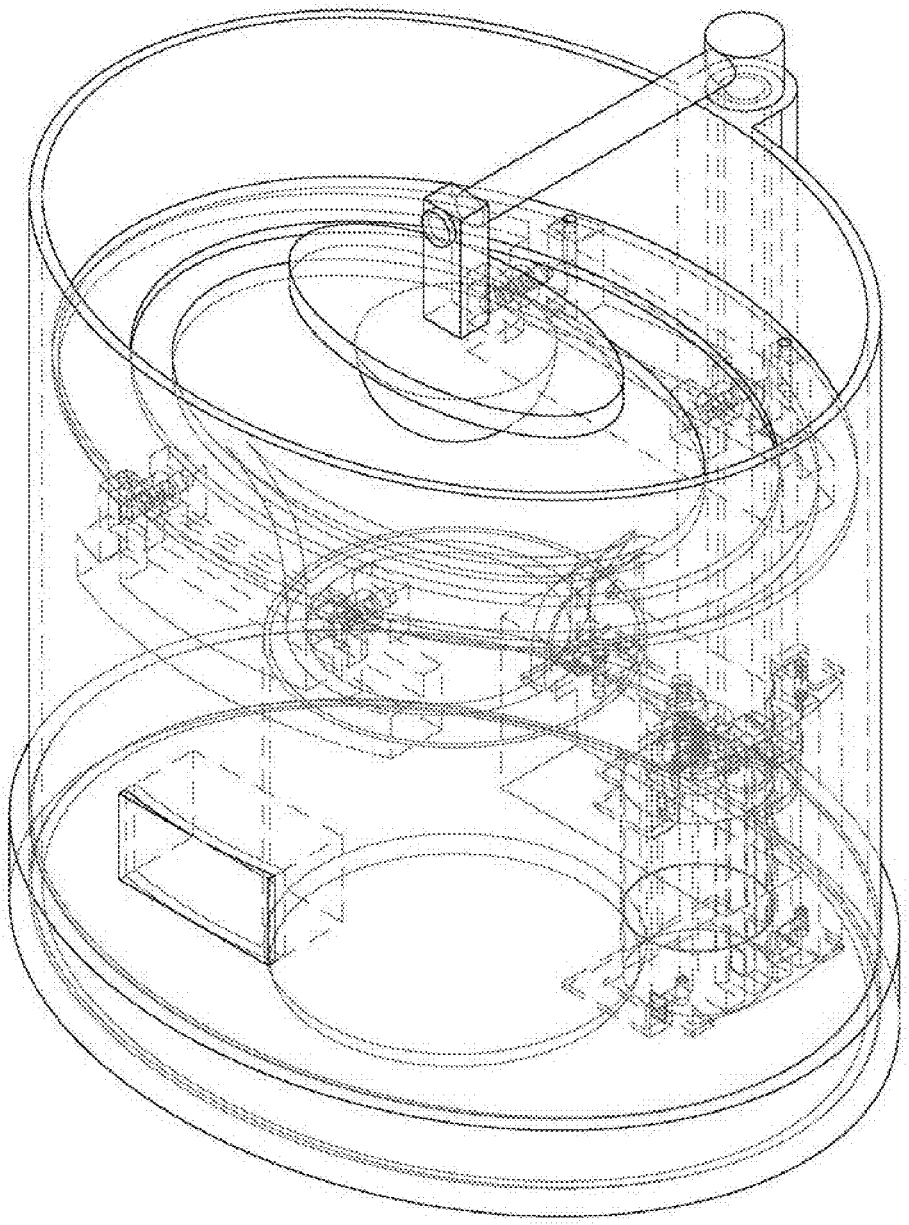
FIG. 1 shows the isometric drawing of the first embodiment complete assembly.

20 Frictional container bottom fill extension used to fit container bottoms that are generally slightly inverted.

21 The hold down plate is what the frictional container bottom cavity fill extension and the rod attachment block attach to.

22 Rod attachment block.

23 Connecting rod to the hold down cover rod attachment block and the extension rod block.

24 The extension rod block.

25 The inner extension rod allowing the hold down cover to raise and lower.

26 A clamp to hold the extension rod in place in an elevated state.

27 A bushing attached to main housing to allow the clamp to slide or screw into and keep the secondary extension rod from pulling out of the extension rod cavity.

28 An outer extension rod or tube for taller containers.

29 A protective ring inserted above the container placement opening to protect the user from the sliding, shaking or vibrating motion.

30 The smallest reduction insert for capturing tiny containers.

31 A reduction insert for capturing containers that would otherwise fall through the opening.

32 The funnel/opening the container fits into which may be funnel shaped and is also the rolling, sliding, shaking, twisting or vibrating surface.

33 The mounting block for a roller or bearing or sliding surface to attach to.

34 The rollers on the funnel/opening.

35 The mounting block for the cam arm attachment bracket to attach to.

36 The cam arm bracket.

37 Attachment pin, bearing or roller for the cam arm to attach to the cam arm bracket.

38 Cam arm.

39 Motor bracket to hold the motor to the main housing.

40 Motor.

41 Cam.

42 Cam rod.

43 Motor mounting block attached to the main housing where the motor mounting bracket attaches.

44 Main housing.

45 Extension rod cavity for containing the hold down extension rods.

46 The opening for the clamp bushing.

47 Protective ring mounting blocks.

48 The track for the funnel/opening to move along.

49 Transformer.

50 The timer for controlling power to the motor.

51 The bottom cover cylinder reaching up to the container funnel/opening.

52 The bottom cover for the extension rod cavity.

53 Attachment point for the bottom cover to the main housing.

54 Top cover.

55 Handle.

56 Inserted weight inside the top cover.

57 Extension rod pockets.

58 Small cover to hold the weight in the top cover in place.

59 Cam arm bracket to the funnel/opening.

60 Cam arm.

61 Attachment pins

62 Lever arm.

63 Fulcrum bracket.

64 Roller, bearing or pin to move linearly with the motion of the rotating cam.

65 Bearing, pin or roller attached to the cam and cam lever for driving or actuating semi-linear movement from the rotating cam.

66 Cam.

67 Motor bracket.

68 Motor.

69 Extension rod for guiding the top cover.

70 Extension rod cavities in the main housing.

71 Fulcrum bracket mounting block.

72 Bottom cover extension rod cavity covers.

73 Duplicate secondary motor, motor mount, cam and cam arm assembly.

74 Spring arm receiving bracket.

75 Rear compression spring.

76 Spring arm bracket.

77 Spring arm bracket mounting block on the funnel/opening.

78 Guide bar.

79 Cam follower bracket with attached cam follower shaft.

80 Cam follower.

81 Plate cam.

82 Mounting block for the spring arm receiving bracket.

83 Front compression spring.

84 Front compression spring keeper.

85 Top cover.

86 Protective ring.

87 Funnel/opening.

88 Motor compartment cover.

89 Motor bracket.

90 Double shafted motor.

91 Main housing.

92 Bottom cover.

93 Pivot push blocks.

94 Pivot plates for the pivot rod attached to the funnel/opening.

95 Pivot rod.

96 Motor mount.

97 Pivot mount.

98 Protective ring mounting blocks.

99 Cam brackets.

100 Push pads.
101 Guide pins.
102 Cam.
103 Cam roller.
104 Top section housing.
105 Container holding pad.
106 Spring mount cavity inside the container holding pad.
107 Spring boss on top section housing.
108 Attachment tab to hold the top section to the middle section.
109 Middle section.
110 Pocket to attach to the dimple from the top section.
111 Upper motor mount block.
112 Lower motor mount block.
113 Pocket to attach to the dimple from the bottom section.
114 Protective cover mounting block.
115 Protective middle section bottom cover.
116 Motor.
117 Motor bracket.
118 Unbalanced cam for creating vibrating forces.
119 Bottom section.
120 Attachment tab to hold the bottom section to the middle section.

DETAILED DESCRIPTION

Figure 1A:
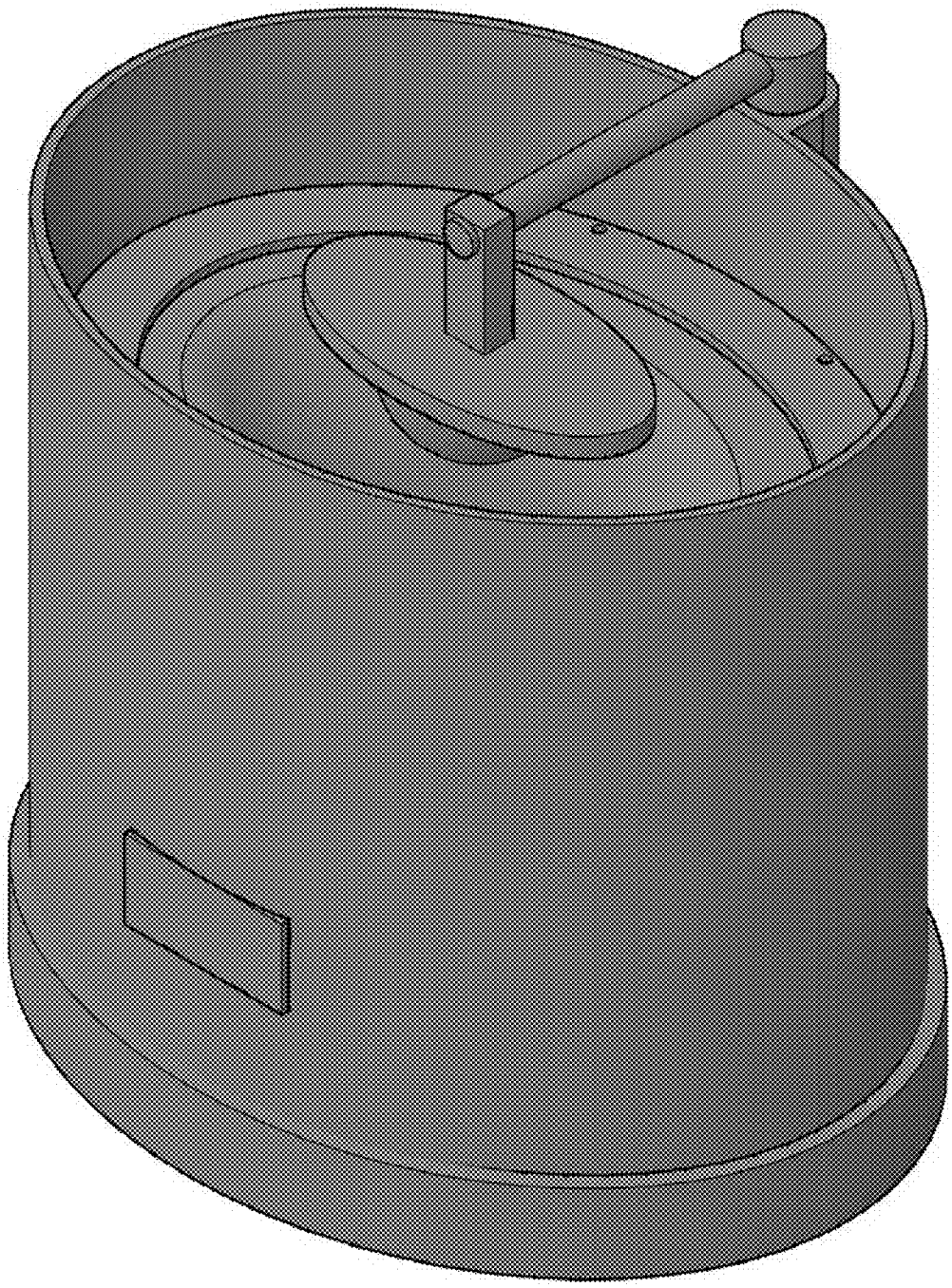
FIG. 1A shows the conceptual isometric drawing of the first embodiment complete assembly.
Figure 1B:
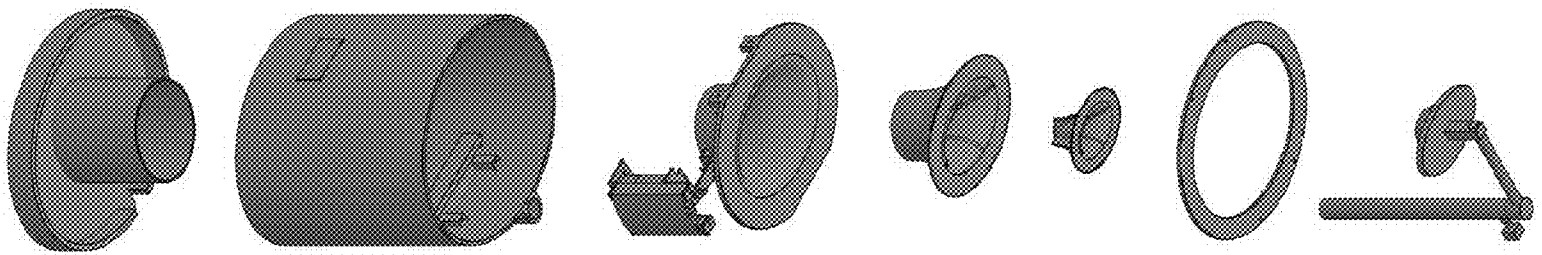
FIG. 1B shows the conceptual isometric drawing of the first embodiment with separated parts.
Figure 1C:
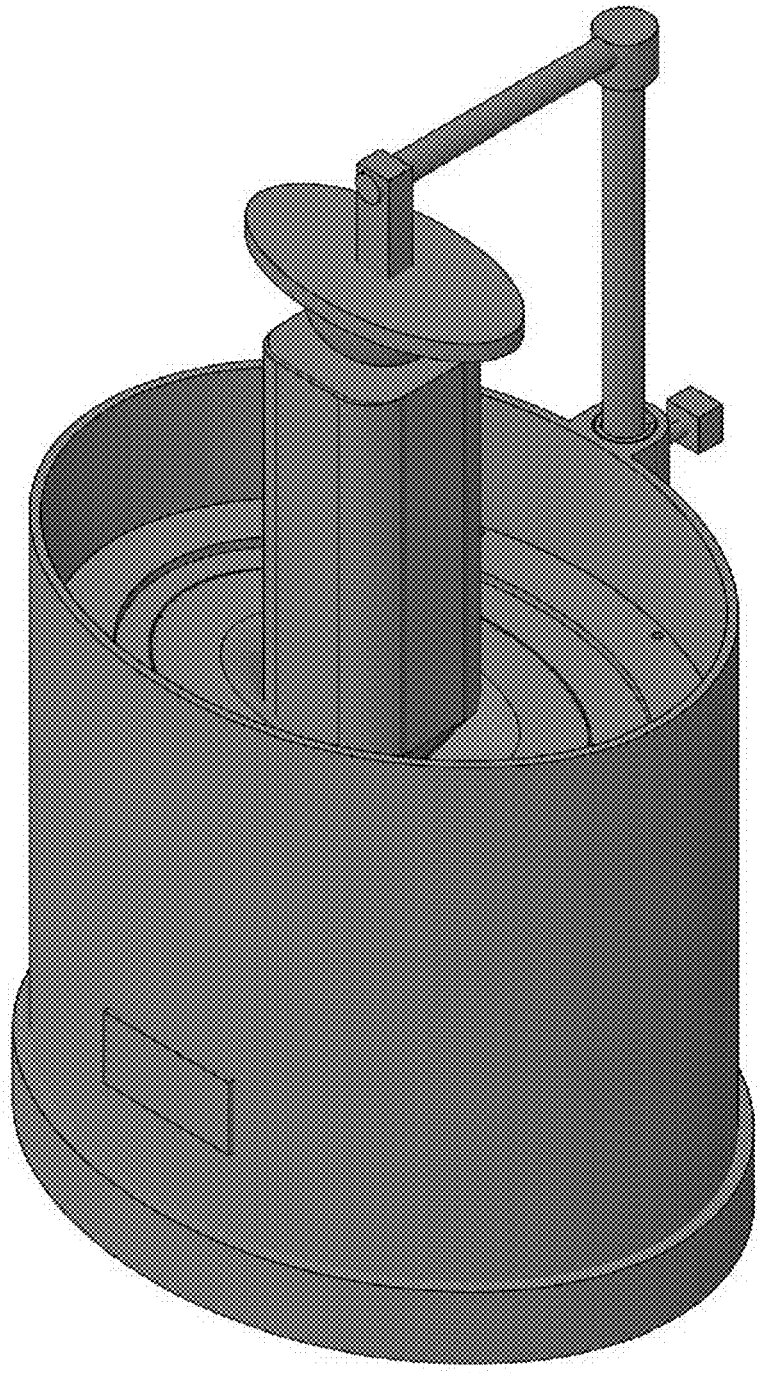
FIG. 1C shows the conceptual isometric drawing of the first embodiment with a container in the opening.
Figure 1D:
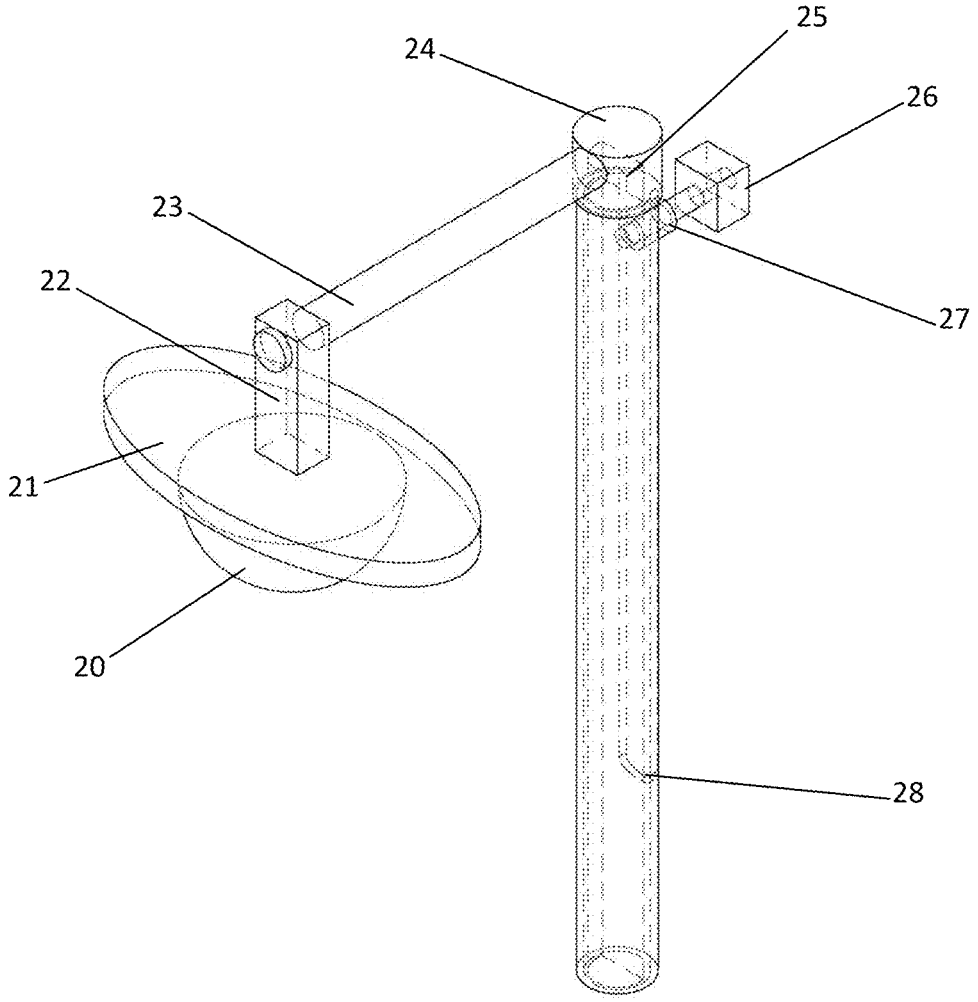
FIG. 1D shows the isometric drawing of the first embodiment adjustable container hold down device.
Figure 1E:
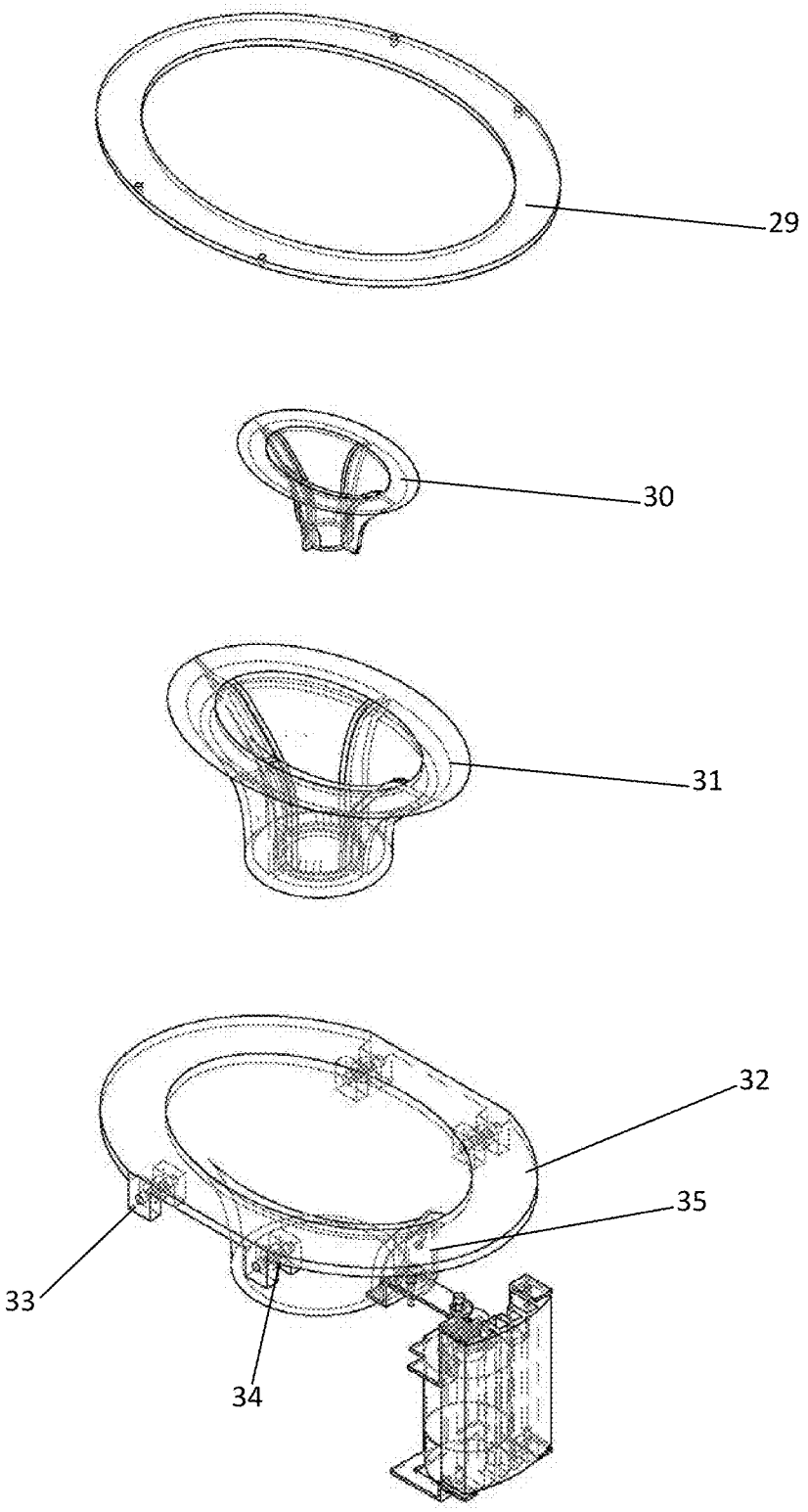
FIG. 1E shows the isometric drawing of the first embodiment protection ring, reduction inserts and funnel/opening.
Figure 1F:
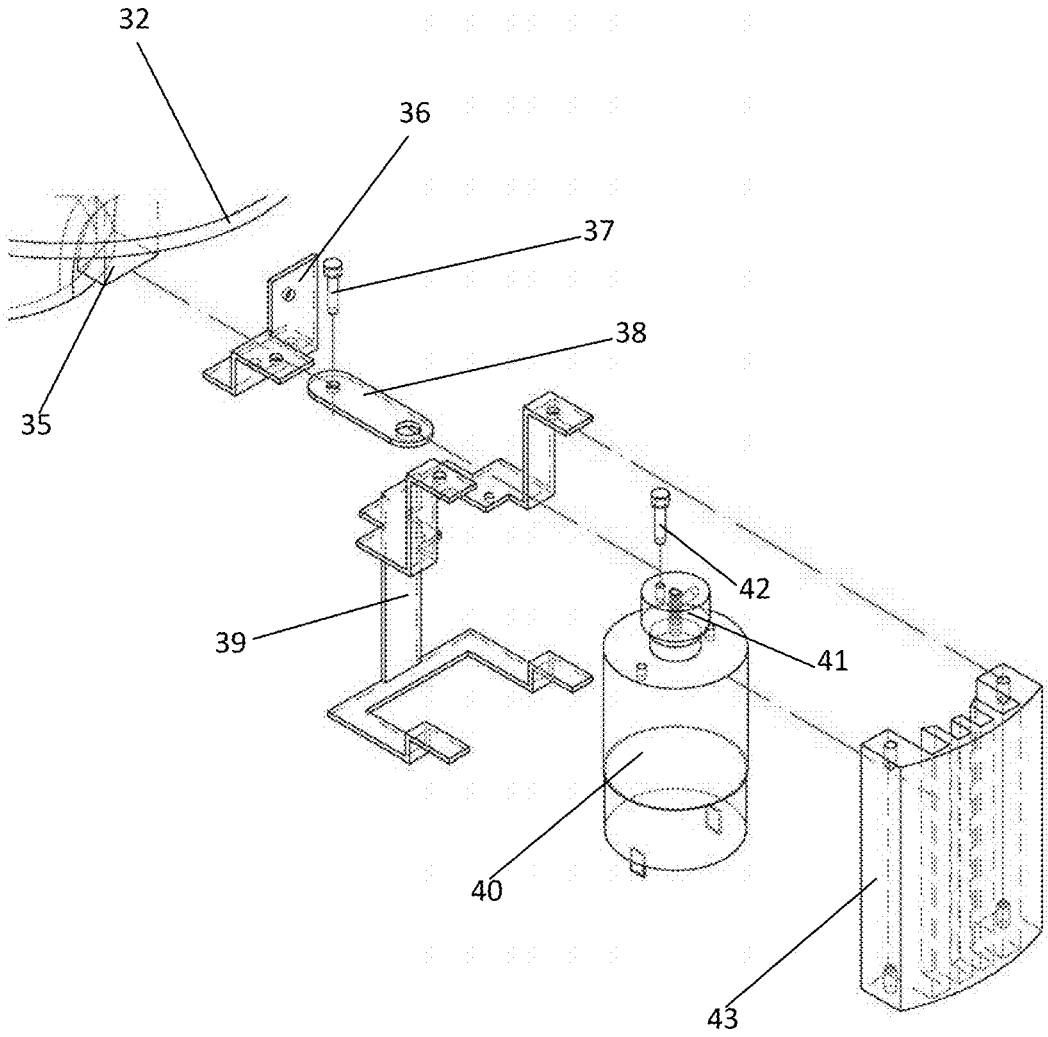
FIG. 1F shows the isometric drawing of the first embodiment motor, cam, and drive components separated.
Figure 1G:
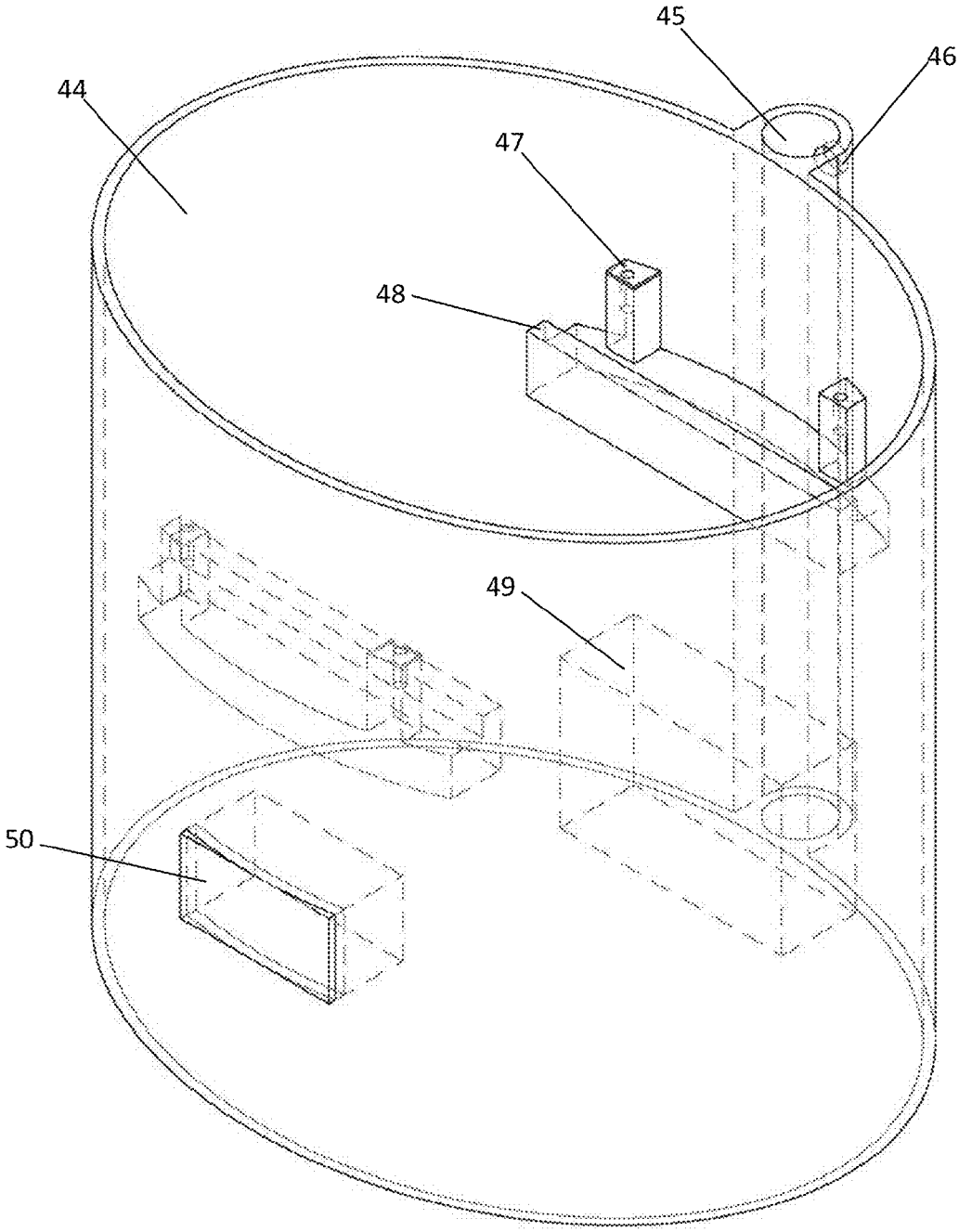
FIG. 1G shows the isometric drawing of the first embodiment main housing.
Figure 1H:
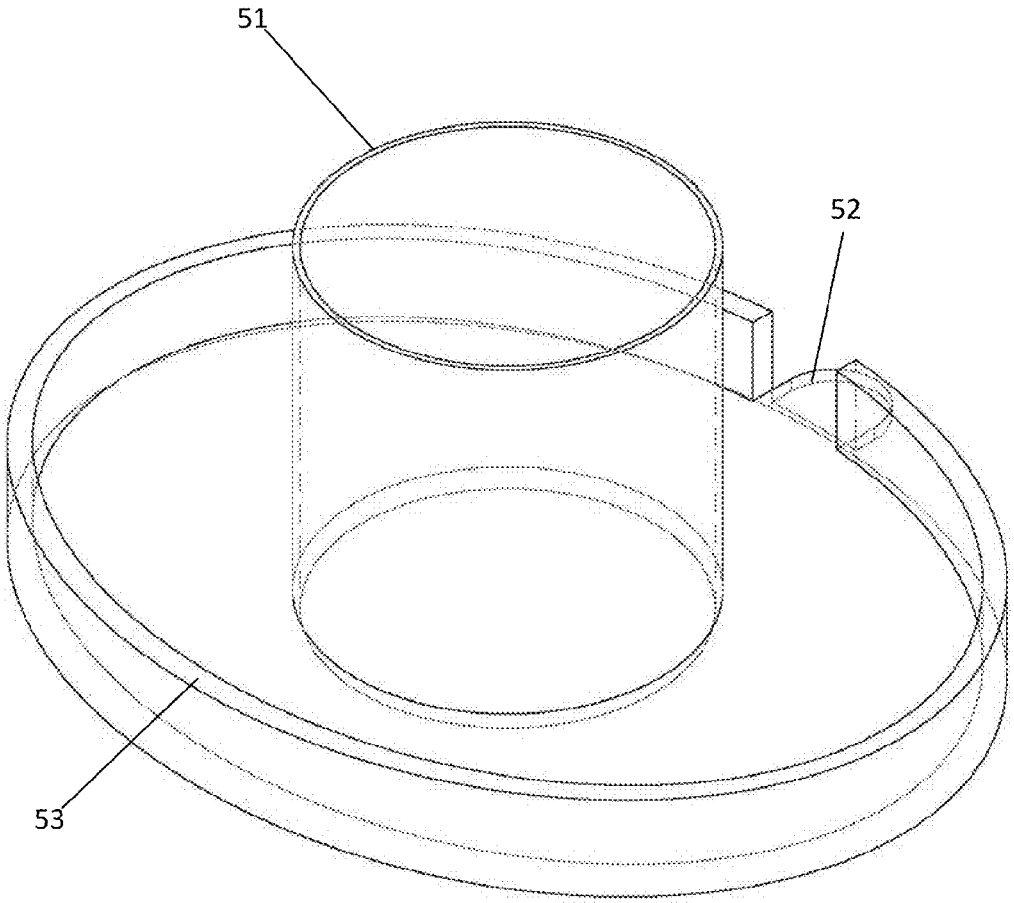
FIG. 1H shows the isometric drawing of the first embodiment bottom cover.

First Embodiment—FIGS. 1 to 1H

FIG. 1 displays the isometric drawing of the diverse container material removal machine. The embodiment will be used to vibrate and shake user inserted diverse containers ranging in size from very small, such as makeup containers, to large containers, such as laundry detergent containers, and transfer the contents of the container from the sides and bottom of the container to the opening of the container. The embodiment is a self contained table top device which has several different removable inserts for various sized containers. The embodiment consists of an adjustable hold down device clamped in place at the proper location to apply a downward force to hold the containers in place. It has a main housing with a funnel or other type of opening to capture the neck and shoulders of the container which will shake and vibrate the container driven by a motor with a cam and cam arm controlled by a timer. The overall shape of this embodiment is elliptical and is nine inches long, seven inches wide and eight inches tall, not including the extended hold down. The embodiment should not be limited to the elliptical shape as other shapes such as square, round, polygon etc. may be used. The embodiment should not be limited to the dimensions given as they may change on this embodiment or different embodiments. The embodiment will be made from a colored polycarbonate plastic but may consist of other materials such as polyethylene, polypropylene, stainless steel, etc. Safety covers are also included for the top and bottom of the embodiment for user safety. A variety of colors may be used.

FIG. 1A shows the conceptual isometric view of the same embodiment so the overall embodiment may be visualized without the hidden lines.

FIG. 1B shows the embodiment with separated components in a conceptual view so the embodiment components may be better visualized for the component descriptions.

FIG. 1C shows the conceptual isometric view of the embodiment with a container inserted into the embodiment opening and held in place by the adjustable hold down device.

FIG. 1D shows the isometric view of the adjustable container hold down device. The frictional container bottom fill extension, 20, is shown as a half sphere and attached to the hold down plate, 21, will make contact with an inserted container (not shown). The material may be a type of rubber for its frictional properties but other materials may be used such as polyurethane, polyethylene, etc. It will be attached by screw, adhesive, etc. or combination of several of these. It may also be a complete molded assembly. The hold down plate is also attached to the rod attachment block, 22, which may be attached using a screw, rivet, adhesive, etc. or any combination of these. It may also be part of a molded assembly. The connecting rod, 23, is attached to the rod attachment block, 22, and the extension rod block, 24. It will be connected by pressing it in, or using some type of screw, rivet, pin, adhesive, etc. or any combination of these. The inner extension rod, 25, is housed inside the outer extension rod which is a tube, 28, and is connected to the extension rod block at the top by being pressed in or pinned, screwed, riveted, adhered, etc. or any combination of these. The rods are designed as steel but should not be limited to steel as they may be UHMW, polyurethane, aluminum, etc. When the extension rod and the cover are extended, it can be clamped in place by the clamp, 26, which may be a screw clamp or a pivot clamp or some other type of clamp. The clamp will screw into or pass through the bushing, 27, which may be brass, steel, plastic, etc. and clamp against the inner rod. When the inner rod fully extends, it will catch against the top of the outer extension rod and lift it up. The clamp will then press against the outer rod and clamp it off while the upper rod is fully extended and held up by the container. The outer rod is limited in its travel by the bushing which is inserted, pressed, glued or some other attachment method into the main housing. Total travel on the extension rods is designed to be approximately fifteen inches of height. It should not be limited to fifteen inches as it could vary on its maximum height.

FIG. 1E shows the isometric view of the funnel/opening for holding the neck and/or shoulders of the inserted container, the reduction inserts and the protective ring. The funnel/opening, 32, will sit loosely in the main housing (described below). The rollers, 34, ride on short tracks in the main housing and the rollers may also be rubber rollers, plastic rollers, steel rollers, bearings, etc. The rollers are held in place by mounting blocks on the edges of the funnel/opening, 33, and are designed to be part of the funnel/opening mold but may be a different material and attached by means of a different method such as adhesive, screws, rivets, etc. or any combination of these. On the motor side of the funnel/opening is a mounting block for cam arm bracket (described below). The cam arm bracket mounting block, 35, is designed to be part of the funnel/opening mold but may be a separate item and attached by a different method such as adhesive, screw, rivet, etc. or any combination of these. The larger reduction insert, 31, is designed to fit inside the funnel/opening and hold containers which may otherwise fall through the large opening. The small reduction insert, 30, will fit into the larger reduction insert and be used for holding containers which are too small for the larger reduction insert. Both inserts are held in by gravity, the weight of the container, and the force generated by the hold down assembly. The inserts are designed to be molded plastic but should not be limited to plastic and may be aluminum, light gage steel, etc. The funnel/opening is also designed to be molded plastic but may be a similar material as the reduction inserts. The protective ring, 29, is mounted above the funnel/opening and seals off the gaps around the funnel/openings edges so the user cannot get a finger pinched during a shaking or vibration cycle due to accident or negligence. It is open to allow a container to fit inside the funnel/opening without obstructing access. It also acts as a keeper plate for the funnel/opening so it cannot jump out of its tracks on the main housing. The material for the protective ring is designed as polyurethane but may be polypropylene, UHMW, aluminum, steel, etc. and will be secured down by screws but may be secured by some other method such as rivets, adhesive, etc. or any combination of these.

FIG. 1F shows the isometric view of the motor components and cam assembly. The motor, 40, is designed to be a 12V DC motor but should not be limited to this. It may be some other voltage, amperage, and RPM to get the perfect shaking and vibration forces to maximize the frequency of the shaking and vibration generated and move material down a container faster and more completely. The motor used may also be an AC motor and will not require the use of a transformer. Should any fuses be required, they will be mounted to the main housing, 44 (shown later). The cam, 41, is attached to the shaft of the motor and held in place by a set screw. The cam has a rod, 42, extruding from the top of it which may also be a pin, roller, roller bearing, etc. to attach to the cam arm, 38, and convert rotary motion to semi-linear motion. The diameter of the cam and cam rod location may change depending on maximizing the necessary movement of cam arm and funnel/opening to maximize the shaking and vibration forces. Currently the cam is designed at ¾ diameter but it may be some other diameter. The cam arm, 38, attaches to the cam arm bracket with a pin or some other type of connecting mechanism that will allow it to rotate while pushing and pulling the funnel/opening back and forth. The cam arm bracket, 36, attaches to the funnel/opening cam arm bracket mounting block, 35, by screws or adhesive or rivet, etc. or some combination of these. The location of the cam arm bracket mounting block on the funnel/opening, 32, may change and may not be offset as shown. Should this occur, the shape of the cam arm mounting bracket will be changed to fit the new location while able to attach in line with the cam arm. As the motor turns the cam, the cam arm turns with the rotary movement of the cam and pushes and pulls the funnel/opening along its tracks in a linear motion. This is the force that will shake and vibrate the inserted container causing the remaining contents of the container to move to the cap of the container. The motor is held in place by the motor bracket, 39, which will attach to the motor mount, 43. The motor bracket design may change if the size of the motor changes. The motor mount may change if the bracket and motor sizes used are different than shown. The motor mount will be attached to the main housing and will have a shock absorber type material, rubber, soft plastic, cloth, etc. to absorb the vibratory forces moving into the main housing. The motor bracket is designed as steel but may be plastic, UHMW, aluminum, etc. The cam, cam arm, and cam arm bracket are designed as steel but may be a different material such as UHMW, aluminum, stainless steel, etc. The motor mount is designed as plastic but may be steel, aluminum, etc. The motor bracket will attach to the motor mount using screws but may use rivets, adhesive, etc. or any combination of these.

FIG. 1G shows the main housing, 44, of the embodiment. It is elliptical shaped, seven inches wide, nine inches long and eight inches tall. The embodiment should not be held to these dimensions as the dimensions may change. The design of the embodiment is a molded design out of polyurethane but may be made of a different material such as polypropylene, aluminum, etc. It may also be an extruded shape with all the inner components attached separately. The hold down extension rods, 25 and 28 (shown previously), will fit in the extension rod cavity, 45, and the clamping device bushing, 27 (shown previously), will be pressed into the bushing opening, 46, after the extension rods are in place. The protective ring (shown previously) mounting blocks, 47, are shown. The tracks, 48, for the funnel/opening (shown previously) are shown and it can be seen that the tracks will provide an adequate rolling surface for the funnel/opening's rollers (shown previously). There is space in the bottom rear of the main housing for a transformer, 49, to convert the input voltage to the required DC voltage depending on what motor is used. The cord with the wall outlet plug is not shown. The timer to initiate a shaking and vibration cycle, 50, is shown mounted on the front of the embodiment. The timer may be digital or mechanical and may have a display screen or may just be buttons. The design is to have a timer with a thirty second cycle but the run time may be increased or decreased. There will be a stop cycle button in case the user would like to terminate a cycle before the time limit is reached. An on/off switch may be used in place of a timer so the embodiment should not be limited to a timer for initiating a cycle. The wire running between the transformer, timer and motor is not shown but will be present. Sound deadening material and/or vibration absorption material (not shown) may be used inside of the main housing to cut down on sound and vibration forces throughout the main housing. This material may be adhered to the inside or sprayed in or some type of dipping method.

FIG. 1H shows the bottom safety cover which will protect the user from the electrical and moving components. The cylinder extending upward, 51, will surround the bottom of the funnel/opening and container and is open all the way to the surface the embodiment rests on. This will allow the user to clean a spill from an unsecured cap on the container they insert into the embodiment. The extension rod cavity bottom cover, 52, closes off the extension rod cavity (shown previously), in the main housing. The ring around the outer edge of bottom cover, 53, is for mounting the bottom cover to the main housing. The design for the ring is to fit around the main housing and secured with screws but may use rivets, adhesive, etc. or any combination of these to secure it. It may also be redesigned to include mounting blocks in the bottom of the main housing and attached to those, eliminating the ring. This ring design as shown should not be limited to only what is shown and described.

Operation

First Embodiment—FIGS. 1-1H

The operation of the embodiment will involve the user to set the embodiment on a flat surface and plug (not shown) it into a wall outlet. Because the embodiment is all one unit, except for the reduction insert(s), no assembly is required. The user will then select a container and raise the hold down assembly, FIG. 1D, to the desired height to fit the container and insert the container inverted into the funnel/opening, 32, held in place by the main housing, 44. They will then lower the hold down assembly against the bottom of the inverted container securely and tighten the clamp to lock it in place. The shaking and vibration cycle is then initiated by the user pushing the start button (not shown). If left alone without pressing the stop button (not shown), the machine will run for thirty seconds then turn off. When the shaking and vibration cycle is initiated, the motor, 40, held to the main housing, 44, by the motor bracket, 39, attached to the motor mounting block, 43, will begin to run. The motor will turn the cam, 41, and the cam will spin with the shaft of the motor and turn the cam pin, 42, which is offset from the motor shaft and it will rotate the cam arm, 38. The cam arm, which is attached to the cam arm bracket, 36, and held together by a pin, 37, will translate the rotary motion into a linear motion and push and pull the funnel/opening, 32. The funnel/opening will slide along a track, 48 on rollers attached to the funnel/opening in four locations, 34. The protective ring, 29, attached to the main housing at four points, 47, will keep the user from pinching their fingers should they reach in during a shaking and vibration cycle and keep the funnel/opening, 32, from jumping out of track. Once the shaking and vibration cycle is complete by either the timer (not shown) shutting it off or the user pressing the stop button (not shown), the hold down assembly, FIG. 1D, is raised and the container is extracted from the embodiment with as much of the material in the container as possible vibrated and shaken down to the cap of the container. Should the user wish to try and shake and vibrate more material to the opening, they can initiate another cycle. If some of the contents of the container are left in the funnel/opening, it can be wiped out with a damp cloth. If some of the contents of the container get into the bottom cover cylinder, 51, the embodiment can be tipped on its side and the cylinder can be cleaned out with a damp cloth. Once the container is removed and the embodiment cleaned, the embodiment may be put away for storage.

If the desired container is too small for the funnel/opening then the reduction inserts, 30 and 31, can be inserted to hold the smaller container in place and the shaking and vibration cycle can begin.

Description

Figure 2:
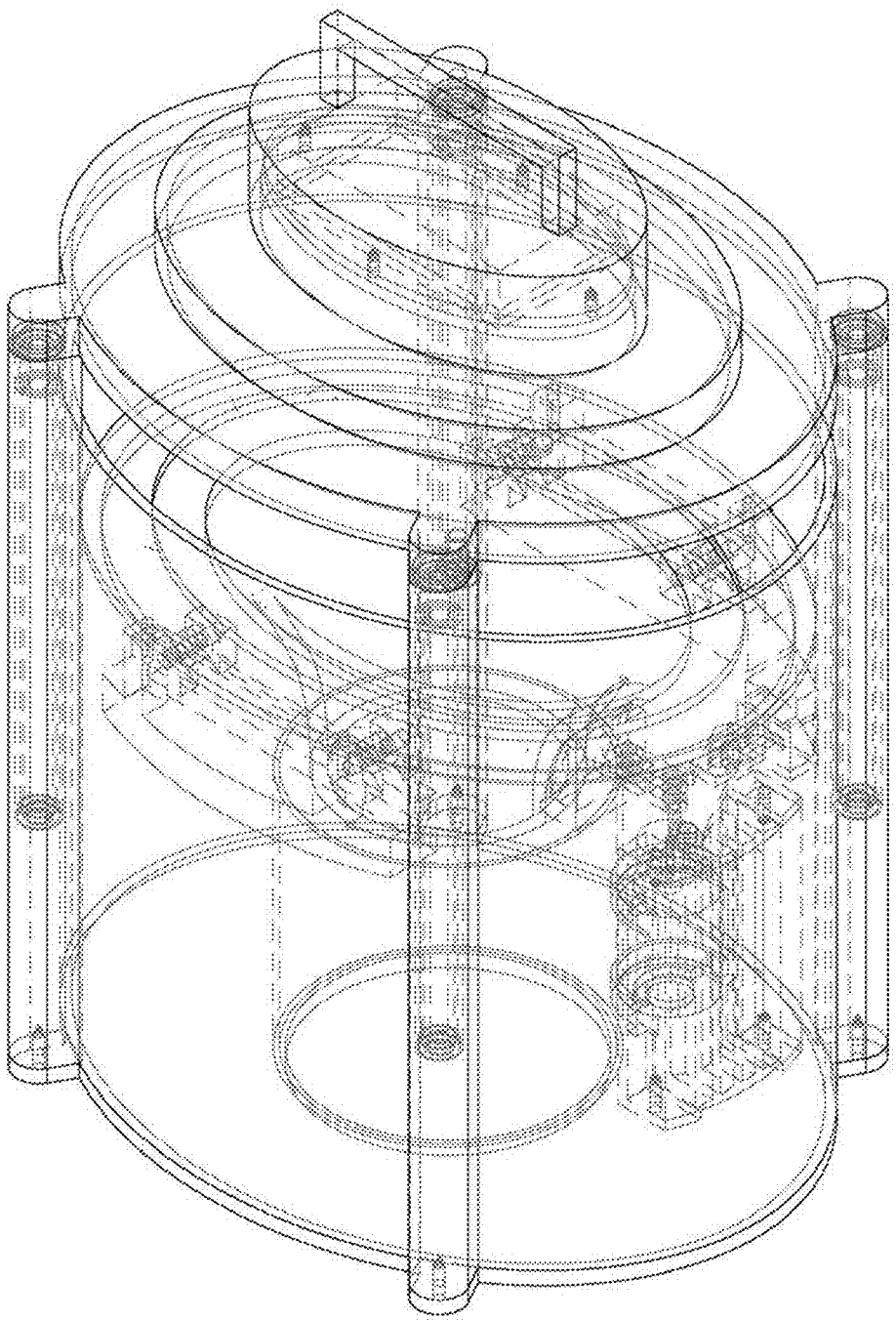
FIG. 2 shows the isometric drawing of the second alternate embodiment complete assembly.

Second Alternative Embodiment—FIGS. 2-2H

FIG. 2 shows the isometric view of the complete second alternate embodiment which is used in the same manner as the first embodiment, to shake and vibrate down otherwise unobtainable material left in household or commercial containers but comprised of different parts. First alternate embodiment has a different hold down, a different main housing, a different motor/cam assembly and a different bottom cover.

Figure 2A:
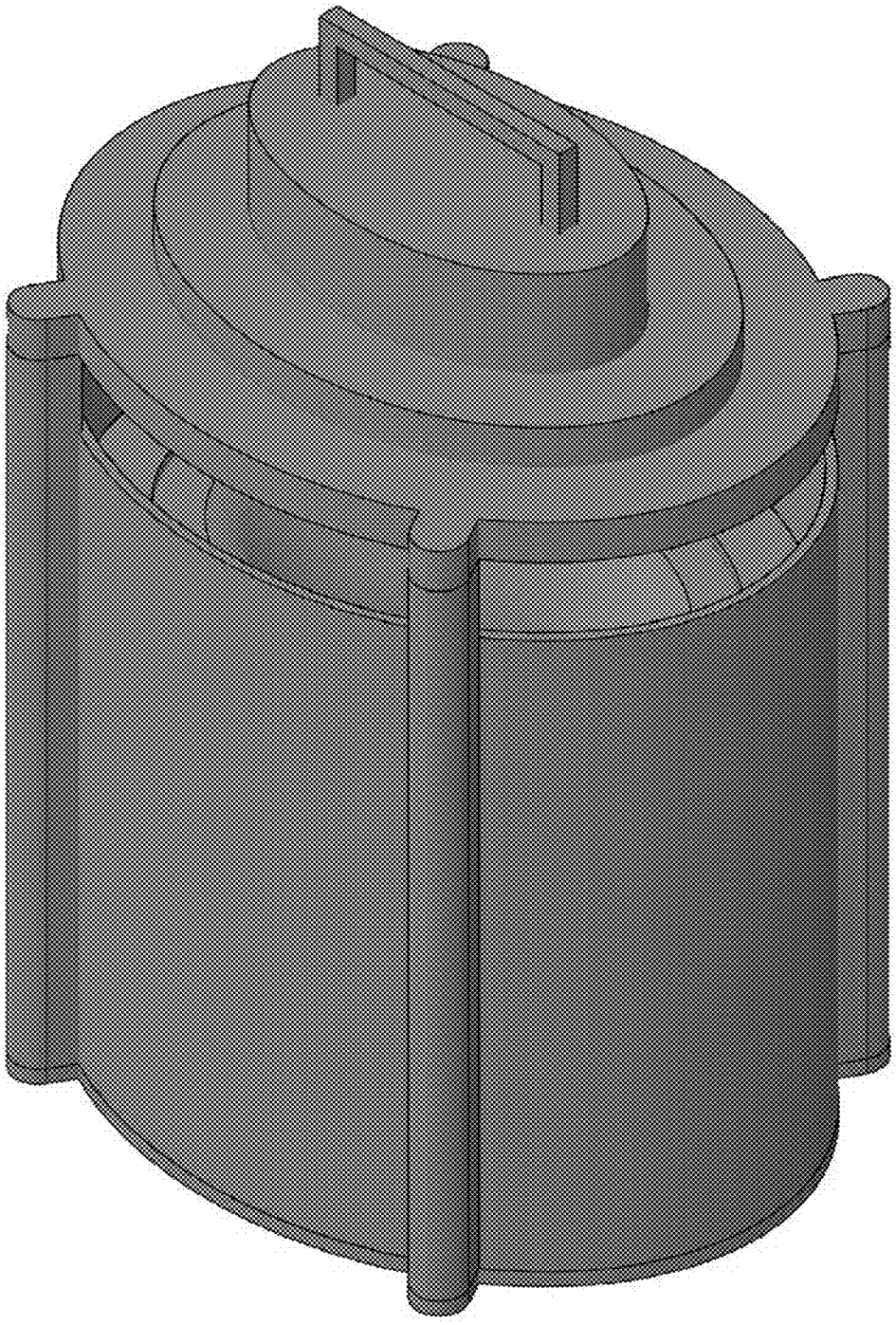
FIG. 2A shows the conceptual isometric drawing of the second alternate embodiment complete assembly.

FIG. 2A shows the conceptual isometric view of the complete second alternate embodiment so it can be seen how the embodiment will look without all the hidden lines.

Figure 2B:
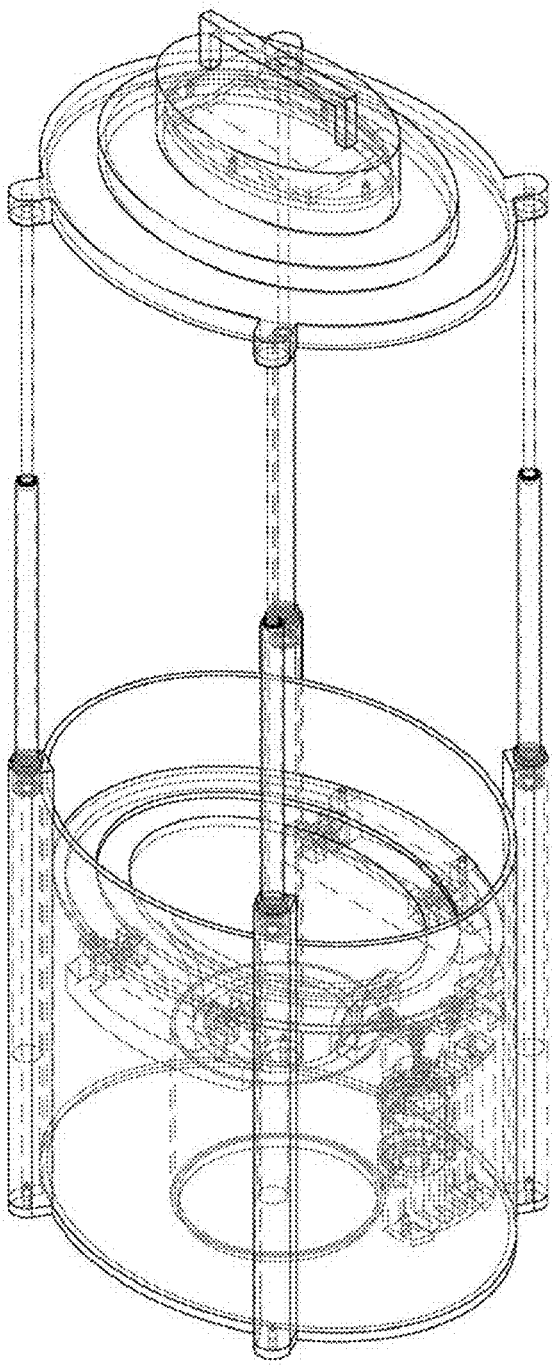
FIG. 2B shows the isometric drawing of the second alternate embodiment with top extended.

FIG. 2B shows the isometric view of the complete second alternate embodiment with the top cover extended to demonstrate the need for the guide arms attached to the top cover.

Figure 2C:
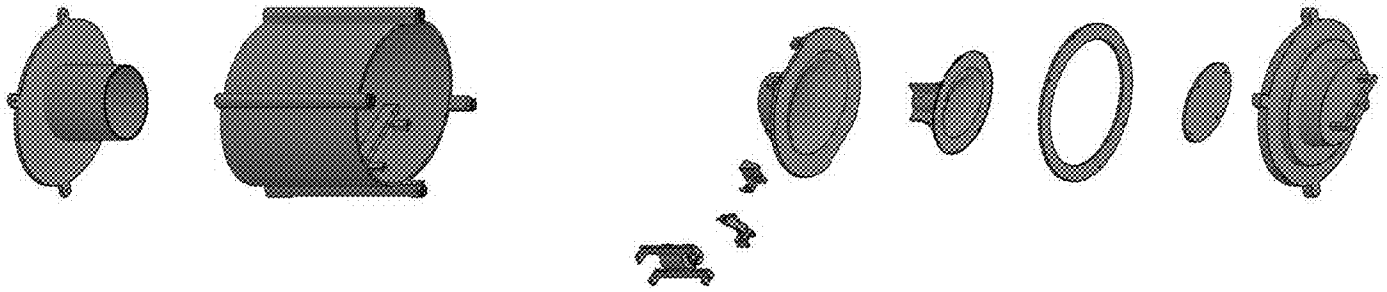
FIG. 2C shows the conceptual isometric drawing of the second alternate embodiment with separated parts.

FIG. 2C shows the conceptual isometric view of the second alternate embodiment with the components separated for reference.

Figure 2D:
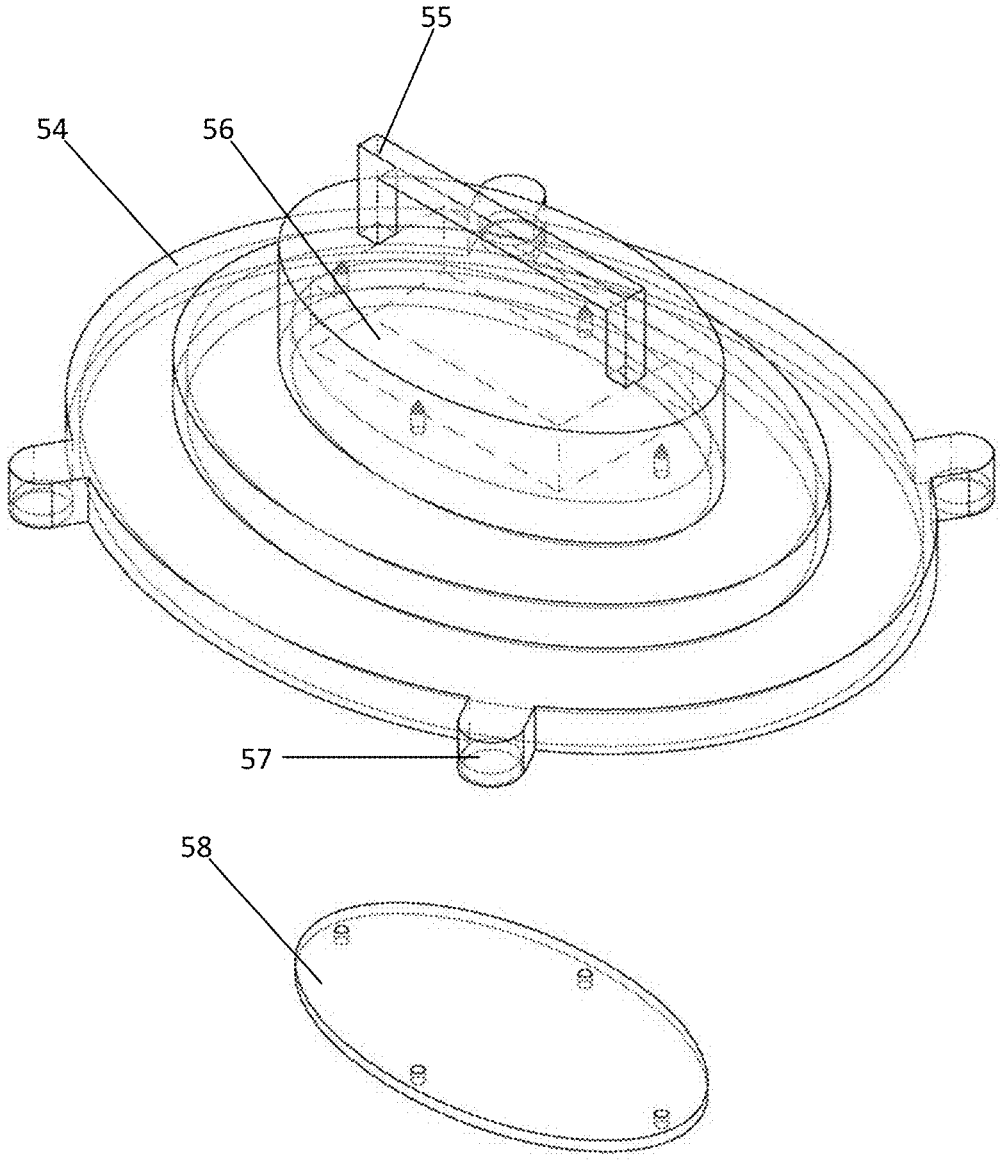
FIG. 2D shows the isometric drawing of the second alternate embodiment hold down cover.

FIG. 2D shows the isometric view the top cover of the second alternate embodiment. The top cover, 54, is designed with a step design to capture the various bottoms of diverse containers, which are inserted upside down, and hold them in place during a shaking and vibration cycle. The initial design for the inside of top section is smooth plastic but a friction surface such as rubber or some similar material may be added to better hold the diverse containers in place. The handle, 55, is for the user to grab and lift the top cover. The handle is not necessarily limited to what is shown but may be a knob or something similar to allow a user to lift the top cover. The top cover telescopes up on four extension rods which are attached in the pockets, 57, by a pin or a threaded connection or adhesive, etc or a combination of several of these. The pockets are designed to fit around the rod keepers on the main housing (shown later) to allow it to rest flat against the main housing. The small cover, 58, encloses a cavity to hold a weight (not shown) which will be inserted and gives the top cover the weight necessary to hold a container in place during a shaking and vibration cycle. The weight will be made from steel, lead or some other similar heavy material and the cover will be held in place with four fasteners. This cover is currently designed for screw fasteners but should not be limited to screws. The weight pocket may also be designed to be accessed from the top with a solid, permanent housing on the bottom and the removable cover on top. In this case the handle, 55, may be attached to the cover or to the top section in a different manner than shown.

Figure 2E:
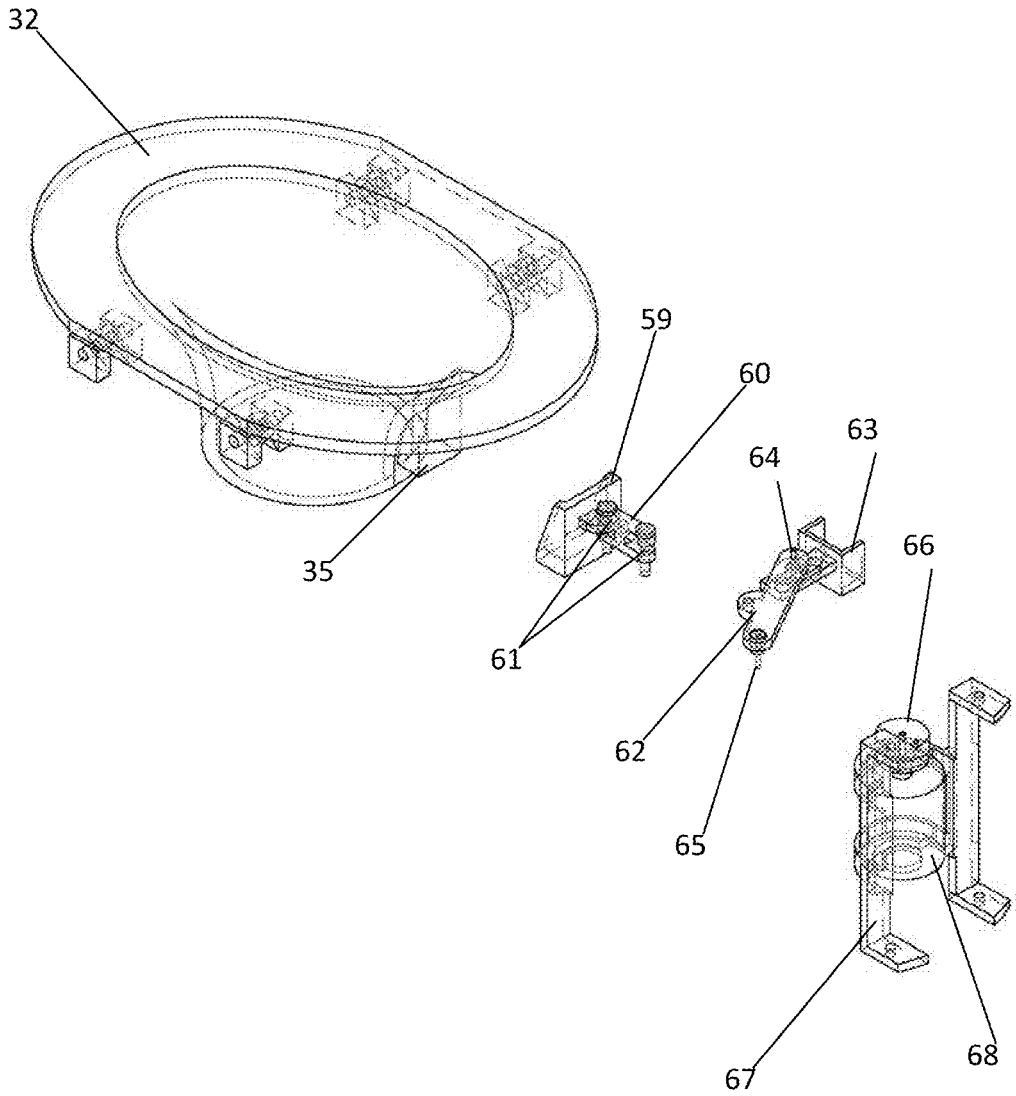
FIG. 2E shows the isometric drawing of the second alternate embodiment funnel/opening, motor, and drive components.

FIG. 2E shows the funnel/opening and motor and cam assembly. It does not show the protective ring and the reduction inserts because they are unchanged from the first embodiment. The funnel/opening, 32, is also unchanged and shown for reference. The cam arm bracket, 59, attaches to the cam arm bracket mounting block, 35, similar to the first embodiment. The bracket is attached using screws, pins, rivets, adhesive, etc. or some combination of these. The cam arm, 60, attaches to the cam arm bracket, 59, and the lever arm, 62, using attachment pins, 61. The design is for using pins but alternative methods of attachment may be used and it should not be limited to pins. The roller bearing or pin, 64, allows the lever arm, 62, to slide along fulcrum bracket, 63, which is slotted and which is attached to the main housing, FIG. 2F, at the fulcrum bracket mounting block, 71 (shown later). The cam roller bearing, pin, rod, etc., protruding from the cam, 66, which is slightly different than in the first embodiment due to the lever relationship, is attached to the lever arm and is offset from the center of the cam. This allows the lever arm to freely rotate with the motors' rotations. The movement this creates is a back and forth motion in the direction of the cam arm which will drive the funnel/opening rapidly during a vibration and shaking cycle. Other methods of driving the funnel/opening back and forth will be addressed in additional alternative embodiments. The motor, 68, is held in place up against the main housing, FIG. 2F, on the motor mount similar to the first embodiment by the motor bracket, 67. Lengths, materials and locations of the cam arm, lever, brackets, attachment points and type and size of bearings may change as the design requires but the general concept of using a lever to move the funnel/opening to shake and vibrate a container is consistent in this second alternate embodiment.

Figure 2F:
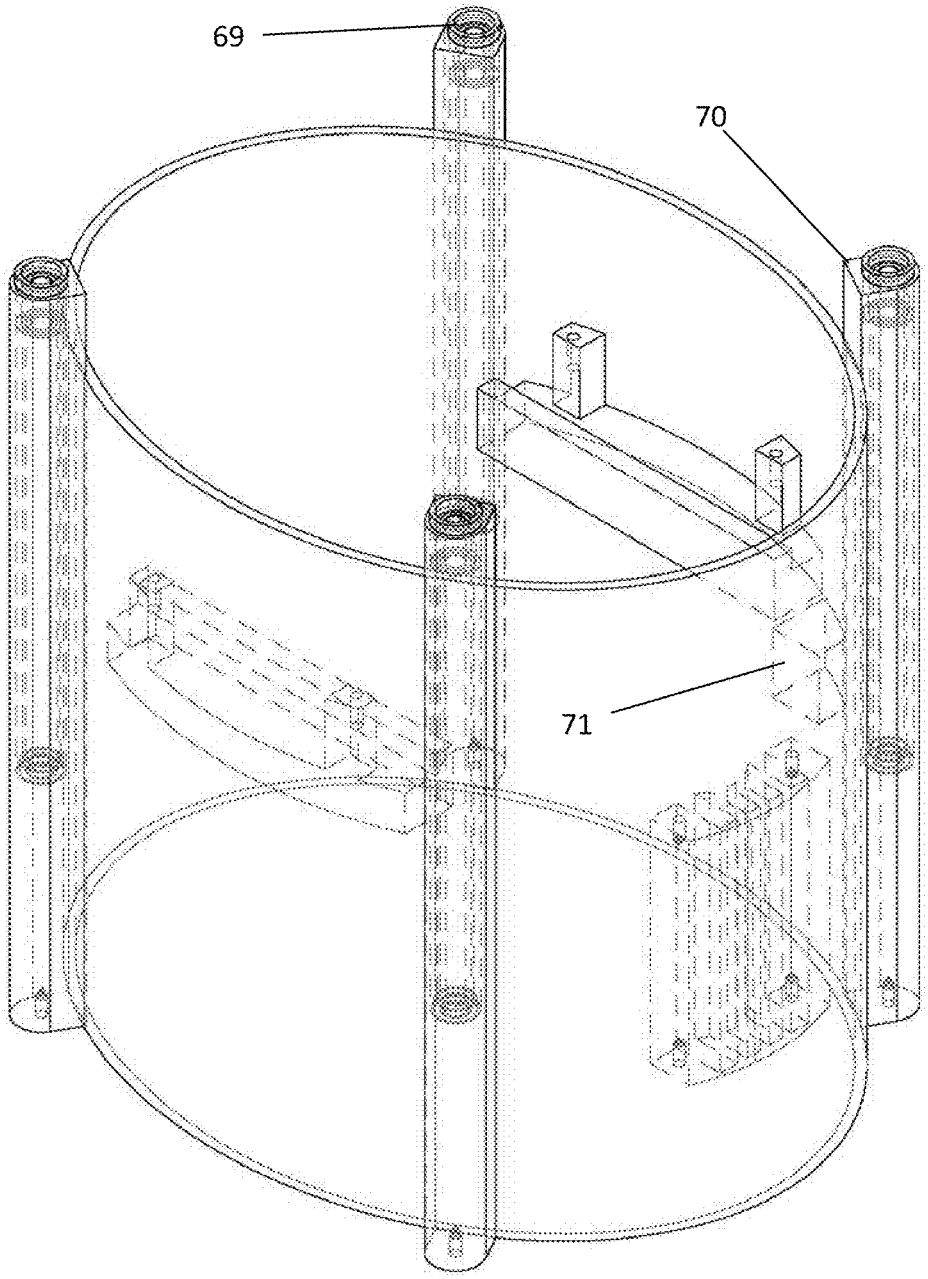
FIG. 2F shows the isometric drawing of the second alternate embodiment main housing.

FIG. 2F shows the isometric view the second alternate embodiment main housing which is comprised of the enclosure to contain all the components and several different mounting blocks for components to attach to. It is elliptical in shape, as shown it is nine inches long, seven inches wide and eight inches tall. It reaches eleven inches with the top cover in place shown in FIG. 2D. The track, motor mount and protective ring mounting blocks remain unchanged from the first embodiment. A track is required but the length and exact material may change or be changed with alternative models. The fulcrum bracket mounting block, 71, for the lever fulcrum bracket, 63, to attach to is designed to be part of the mold. The fulcrum mounting block may also be a separate block attached by a different method and may be made of steel, aluminum, plastic, etc. and should not be limited to part of the mold. It may be attached by screw, adhesive, rivet, etc. The housings for the extension rods, 70, contain the extension rods, 69, which hold up the top cover. The extension rods are raised by the top cover and are used primarily for guiding the top cover, not holding it up. The design shown allows the top cover to be raised twelve inches but an alternative method may be used for guiding the top section and the distance may change as the design requires. There is also a timer switch (not shown) which is similar to the first embodiment. Should a DC motor be used, there will be a transformer (not shown) housed in the rear of the unit with a cord (not shown) running through an opening in the main housing (not shown) to a wall plug. The transformer will be 3V, 6V, 9V, 12V or 24V stepping down from 110/220 AC voltage. Future units may be battery operated which will be placed accordingly within the main housing and access to change the batteries.

Figure 2G:
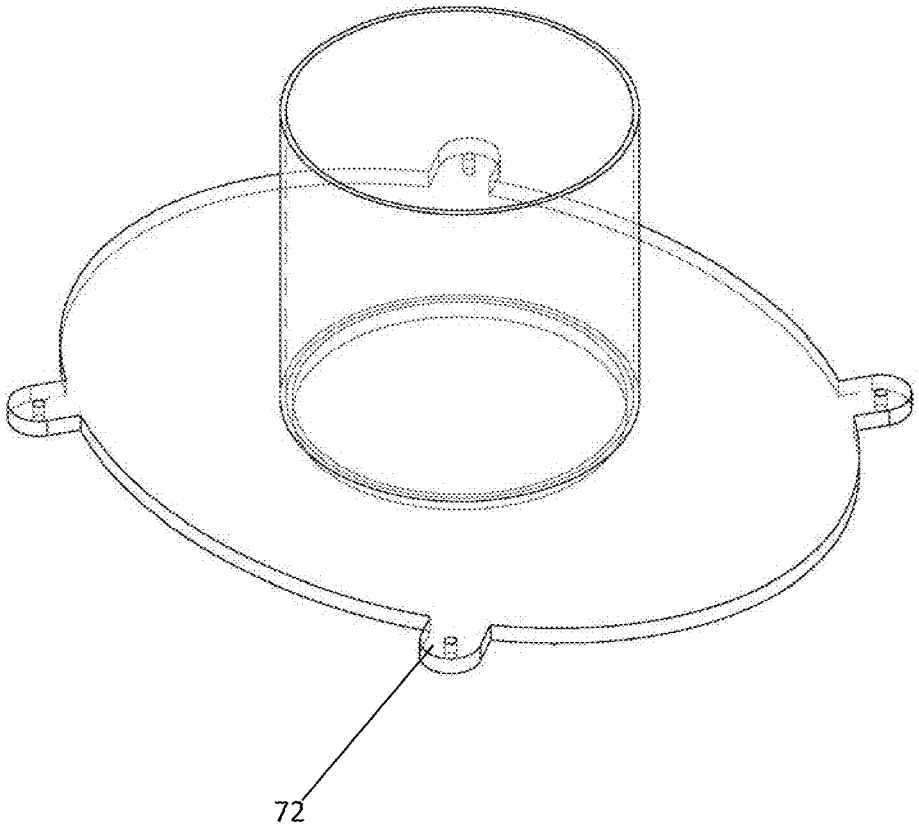
FIG. 2G shows the isometric drawing of the second alternate embodiment bottom cover.

FIG. 2G shows the isometric view of the bottom cover. It works similar to the bottom cover in the first embodiment but has bottom cover extension rod cavity covers, 72, in four places rather than one to enclose the extension rod housings. The method of attaching the bottom cover is designed to use the extension rod covers and attach to the extension rod housings by a pressed in fastener attached to the extension rod covers. This should not be limited to this method and bottom cover attachment blocks may be added to the main housing to attach the bottom cover to. A ring like the first embodiment may be added and attached similar to the first embodiment. The method of attachment may be screw, rivet, adhesive, etc. or some combination of these.

Operation

Second Alternative Embodiment—FIGS. 2-2G

The operation of the second alternate embodiment will involve the user to set the embodiment on a flat surface and plug (not shown) it into a wall outlet. Because the embodiment is all one unit, except for the reduction inserts, no assembly is required. The user will then select a container and raise the top cover, 54, to the desired height to fit the container and insert the container inverted into the funnel/opening, 32, similar to the first embodiment. They will then center the bottom of the container against the top cover and rest the weighted top cover against the bottom of the inverted container which holds it in place in the funnel/opening by lowering the cover until it meets the container. The shaking and vibration cycle is then initiated by the user pushing the start button (not shown). If left alone without pressing the stop button (not shown), the machine will run for thirty seconds then turn off. When the shaking and vibration cycle is initiated, the motor, 68, held to the main housing, FIG. 2F, at the motor mounting block by the motor bracket, 67, will begin to run. The motor will turn the cam, 66, and the cam will spin with the shaft of the motor and turn the roller bearing which is offset from the motor shaft and it will rotate the lever arm, 62, with the spinning cam. The fulcrum of the lever arm will slide along the fulcrum bracket with a slotted attachment, 63, on a pin or roller, 64, to compensate for the spinning attachment at the cam. With the lever arm fixed at the cam and with only forward and backward motion at the fulcrum bracket, it will drive the cam arm, 60, side to side in relation to the front of the embodiment. The cam arm is attached to the lever arm and the cam arm bracket, 59, with pins, 61, to allow it to pivot on both attachment ends. The cam arm bracket is attached to the funnel/opening, 32, at the mounting block, 35, similar to the first embodiment and consequently move the funnel/opening side to side with the motion of the cam arm. The funnel/opening will slide along a track on rollers, attached to the funnel/opening in four locations similar to the first embodiment. The protective ring is attached to the main housing at four points and will keep the user from pinching their fingers should they reach in during a shaking and vibration cycle. Once the vibration cycle is complete by either the timer (not shown) shutting it off or the user pressing the stop button (not shown), the top cover is raised and the container is extracted from the embodiment with as much of the material in the container as possible shaken and vibrated down to the cap of the container. If some of the contents of the container are left in the funnel/opening, it can be wiped out with a damp cloth. The top cover can now be lowered. If some of the contents of the container get into the bottom cover, FIG. 2G, protective cylinder, the embodiment can be tipped on its side and the cylinder can be cleaned out with a damp cloth. Once cleaned, if necessary, the embodiment can be put away for storage.

If the desired container is too small for the funnel/opening the reduction inserts can be inserted to hold the smaller container in place and the shaking and vibration cycle can begin.

Description

Figure 3:
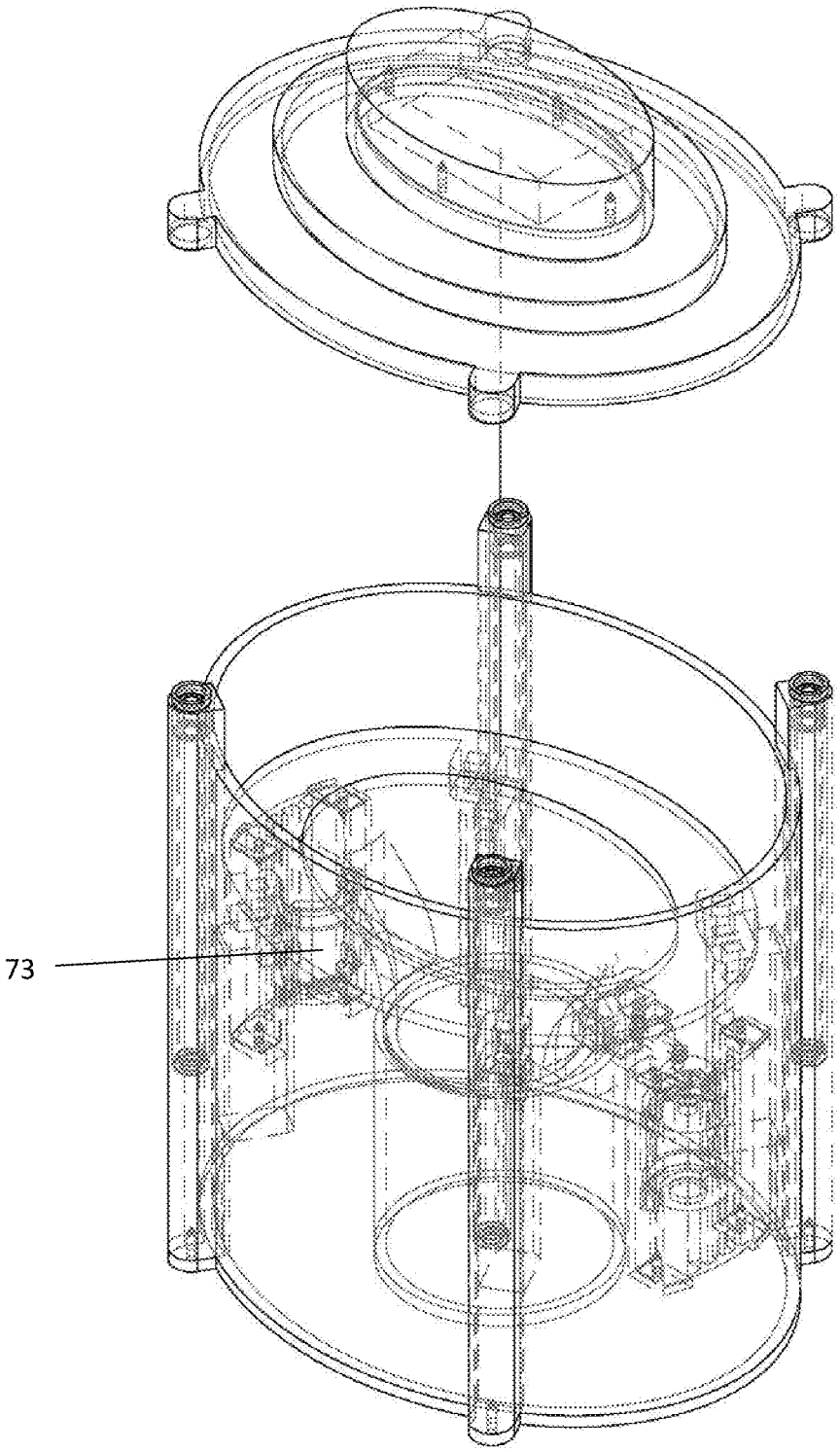
FIG. 3 shows the isometric drawing of the third alternate embodiment complete assembly.

Third Alternative Embodiment—FIG. 3

FIG. 3 shows the isometric view of the third alternate embodiment similar to the second alternate embodiment and the first embodiment. The third alternate embodiment uses the top cover of the second alternate embodiment and the cam and motor setup similar to the first embodiment except it uses two motors with two cam arms, 73, on both ends of the funnel/opening directly connected to the motor cams. The funnel/opening in this embodiment is not sliding like the original embodiment but rather is floating on either springs or rubber pads, to allow both motors to move the funnel/opening side to side as well as allow a slight rotational force.

Operation

Third Alternative Embodiment—FIG. 3

The operation of the third alternative embodiment is similar to the second alternative embodiment and the first embodiment. The difference is the third alternate embodiment uses two motors not in line with each other but offset on either side of the main housing. The funnel/opening is suspended on springs or rubber pads and when a vibration and shaking cycle is initiated, the motors turn the cams which drive the offset cam arms and the forces generated on the funnel/opening are slight twisting forces with back and forth travel.

Description

Figure 4:
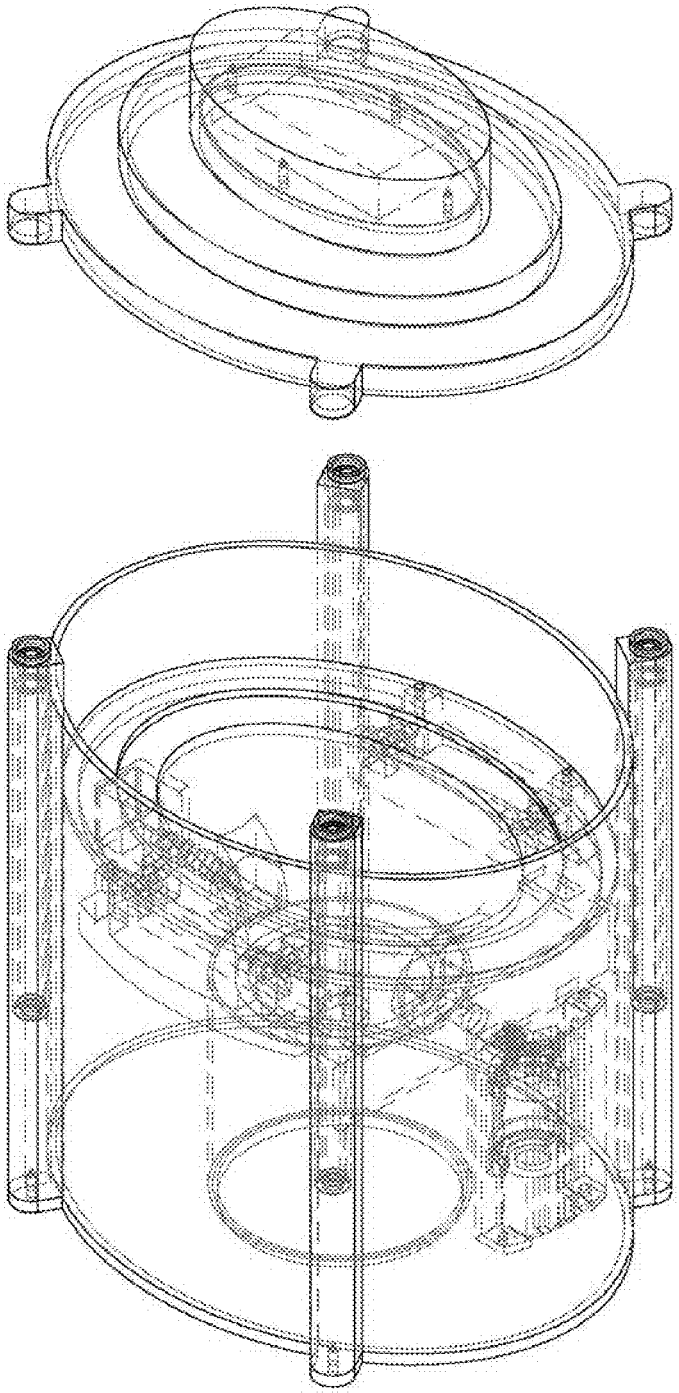
FIG. 4 shows the isometric drawing of the fourth alternate embodiment complete assembly.
Figure 4A:
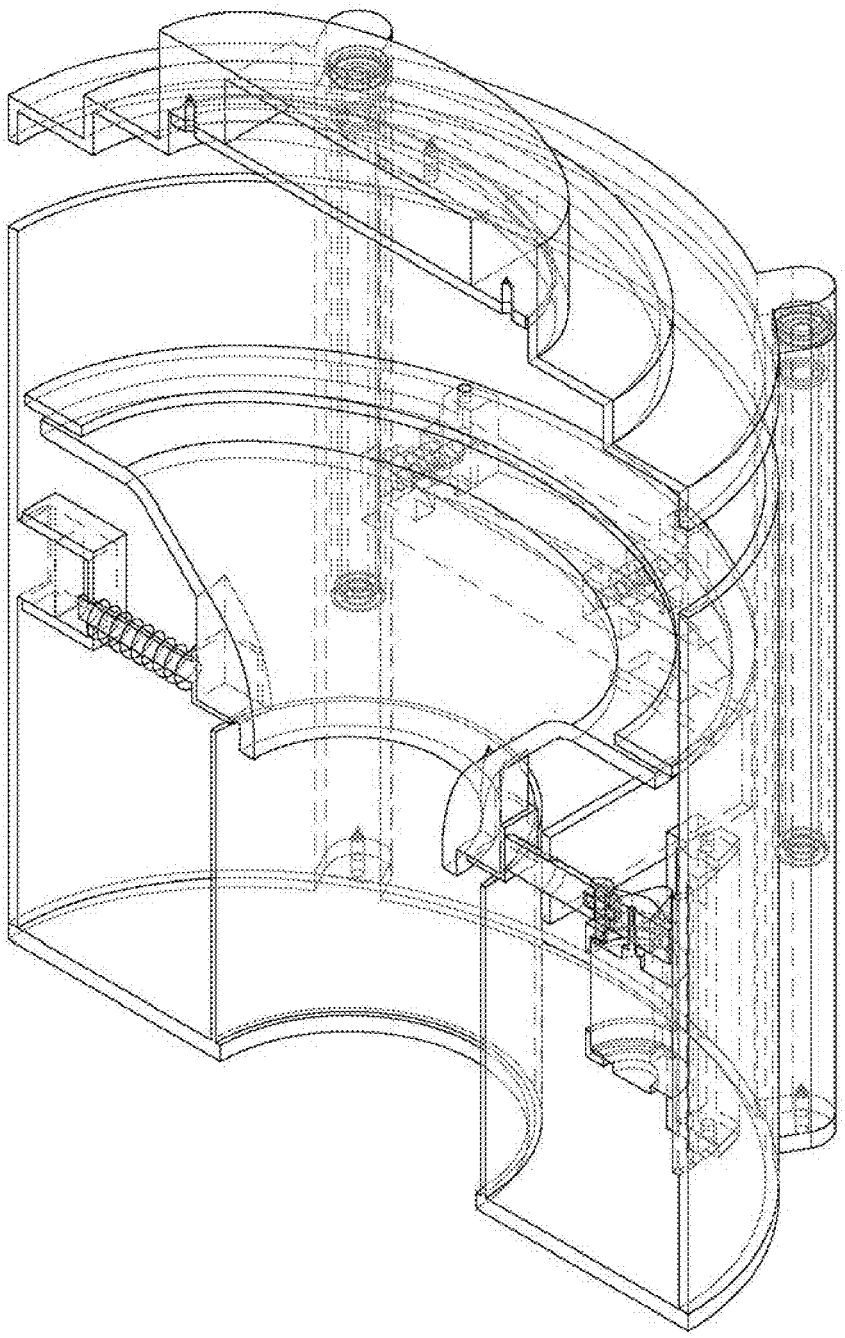
FIG. 4A shows the sliced isometric drawing of the fourth alternate embodiment complete assembly.
Figure 4B:
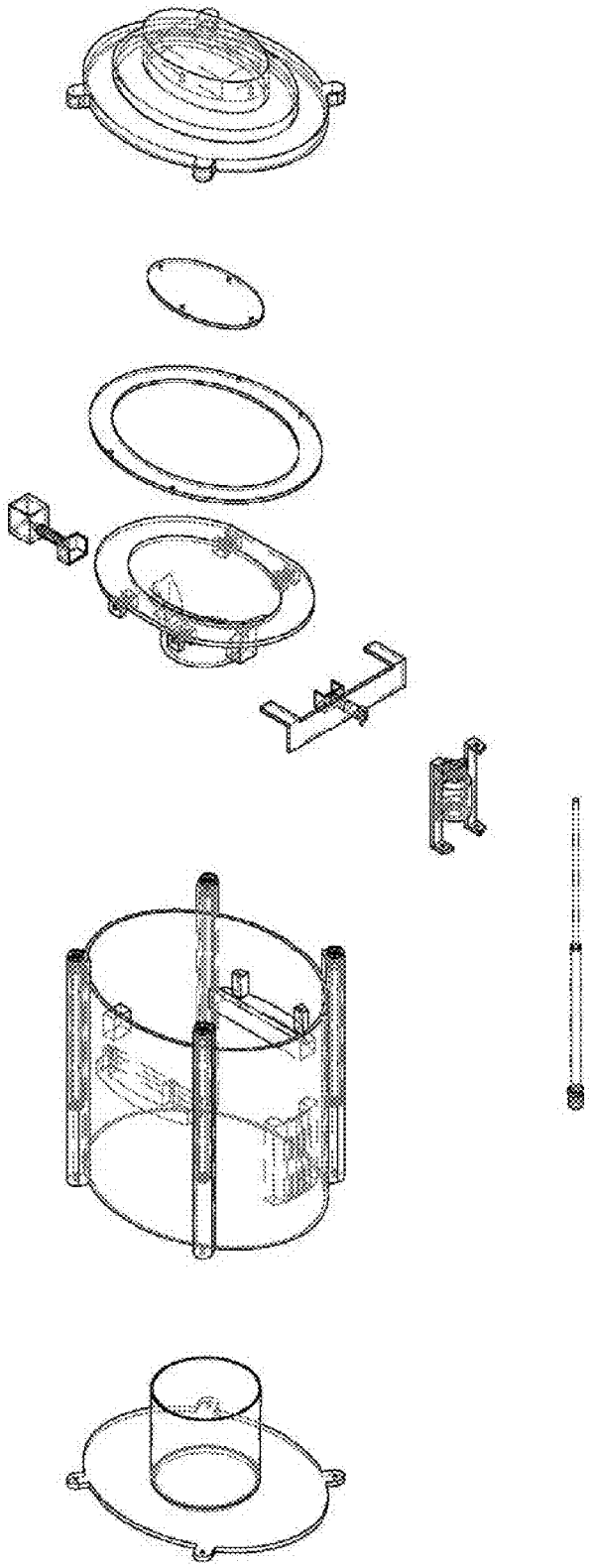
FIG. 4B shows the isometric drawing of the fourth alternate embodiment with separated parts.
Figure 4C:
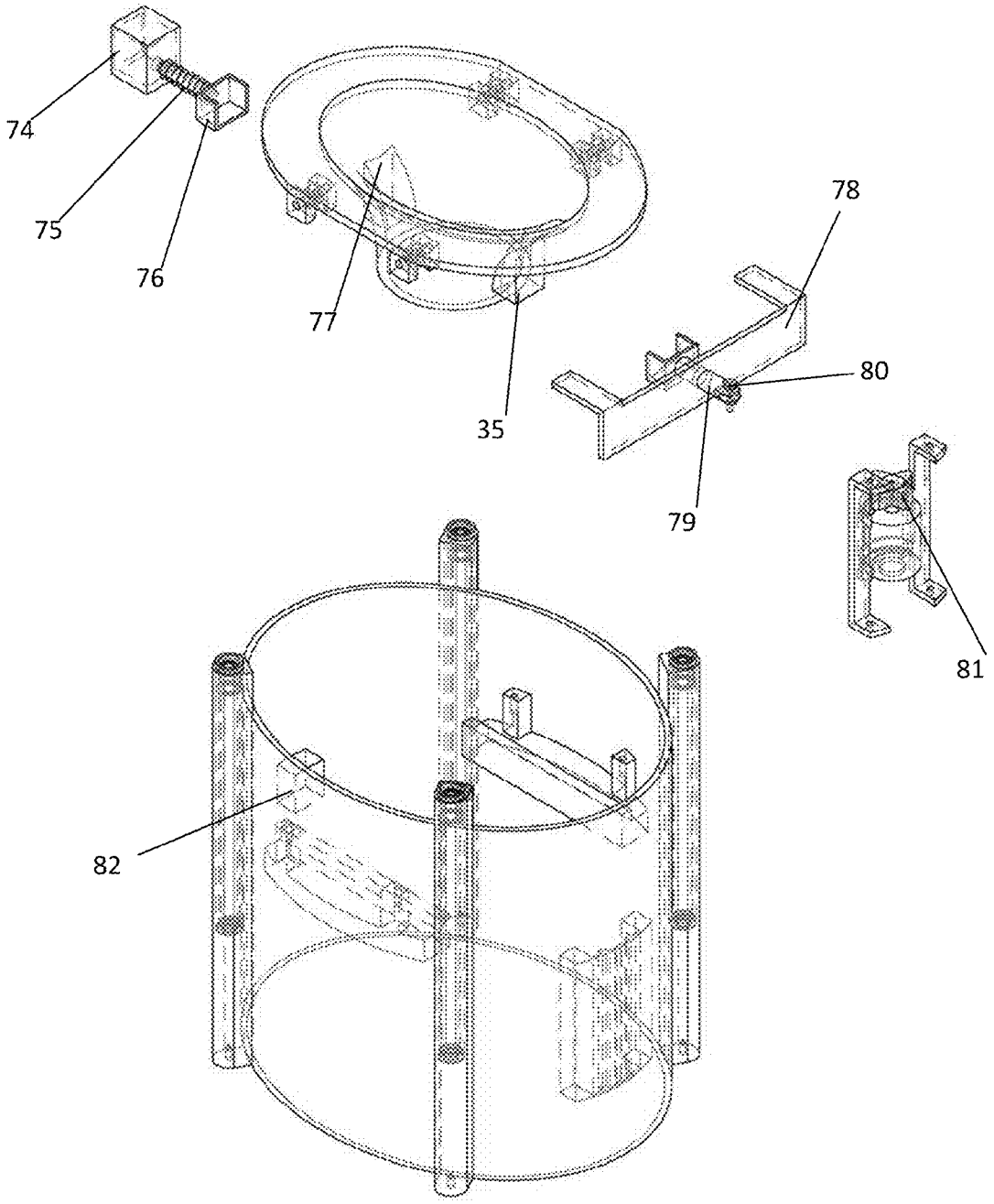
FIG. 4C shows the isometric drawing of the fourth alternate embodiment funnel/opening, drive components, motor and main housing.

Fourth Alternative Embodiment—FIGS. 4-4C

FIG. 4 shows the isometric view of the fourth alternate embodiment which is similar to the second alternate embodiment but uses a different motor/cam drive assembly.

FIG. 4A shows the isometric view of the fourth alternate embodiment sliced so the view of the different configuration can be clearly viewed.

FIG. 4B shows the isometric conceptual view of the fourth alternate embodiment so the components of the fourth alternate embodiment can be viewed without hidden lines for additional clarity.

FIG. 4C shows the isometric view of the fourth alternate embodiment motor/cam and different components to achieve a vibration and shaking motion to vibrate and shake the contents of an inserted container to the cap of the container. The fourth alternate embodiment top cover, main housing, funnel/opening, bottom cover and most other components are similar to the second alternate embodiment. The changes in this embodiment are the cam and motor relationship. This fourth alternate embodiment uses an elliptical shaped plate cam and cam follower pushing against a compression spring to generate the back and forth motion of the funnel/opening and shaking and vibrating the inserted container. A spring arm receiving bracket, 74, mounts to the spring arm receiving bracket mount on the main housing, 82, by screw, rivet, adhesive, etc. or any combination of these. The spring arm bracket, 76, has an arm which the spring, 75, fits over. The spring arm bracket attaches to the spring arm bracket mount, 77, on the funnel/opening. As the funnel/opening moves back and forth, the spring will compress against the spring arm receiving bracket while the spring arm slides in and out of the bracket. Because of this the spring generates a constant force toward the cam follower and motor. On the motor side of the funnel/opening, the cam follower bracket, 79, attaches to the funnel/opening on the mounting block, 35, similar to the first embodiment but the mounting block is in line with motor rather than offset. It is attached by screw, rivet, adhesive, etc. or any combination of these. The cam follower shaft, which is part of the cam follower bracket, passes through a guide bar, 78, to ensure movement in only the direction of travel. The guide bar is attached to the ledges the protective ring mounting blocks are attached to. It will be attached by screw, rivet, adhesive, etc. or any combination of these. The cam follower roller, 80, extends out of the tip of the cam follower arm and will ride against the plate cam, 81, attached to the motor and held with a set screw. The cam shown is an elliptical shape but may be egg-shaped, eccentric or a snail type cam. As the cam turns, it pushes the cam follower and the funnel/opening against the spring which pushes back and generates the back and forth motion desired.

Operation

Fourth Alternative Embodiment—FIGS. 4-4C

The operation of the fourth alternate embodiment will involve the user to raise the top cover of the embodiment and insert the desired container into the funnel/opening, then close the top cover similar to the second alternate embodiment. The user will then initiate the shaking and vibration cycle by pressing the start button (not shown) on the timer. Once initiated, the motor will turn the elliptical plate cam, 81, which will begin to rotate. The cam follower roller or roller bearing will roll against the plate cam and move through the guide bar. The cam follower is attached to the funnel/opening and pushes the funnel/opening toward the spring, 75. The spring, which is attached around the spring arm bracket, 76, and is also attached to the funnel/opening at the mounting block, 77, compresses against the spring receiving bracket, 74. The spring receiving bracket is mounted to the main housing at the spring receiving bracket mounting block, 82. The spring compresses and pushes the funnel/opening and cam follower against the cam and the rotary motion generates the shaking and vibration forces to cause the remaining material in the inserted container to move toward the cap of the container. After the time runs out or if the user chooses to stop the cycle by pressing the stop button (not shown) the cycle ends and the container may be removed.

Description

Figure 5:
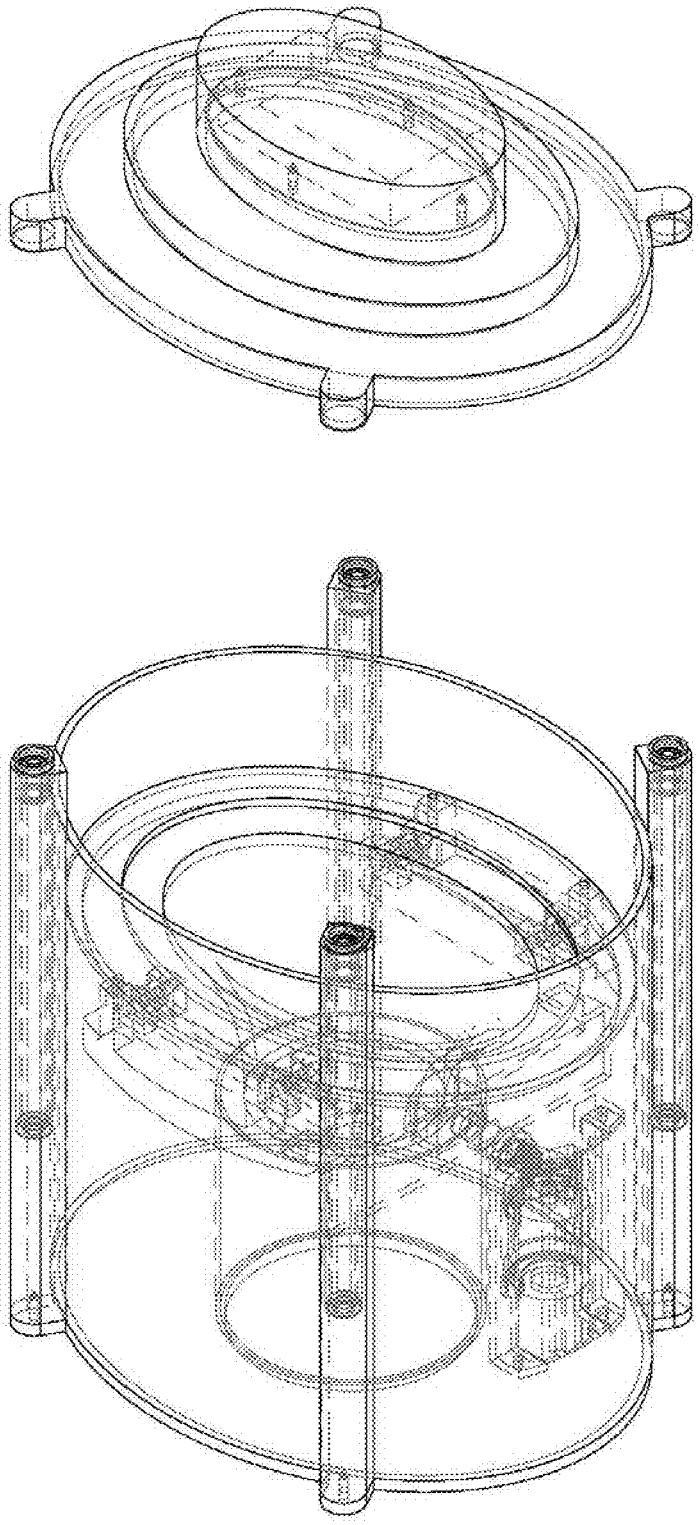
FIG. 5 shows the isometric drawing of the fifth alternate embodiment complete assembly.
Figure 5A:
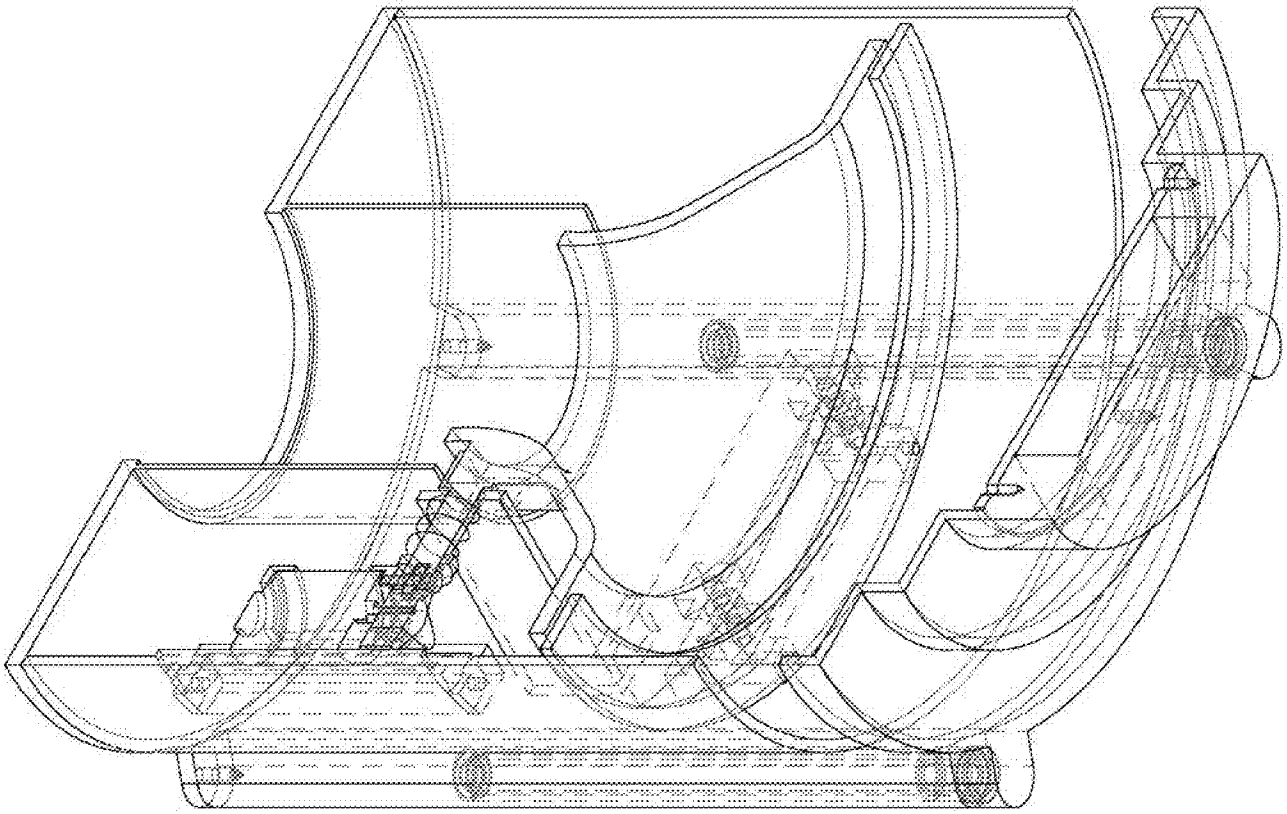
FIG. 5A shows the sliced isometric drawing of the fifth alternate embodiment complete assembly.
Figure 5B:
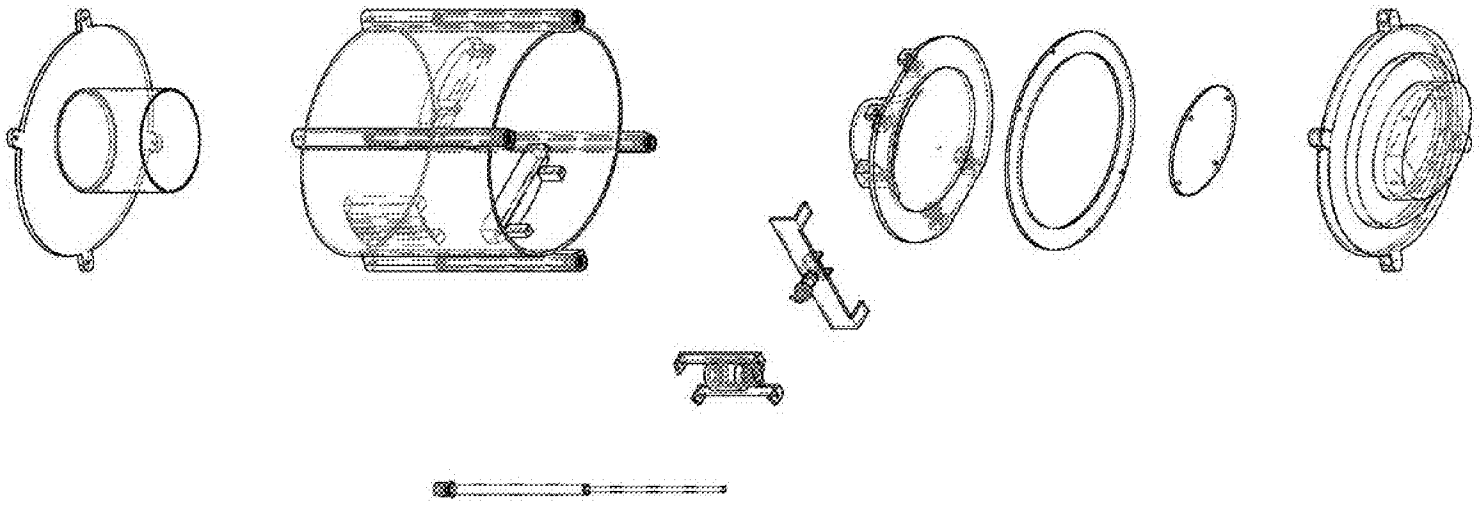
FIG. 5B shows the isometric drawing of the fifth alternate embodiment with separated parts.
Figure 5C:
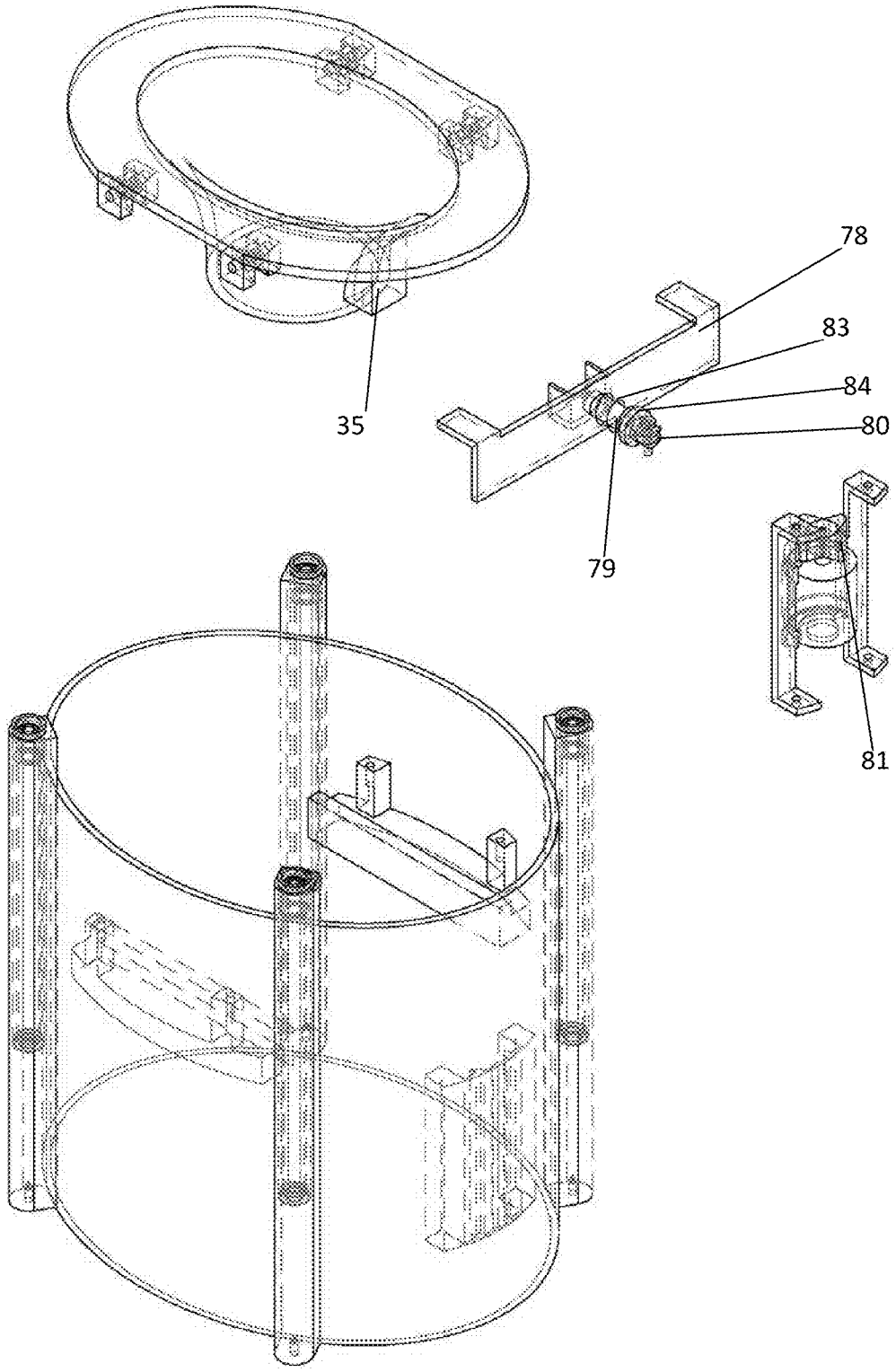
FIG. 5C shows the isometric drawing of the fifth alternate embodiment funnel/opening, drive components, motor and main housing.

Fifth Alternative Embodiment—FIGS. 5-5C

FIG. 5 shows the isometric view of the fifth alternate embodiment which is similar to the fourth alternate embodiment but uses a different spring assembly.

FIG. 5A shows the isometric view of the fifth alternate embodiment sliced so the view of the different configuration can be clearly viewed.

FIG. 5B shows the isometric conceptual view of the fifth alternate embodiment so the components can be viewed without hidden lines for additional clarity.

FIG. 5C shows the isometric view of the fifth alternate embodiment motor/cam and different components to achieve a vibration and shaking motion to vibrate and shake the contents of an inserted container to the cap of the container. The fifth alternate embodiment top cover, main housing, funnel/opening, bottom cover and most other components are similar to the fourth alternate embodiment. The difference is the location of the compression spring. This fifth alternate embodiment uses an elliptical shaped plate cam and cam follower pushing against a compression spring to generate the back and forth motion of the funnel/opening and shaking and vibrating the inserted container. On the motor side of the funnel/opening, the cam follower bracket, 79, attaches to the funnel/opening on the mounting block, 35, similar to the second embodiment but the mounting block is in line with motor rather than offset. It is attached by screw, rivet, adhesive, etc. or any combination of these. The cam follower passes through a guide bar, 78, to ensure movement in only the direction of travel. The guide bar is attached to the ledges the protective ring mounting blocks are attached to. It will be attached by screw, rivet, adhesive, etc. or any combination of these. A spring, 83, and the spring keeper, 84, are located on the cam follower shaft and held in place by the cam follower roller pin. The spring keeper will prevent the spring from escaping the cam follower shaft and gives the compression spring a platform to compress against. The cam follower roller, 80, extends out of the tip of the cam follower arm and will ride against the plate cam, 81, attached to the motor. The cam shown is an elliptical shape but may be egg-shaped, eccentric or a snail type cam. As the cam turns, it pushes the cam follower and the funnel/opening against the spring which causes it to compress between the guide bar and the spring keeper. As the spring compresses, it pushes the cam follower back towards the cam and generates the back and forth motion desired.

Operation

Fifth Alternative Embodiment—FIGS. 5-5C

The operation of the fifth alternate embodiment will involve the user to raise the top cover of the embodiment and insert the desired container into the funnel/opening, then close the top cover similar to the second alternate embodiment. The user will then initiate the shaking and vibration cycle by pressing the start button (not shown) on the timer. Once initiated, the motor will turn the elliptical plate cam, 81, which will begin to rotate. The cam follower roller will roll against the plate cam and move through the guide bar. As the cam follower is pushed toward the guide bar by the cam, the spring, 83, will compress between the guide bar and the spring keeper, 84. The spring applies a constant force against the spring keeper to keep the cam follower rolling against the cam. Because of the elliptical shape of the cam, the cam follower will ride the contour of the cam and cause a back and forth motion. Because the cam follower is attached to the cam bracket which is connected to the funnel/opening, 32, at the mounting block, 35, it will push the funnel/opening back and forth from the direction of the motor. It is a side to side motion from when looking at the embodiment from the front. This motion generates the shaking and vibration forces to cause the remaining material in the inserted container to move toward the cap of the container. After the time runs out or if the user chooses to stop the cycle by pressing the stop button (not shown) the cycle ends and the container may be removed.

Description

Figure 6:
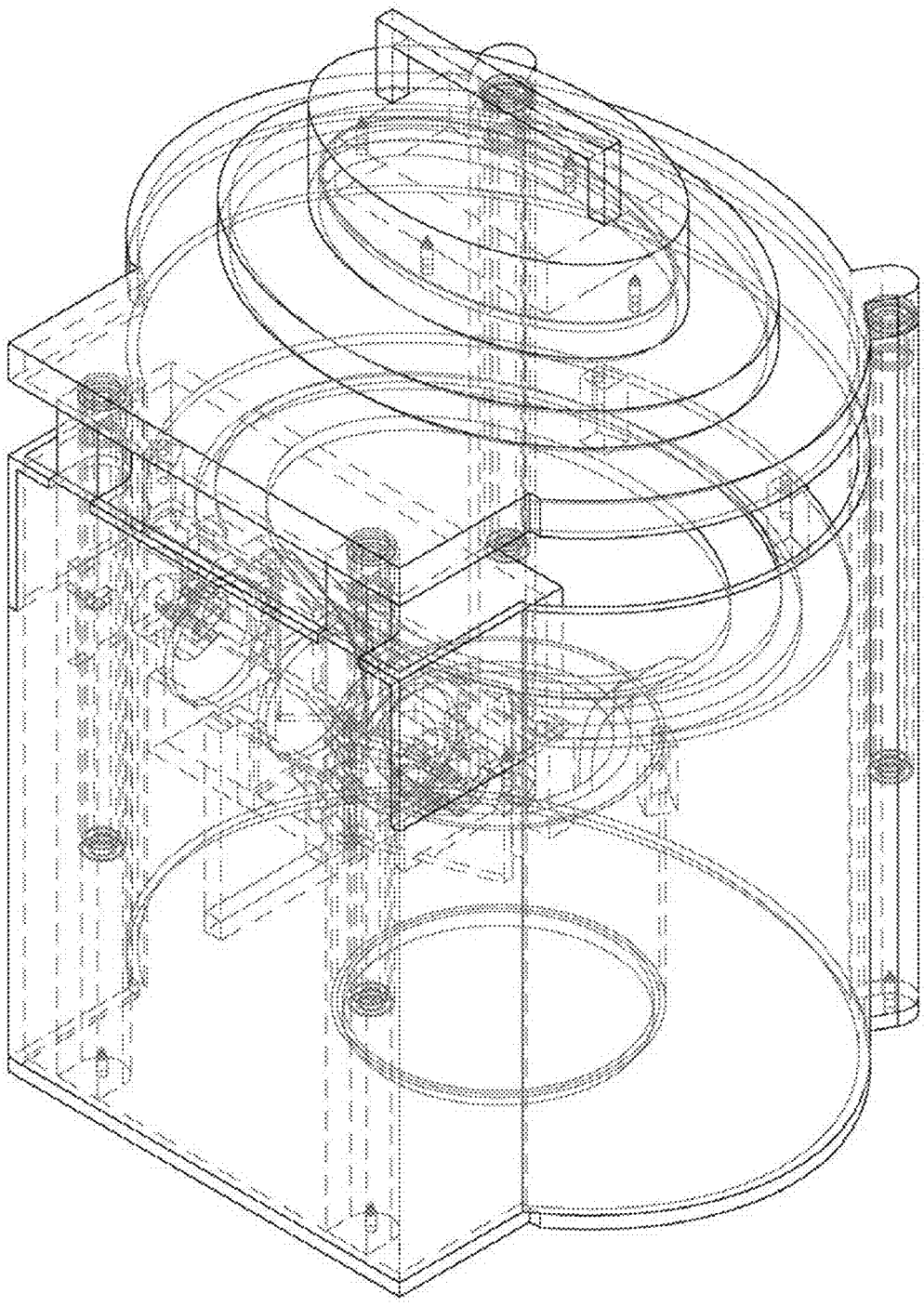
FIG. 6 shows the rear isometric drawing of the sixth alternate embodiment complete assembly.
Figure 6A:
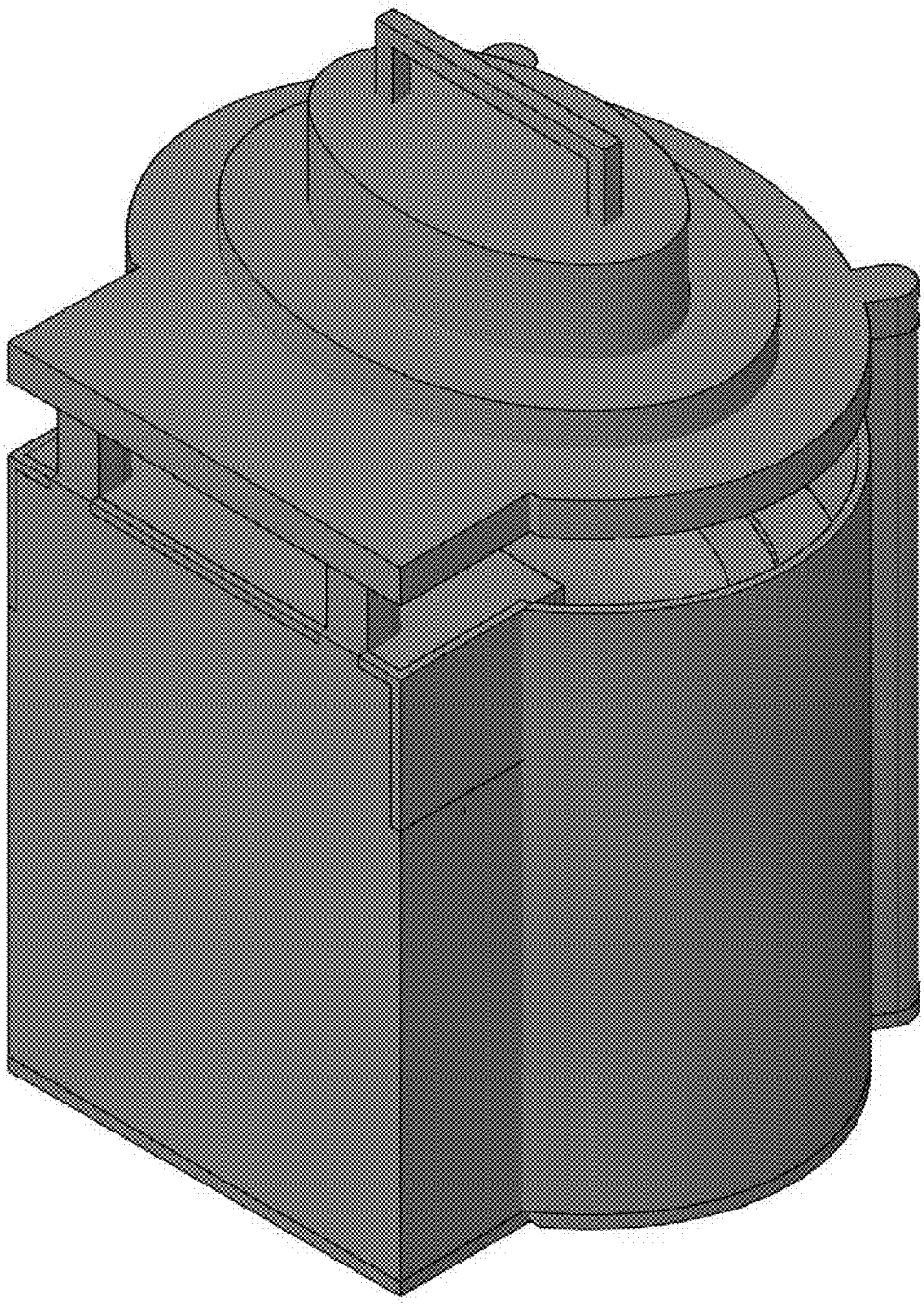
FIG. 6A shows the rear, conceptual isometric drawing of the sixth alternate embodiment complete assembly.
Figure 6B:
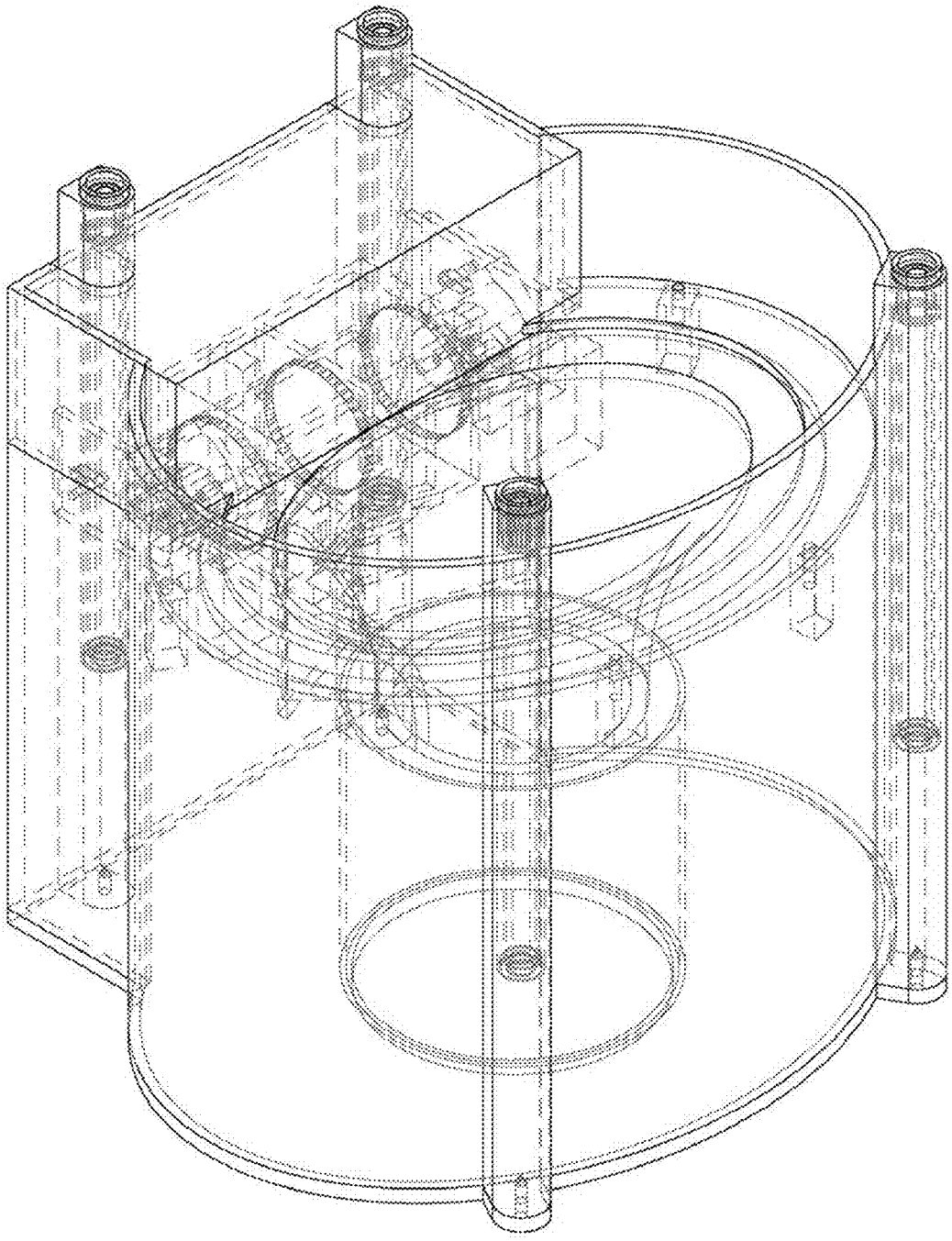
FIG. 6B shows the front isometric drawing of the sixth alternate embodiment assembly.
Figure 6C:
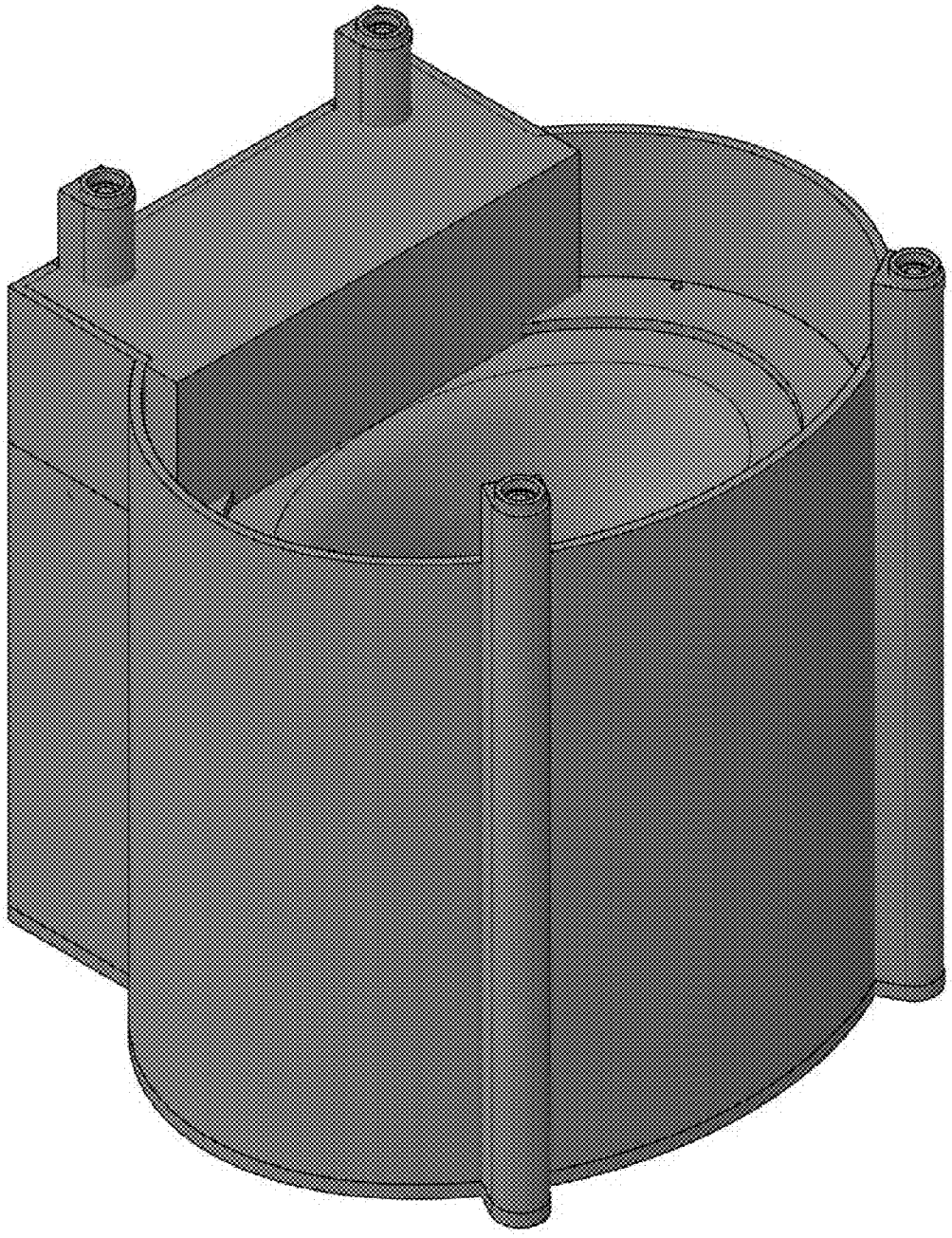
FIG. 6C shows the front, conceptual isometric drawing of the sixth alternate embodiment assembly.
Figure 6D:
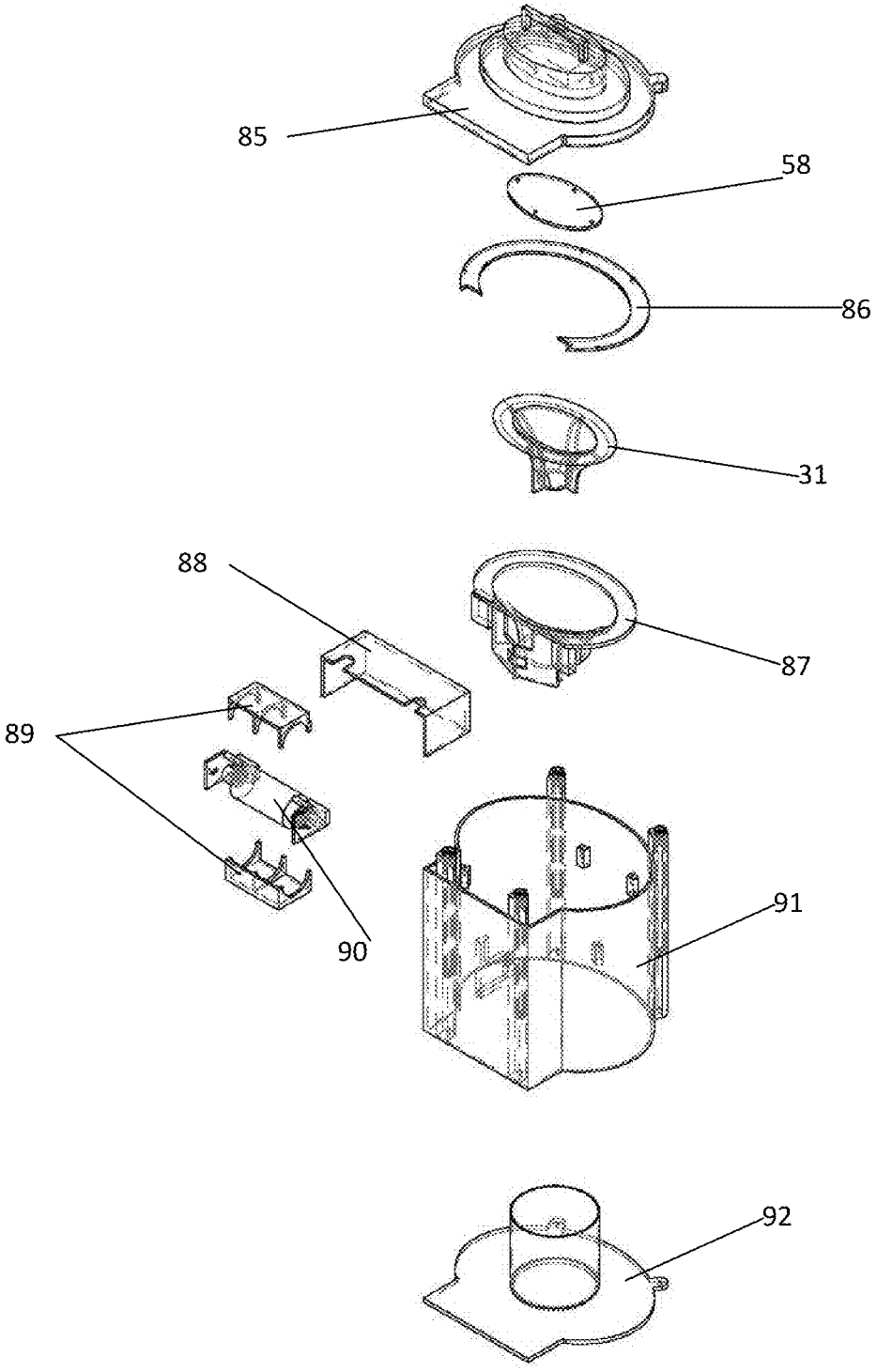
FIG. 6D shows the isometric drawing of the sixth alternate embodiment with separated parts.
Figure 6E:
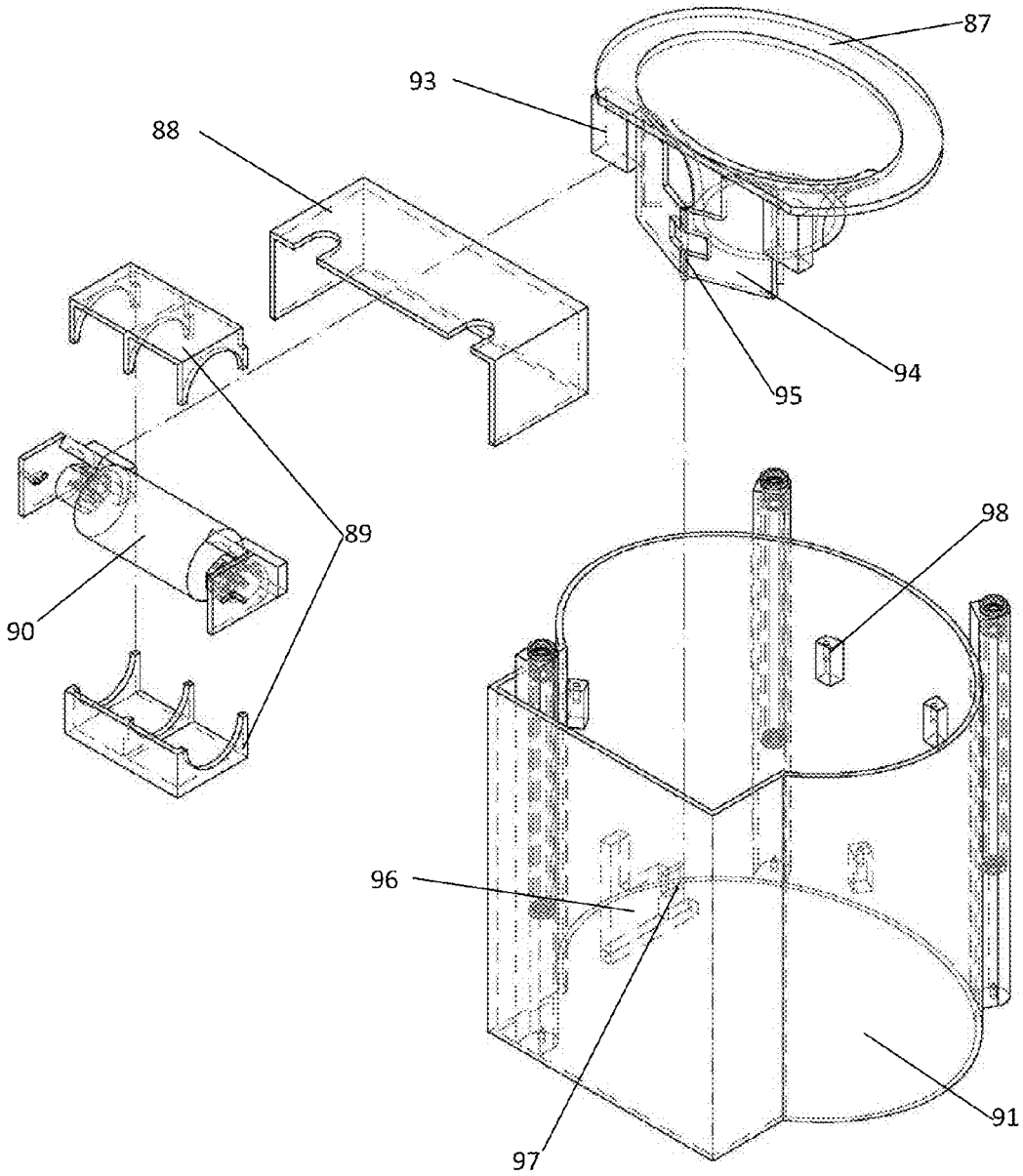
FIG. 6E shows the isometric drawing of the sixth alternate embodiment funnel/opening, motor, motor housing and main housing.
Figure 6F:
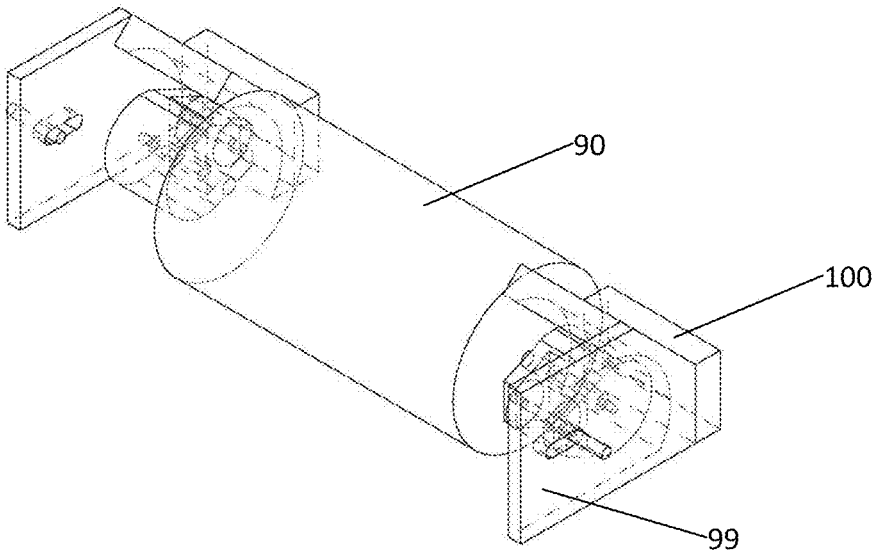
FIG. 6F shows the isometric drawing of the sixth alternate embodiment motor, cams and pushers.
Figure 6G:
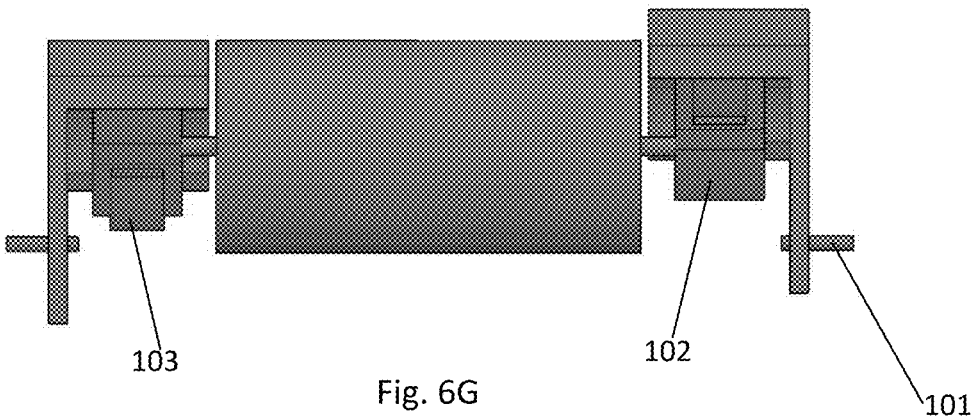
FIG. 6G shows the conceptual top drawing of the sixth alternate embodiment motor, cams and pushers.
Figure 6H:
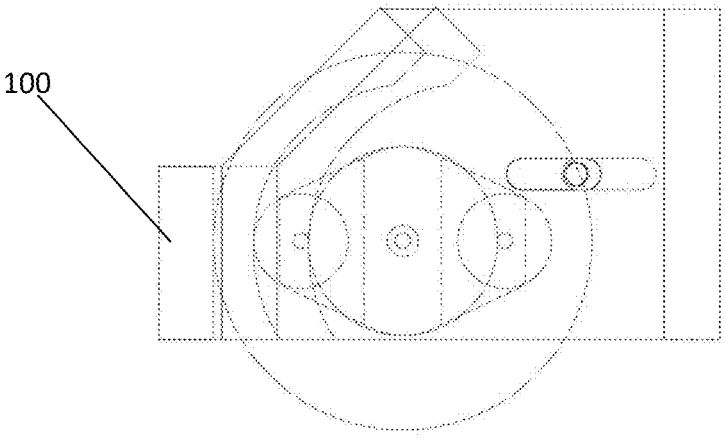
FIG. 6H shows the conceptual side drawing of the sixth alternate embodiment motor, cams and pushers.

Sixth Alternative Embodiment—FIGS. 6-6H

FIG. 6 shows the isometric view of the complete sixth alternate embodiment rear view with the top cover. This sixth alternate embodiment is much different from the previous embodiments but achieves the same result of shaking and vibrating down the material from a partially emptied container to the cap of the container.

FIG. 6A shows the conceptual isometric view of the complete sixth alternate embodiment rear view with the top cover.

FIG. 6B shows the isometric view of the sixth alternate embodiment front view.

FIG. 6C shows the conceptual isometric view of the sixth alternate embodiment front view.

FIG. 6D shows the isometric view of the sixth alternate embodiment with the components separated. The top cover, 85, is similar to the top cover in the second alternate embodiment except it has a rectangular section on the back to compensate for the change in shape of this embodiment due to a different motor location. The weight in the top cover, similar to the second alternate embodiment (not shown) uses a similar cover, 58, to hold it in place. The protective ring, 86, has been modified from the second alternate embodiment to allow for the motor compartment but its function is similar. The reduction insert shown, 31, is similar to the second alternate embodiment and the smaller reduction insert (not shown) will also be utilized for this sixth alternate embodiment. The funnel/opening, 87, is similar to the second alternate embodiment in shape for the container insertion only. It houses different components for a different type of motion from the former embodiments. This will be looked at closer in a later drawing. The motor housing is covered with a cover, 88, designed to fit around the rear extension rod housings. The motor bracket, 89, is in two pieces and will hold the motor, 90, in place and is attached to the main housing, 91. The bottom cover, 92, is similar to that of the first alternate embodiment but is modified to enclose the rectangular motor compartment.

FIG. 6E shows the isometric view of the sixth alternate embodiment main housing, funnel/opening and motor/cam components. The funnel/opening, 87, fits inside the main housing, 91, and pivots on a pivot rod, 95. The pivot rod fits through the pivot plates, 94, on the funnel/opening and through the pivot mount, 97, which extends off the motor mount, 96. The funnel/opening is elevated by the pivot rod and pivots as it is pushed by the motor, 90. The pivot push blocks, 93, on the funnel/opening is where the motor will alternately push each side to give the funnel/opening its pivot motion. The motor bracket, 89, will enclose the motor and attach to the motor mount. It is designed that the motor mount will attach with an L-bracket (not shown) but the motor mount may be increased in size and the motor bracket will mount with screws directly into it from the top. The design of attachment shown should not be a limiting factor for this embodiment as it may change but the concept remains. The motor housing cover, 88, will then cover the entire motor compartment from the top. It will be attached with screws, rivets, adhesive, etc. or some combination of these. The protective ring mounting blocks, 98, is where the protective ring (shown in FIG. 6D) will mount. The protective ring will mount with screws, rivets, adhesive, etc. or some combination of these.

FIG. 6F shows the isometric view of the motor/cam assembly. The motor, 90, is a dual shaft motor, designed at 12V DC but some other voltage may be used and it should not be limited to 12V. On each end it has the cam brackets, 99, which the rotating cams will push as the motor rotates. The push pads, 100, will push against the pivot push blocks, 93 (shown in FIG. 6E), on the funnel/opening to pivot the funnel/opening.

FIG. 6G shows the conceptual top view of the motor/cam assembly. The cam brackets ride on a guide pin, 101, which are mounted on the main housing motor compartment. The guide pin should not be limited in their design to pins only as these may also be guide bars or even guide tracks. The cam, 102, mounts on either end of the motor to the shaft offset 180 degrees. On the end of the cams are rollers or roller bearings, 103, which will push against the cam brackets alternating as the motor rotates and create the pivoting motion.

FIG. 6H shows the hidden line side view of the motor/cam assembly so the relationship between the cam roller and the cam bracket can be seen. The cam bracket is designed with a lead-in and lead-out to guarantee smooth rotation and easy motion to push the cam brackets into the funnel/opening.

Operation

Sixth Alternative Embodiment—FIGS. 6-6H

The user will place the sixth alternate embodiment on a flat surface and plug (not shown) it into the wall outlet. They will then raise the top cover, 85, and insert a container into the funnel/opening, 87. If the container is too small for the funnel/opening, they will insert the reduction insert, 31, into the funnel/opening or the smaller reduction insert (not shown) into the larger insert to obtain the correct size opening to hold their container. They will then rest the weighted top cover onto the container and initiate the vibration and shaking cycle. They will press the start button (not shown) which will start the motor, 90, rotating. The motor is held in place by the motor bracket, 89, mounted to the motor mount on the main housing, 96. The motor will turn the cams, 102, mounted to the dual shafts of the motor which will spin around and the rollers, 103, will roll against the cam bracket, 99, alternating as the cams are offset 180 degrees. The cam brackets will slide along the guide pins, 101, and push the push pads, 100, into the funnel/opening pivot push blocks, 93 on the funnel/opening. As the cam and cam roller sweeps around and push the cam bracket and push pad, the funnel/opening pivots in the direction of the cam which is pushing the pivot push block. As one cam disengages and the other, offset 180 degrees, pushes the opposite cam bracket and push pad. It pushes against the opposite side funnel/opening pivot pad and this creates the shaking and vibration motion. The funnel/opening pivots on the pivot rod, 95, and the pivot rod rides inside the funnel/opening pivot plates, 94, and the main housing pivot mounting block, 97. As the motor/cams move each side of the funnel/opening, it pivots on freely on the pivot rod at very high speeds. Once the time on the timer (not shown) expires, the cycle is complete and the container can be removed from the embodiment by lifting the top cover and remove the container. The remaining extractable contents of the container should be in the cap of the container. If the user wishes to run another cycle, they can begin the procedure again.

Description

Figure 7:
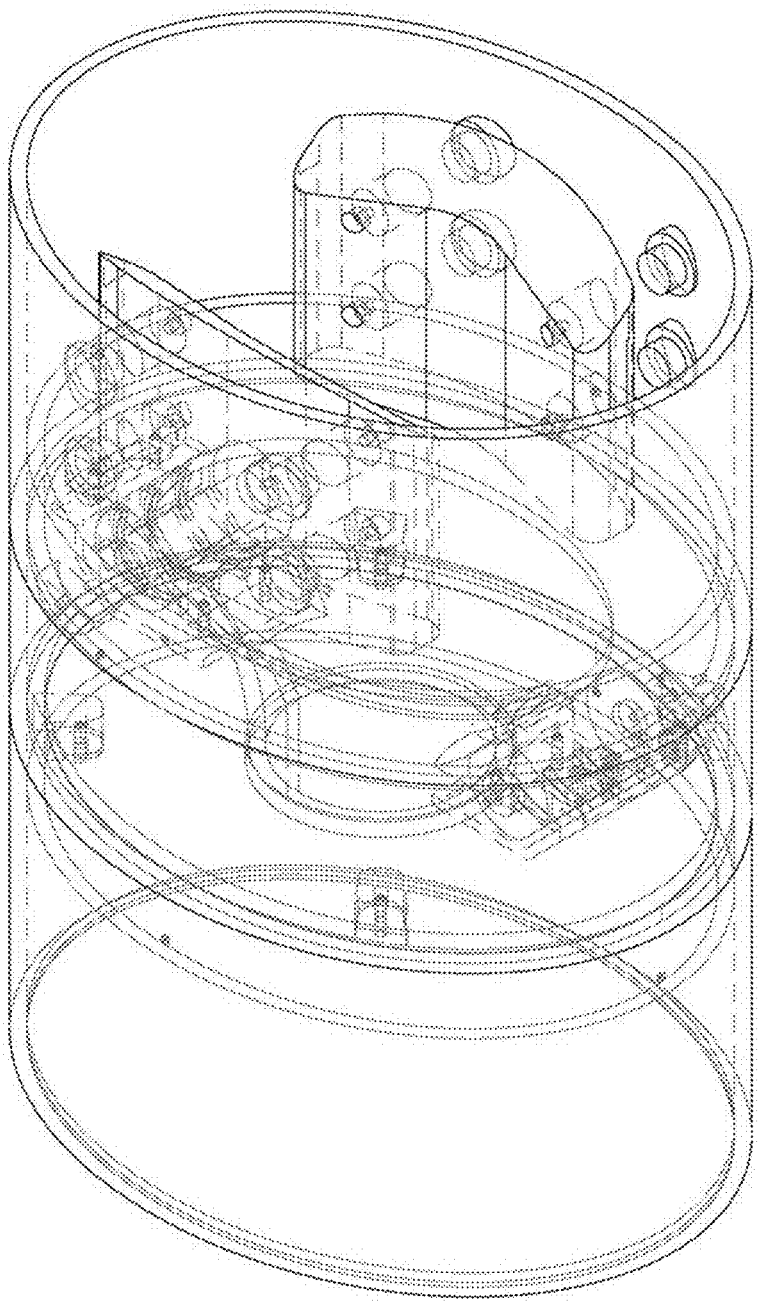
FIG. 7 shows the isometric drawing of the seventh alternate embodiment complete assembly.
Figure 7A:
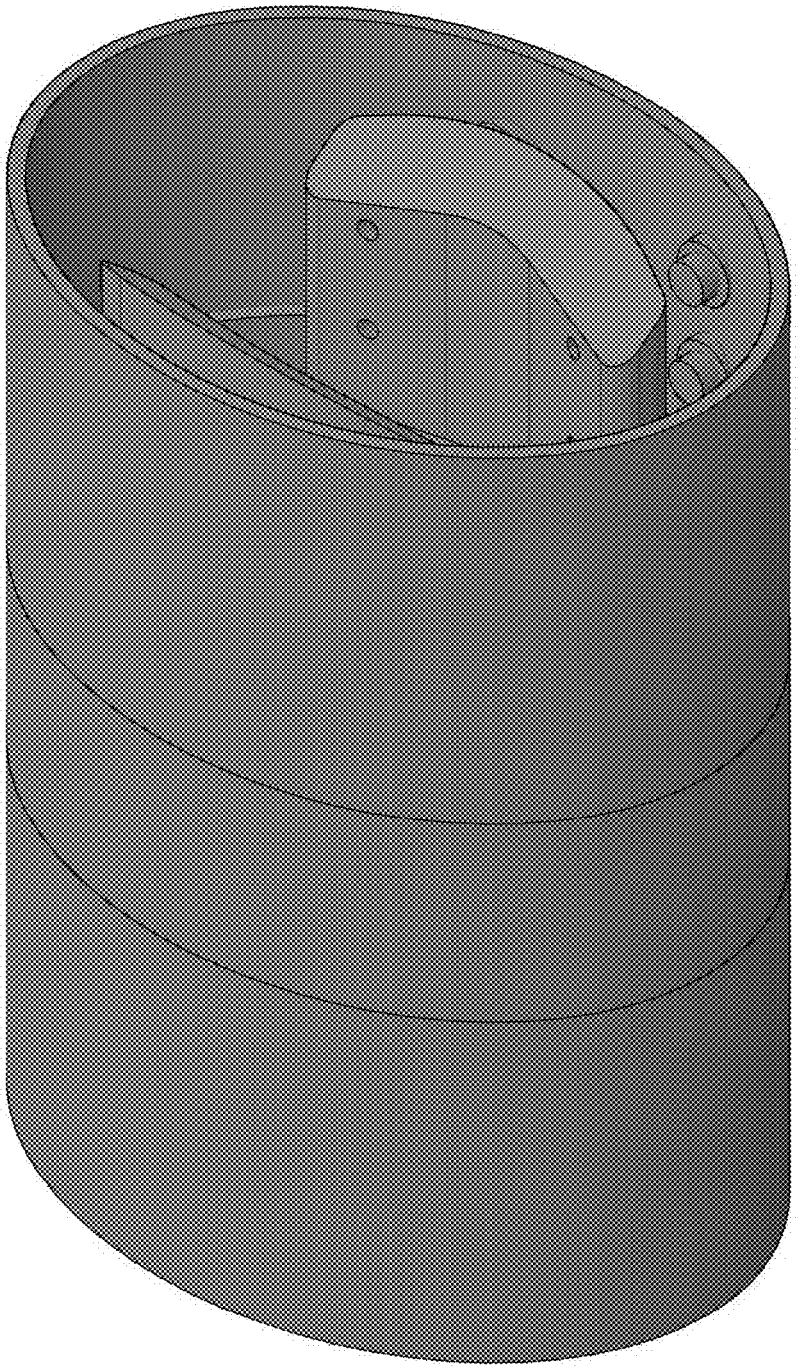
FIG. 7A shows the conceptual isometric drawing of the seventh alternate embodiment complete assembly.
Figure 7B:
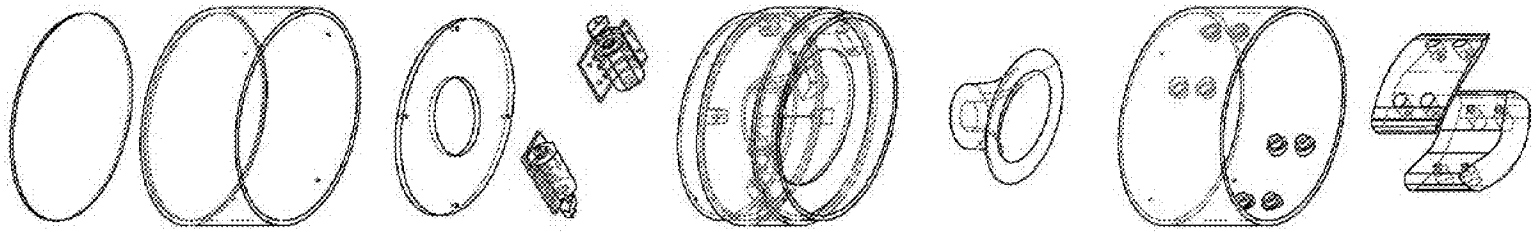
FIG. 7B shows the isometric drawing of the seventh alternate embodiment with separated parts.
Figure 7C:
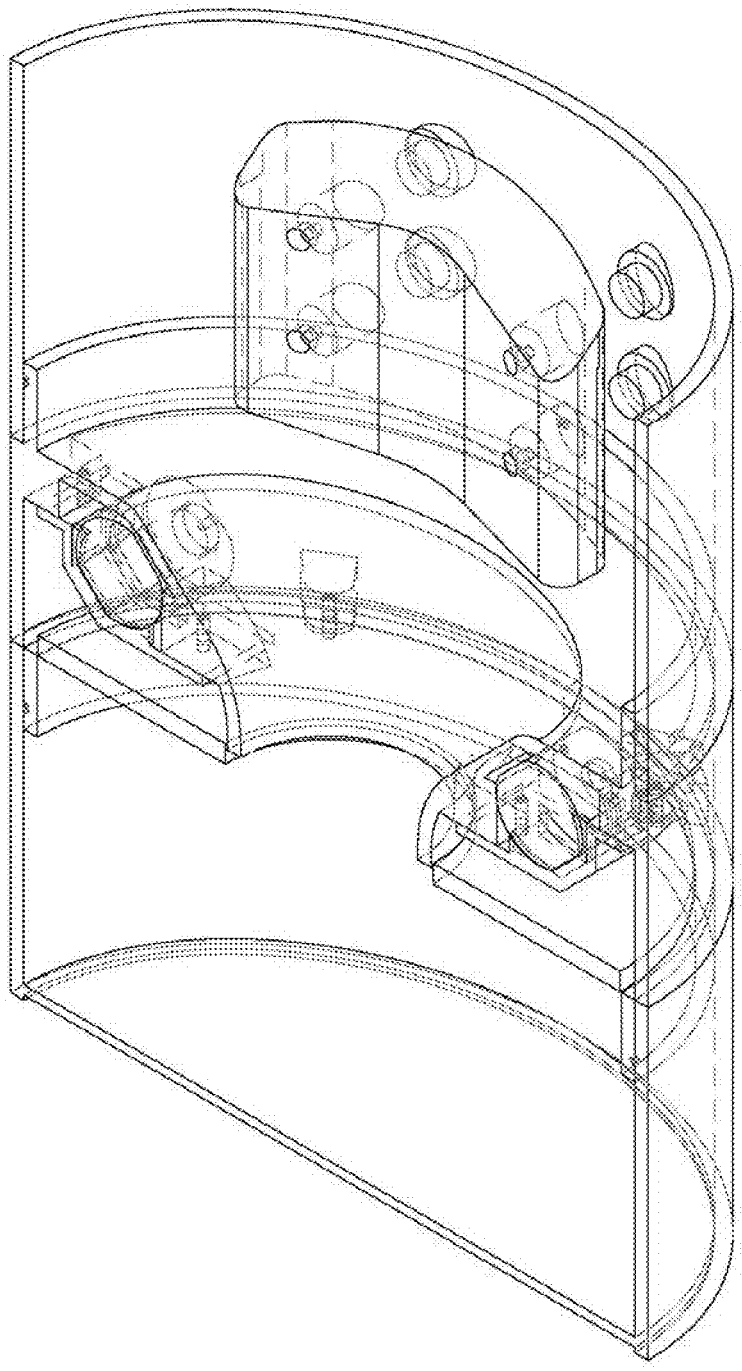
FIG. 7C shows the sliced, isometric drawing of the seventh alternate embodiment complete assembly.
Figure 7D:
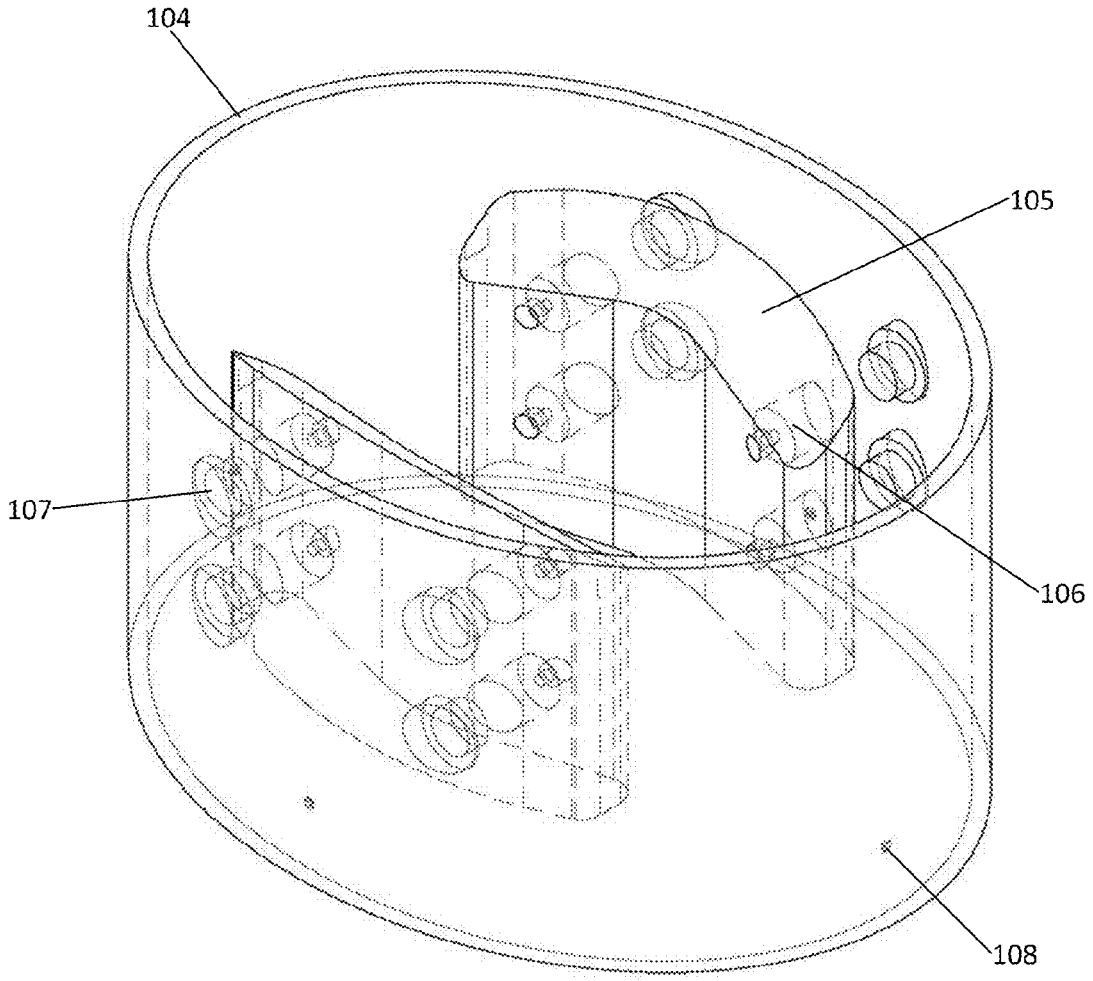
FIG. 7D shows the isometric drawing of the seventh alternate embodiment top section.
Figure 7E:
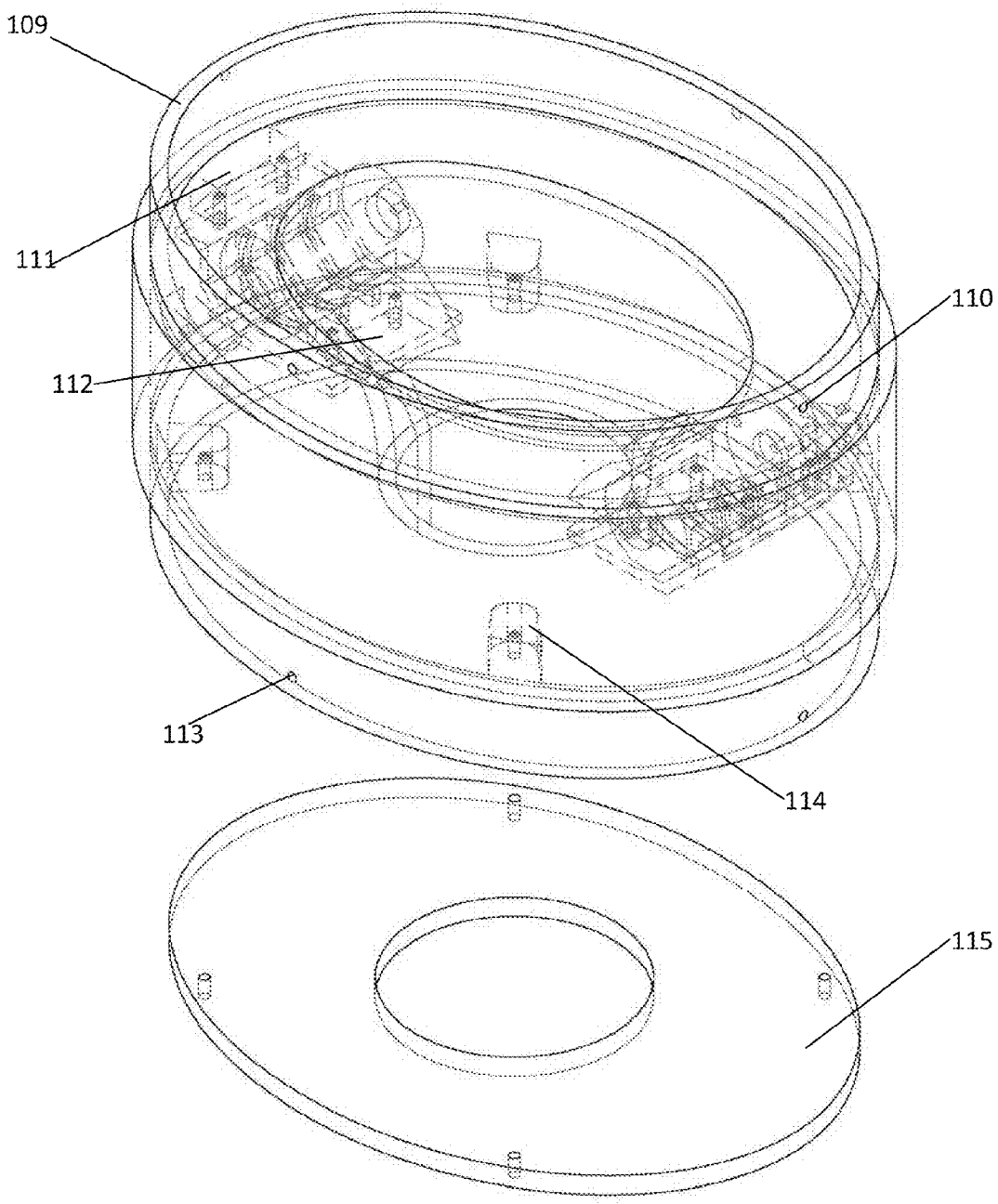
FIG. 7E shows the isometric drawing of the seventh alternate embodiment middle section.
Figure 7F:
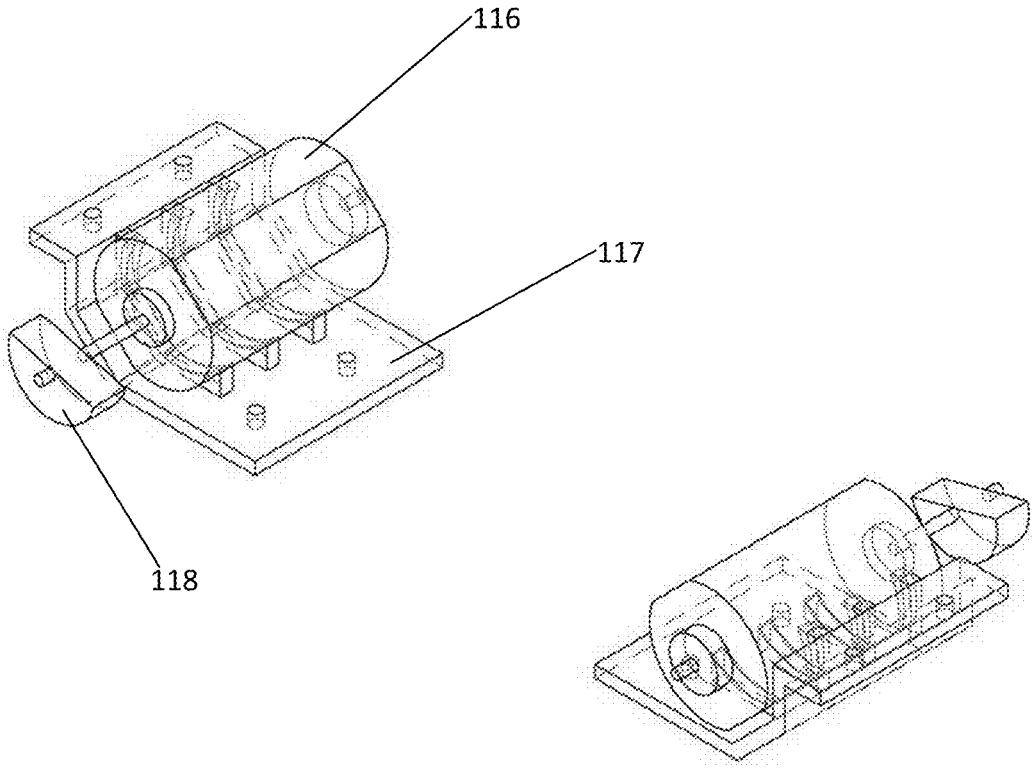
FIG. 7F shows the isometric drawing of the seventh alternate embodiment motors and motor housings.
Figure 7G:
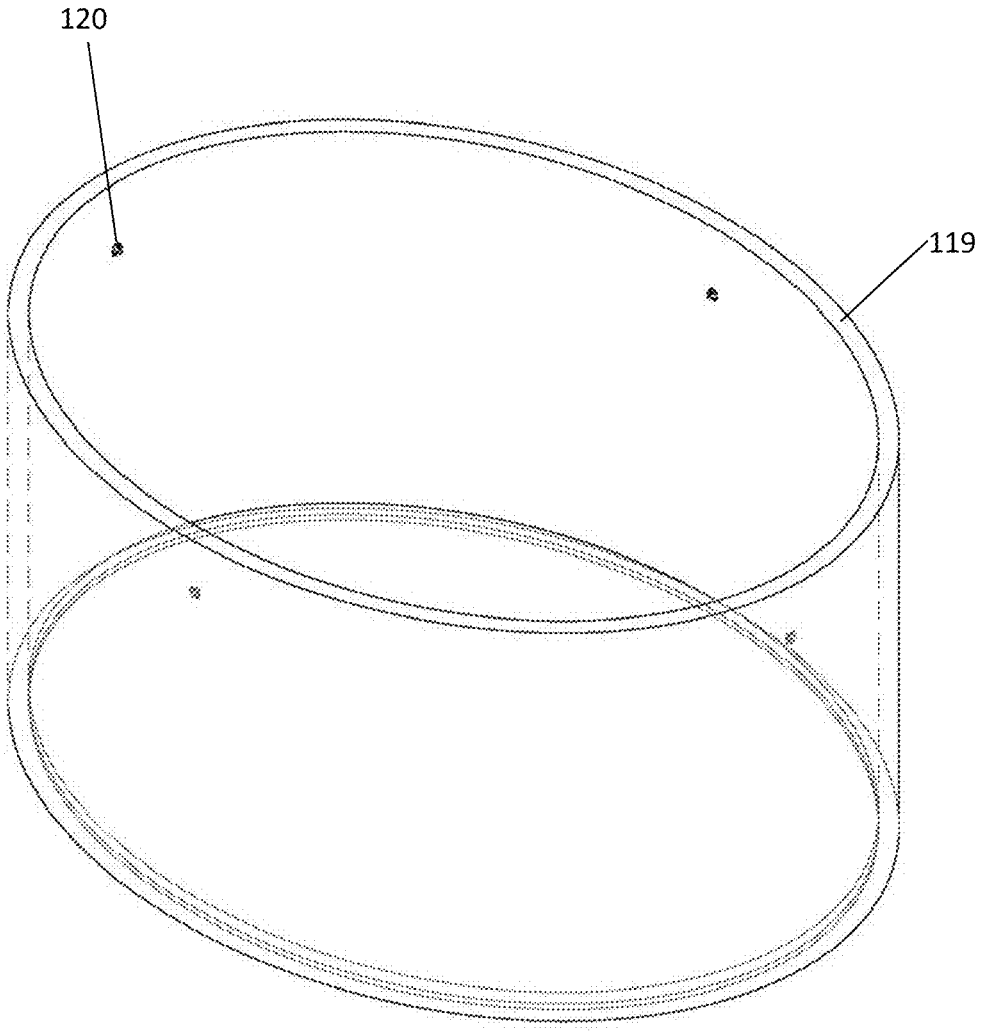
FIG. 7G shows the isometric drawing of the seventh alternate embodiment bottom section.

Seventh Alternative Embodiment—FIGS. 7-7G

FIG. 7 shows the isometric view of the seventh alternate embodiment complete assembly. The seventh alternative embodiment is different than the other embodiments in that it does not move the funnel/opening. Instead it uses powerful vibrating motors to vibrate an inserted container to make the contents of the container move to the cap of the container. The embodiment shown is composed of three main sections but should not be limited to three sections. The bottom section is a spacing section to keep the container elevated so it rests in the funnel/opening of the middle section. As shown, the middle section fits into the bottom section. The middle section contains the electrical components, a timer and transformer and the motors which are pressed against the sides of the funnel/opening. The upper section is the housing the containers are inserted through to the funnel/opening and is open at the top and the bottom. It contains holding pads which are spring loaded to hold the container tightly in place during the vibration cycle. The upper section fits over top of the middle section.

FIG. 7A shows the conceptual isometric view of the seventh alternate embodiment complete assembly.

FIG. 7B shows the isometric view of the seventh alternate embodiment with separated components.

FIG. 7C shows the sliced isometric view of the seventh alternate embodiment for better clarification.

FIG. 7D shows the isometric view of the top section of the seventh alternate embodiment. The top section, 104, is open at both ends and it slides over the top of the perimeter flange of the middle section, FIG. 7E, and is held in place by tabs, 108. The tabs may be modified to a different method of securing it to the middle section. It has eight bosses or protrusions, 107, molded on the side for attaching springs (not shown) which will also attach to the holding pads, 105, at the attachment points, 106. The springs will be held into the holding pads by a spring keeper (not shown) and screwed into the pads. Alternate methods of attaching the springs to the pads may be utilized, however. The holding pads should not be limited to springs as other methods of applying a holding force may be used. These holding pads will put pressure on the container and keep it from bouncing all over during the vibration cycle. The design of the bosses should not be limited to eight as the number may be increased or decreased and they should not be limited to being part of the mold but may be separate and attached by another method to the upper section. The spring force from the pads will offer enough pressure to keep a container in place but allow a user to easily insert and retract a container. There will also be vibration forces that will be transmitted through the springs into the holding pads and the container. Alternate holding pads may be used that will accommodate additional vibrating motors for additional vibration into the inserted container. The shape, method of spring attachment, concavity and design of the pad may be modified to best hold the containers in place during a vibration cycle.

FIG. 7E shows the isometric view of the middle section of the seventh alternate embodiment. The middle section is open at the top and the bottom. The top has an angled elliptical opening that curves down to a circle opening in the bottom. The opening allows the container to rest against the curved, angled and straight portions and this is where the vibration forces are transferred to the inserted, inverted container. The middle section has a one inch indented lip at the top and the bottom around the perimeter to fit into the bottom section, FIG. 7G, and have the top section, FIG. 7D, fit over top of it while the outside of the complete embodiment is flush with each other. The method for attaching the three sections may be modified to have a larger or smaller lip or no lip at all. It has the top receiving pockets, 110, for the top section tabs and bottom receiving pockets, 113, for the bottom section tabs. The upper motor mount block, 111, and the lower motor mount block, 112, for the motor housing, FIG. 7F, to attach to. It has spring wound mechanical timer (not shown) with a one to three minute timing limit. Alternative timers will include digital which will allow the user to set the desired vibration cycle time and press a start button. A shut off button will be used if they would like to cancel the cycle early. An additional alternative timer will be digital preset times initiated by pressing a labeled button with the desired time for the vibration cycle and will include a shut off button to cancel the vibration cycle. A transformer (not shown) will be mounted in this section with a cord (not shown) for plugging into a wall outlet. The transformer for this embodiment is a 9V transformer which will then be wired to the timer and into two 9V motors. Alternative designs may include 3V, 6V, 12V, 24V or something otherwise for the transformer, timer and motors. The bottom protective cover, 115, has an open middle to allow the container to fit through but encloses the middle section preventing the user from touching the electrical components. It will mount to the mounting blocks, 114, which are attached to the middle section housing. It is attached by screws but other methods of attachment may be used such as rivets, adhesive, or some other type of attaching mechanism to keep it in place. The mounting blocks, which are part of the molded body, may be separate mounts that are attached by some other method.

FIG. 7F shows the isometric view of the motors and motor brackets. The motor brackets, 117, are intended to hold the motors in place and apply force to the motors, 116, against the opening of the middle section where the containers rest against. The motor brackets are designed to the shape of the vibrating motor that will be used. Many different motors may be used which will require different motor brackets to hold them in place. Additional motors may be used and will require additional motor brackets in the middle section. The motor brackets have cooling ribs to allow the motor to stay cooler during a vibration cycle. The motor brackets will be attached to the motor mounts, 111 and 112 (shown in FIG. 7E), by screw but other methods of attachment may be used such as rivets, adhesive, or some other type of clamping method to the middle section. The unbalanced cams, 118, will be the primary method of generating the necessary vibration forces used to vibrate the inserted container contents down to the cap of the container.

FIG. 7G shows the isometric view of the bottom section of the seventh alternate embodiment. The bottom section, 119, is a spacer to elevate the embodiment off the table top and keep the container from touching the bottom which allows it to effectively rest against the opening and vibrating motors of the middle section, FIG. 7E. The bottom section is open at the top only and the middle section fits into the bottom section and is held in place by tabs, 120. The tabs may be modified to some other type of holding method such as external locking clamps, a hinge, an o-ring or something otherwise. The bottom section has a friction pad (not shown) on the bottom to help keep it from moving during a vibrating cycle.

Operation

Seventh Alternative Embodiment—FIGS. 6-6H

The operation of the embodiment will involve the user to assemble the embodiment by placing the bottom section, 119, on a table and sliding the middle section, 109, into it until the tabs, 120, slide into the pockets, 113, and hold it in place. They will then take the top section, 104, and slide it over top of the middle section until the tabs, 108, slide into the pockets, 110, and it is held in place. They will then plug in the power cord (not shown) to the wall outlet. Now that the embodiment is ready to be used, the user will select the container they wish to have vibrated and invert the container and insert it into the opening at the top of the embodiment. The holding pads, 105, will be forced apart and the springs (not shown) will compress against the bosses, 107, and allow the container to be pressed down to the opening where the vibrating motors are attached. If the container selected is too small for the large opening, the user must take the top section off and put the reduction insert (not shown) into the large opening then put the top section back in place.

Once the container is in place and held securely between the holding pads, the user can then begin the vibration cycle. The designed timer (not shown) is a spring wound mechanical timer to which the user will dial the timer to their required cycle time limit. To stop the cycle will require the user to turn the dial to the off position. When the timer is turned and the vibration cycle is initiated, the vibrating motors, 116, held in place by the motor brackets, 117, will start to run. The contents of the container will then flow to the opening of the container and rest at the cap of the container.

Once the cycle is complete, the user can extract the container and view the performance of the embodiment and then decide to insert the container for additional vibration cycles. While this embodiment is designed to maximize the extraction of the contents of the container to its opening, it does by no means guarantee that one hundred percent of the contents of the container may be vibrated to the opening of the container. Alternative designs will include a clear plastic housing so the user can see the performance of the vibration cycle while it is in a vibrating cycle.

Should the contents spill during the vibration cycle or some residue on the outside of the bottles be transferred to the embodiment's components, the embodiment may be sectioned apart for easy cleaning. The upper and bottom sections of the embodiment may be run under water but the middle section must be kept out of water and wiped clean with a washrag or some other type of cleaning device. It is recommended the embodiment be unplugged from the outlet during this procedure. Future embodiments may be made to have a middle section that will be waterproof.

Description

Figure 8:
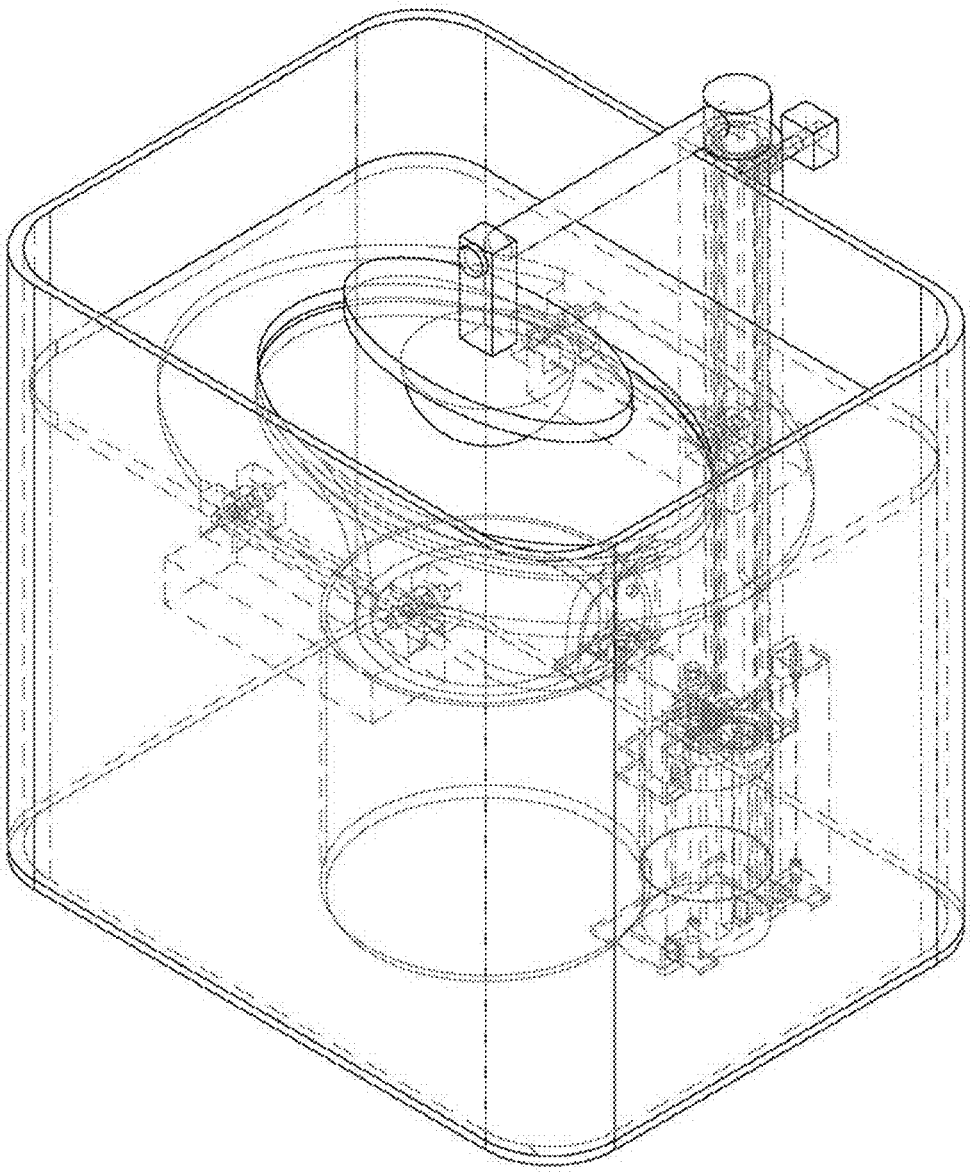
FIG. 8 shows the isometric drawing of the eighth alternate embodiment complete assembly.
Figure 8A:
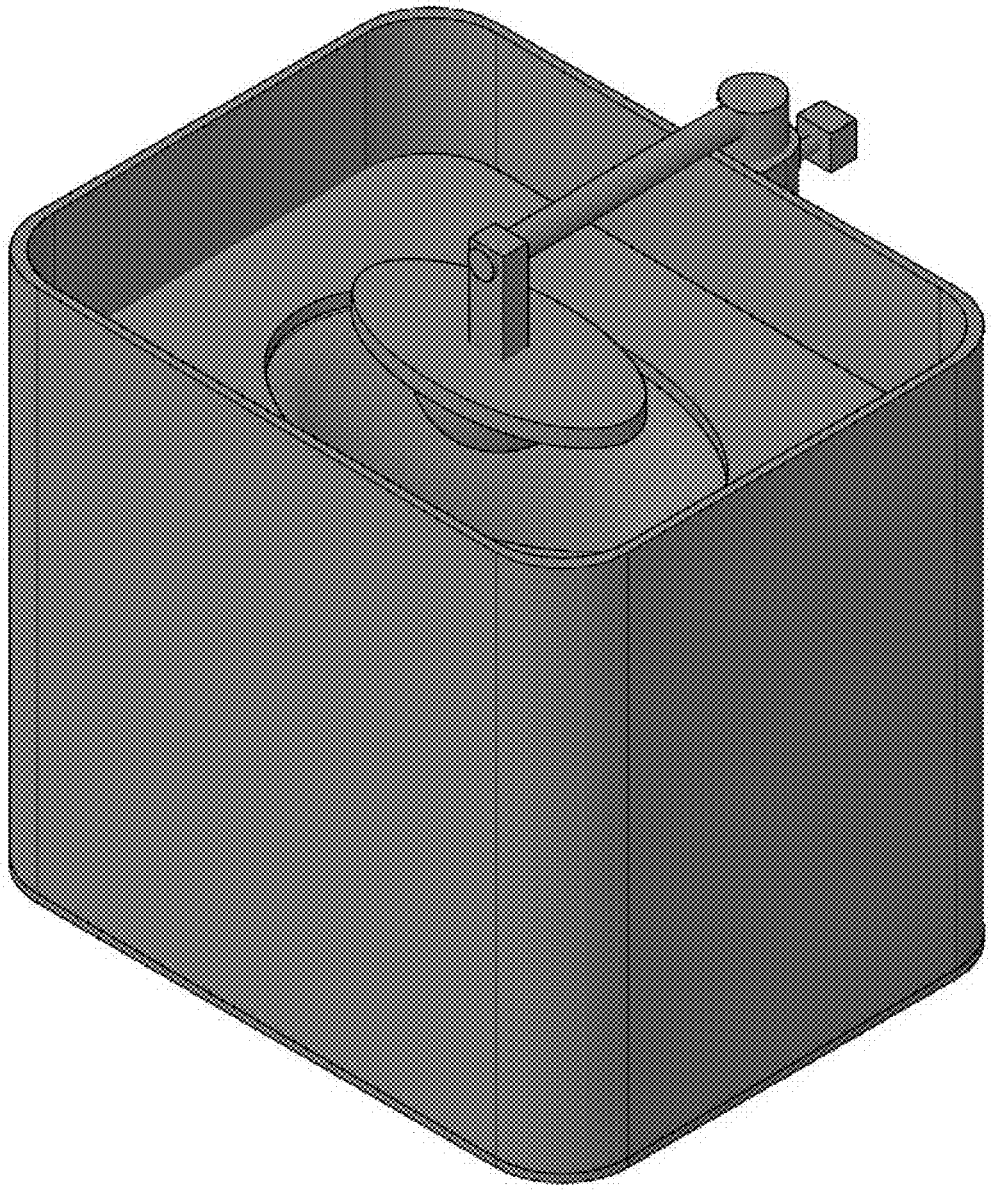
FIG. 8A shows the conceptual isometric drawing of the eighth alternate embodiment complete assembly.

Eighth Alternative Embodiment—FIGS. 8-8A

FIG. 8 shows the isometric view of the eighth alternate embodiment. This eighth alternate embodiment is similar to the first embodiment in function and components. The only change is the housing is square rather than elliptical. The protective ring and bottom cover are also square.

FIG. 8A shows the conceptual isometric view of the eighth alternate embodiment for visual purposes.

Operation

Eighth Alternative Embodiment—FIGS. 8-8A

The operation of this eighth alternate embodiment is similar to the first embodiment.

Description

Figure 9:
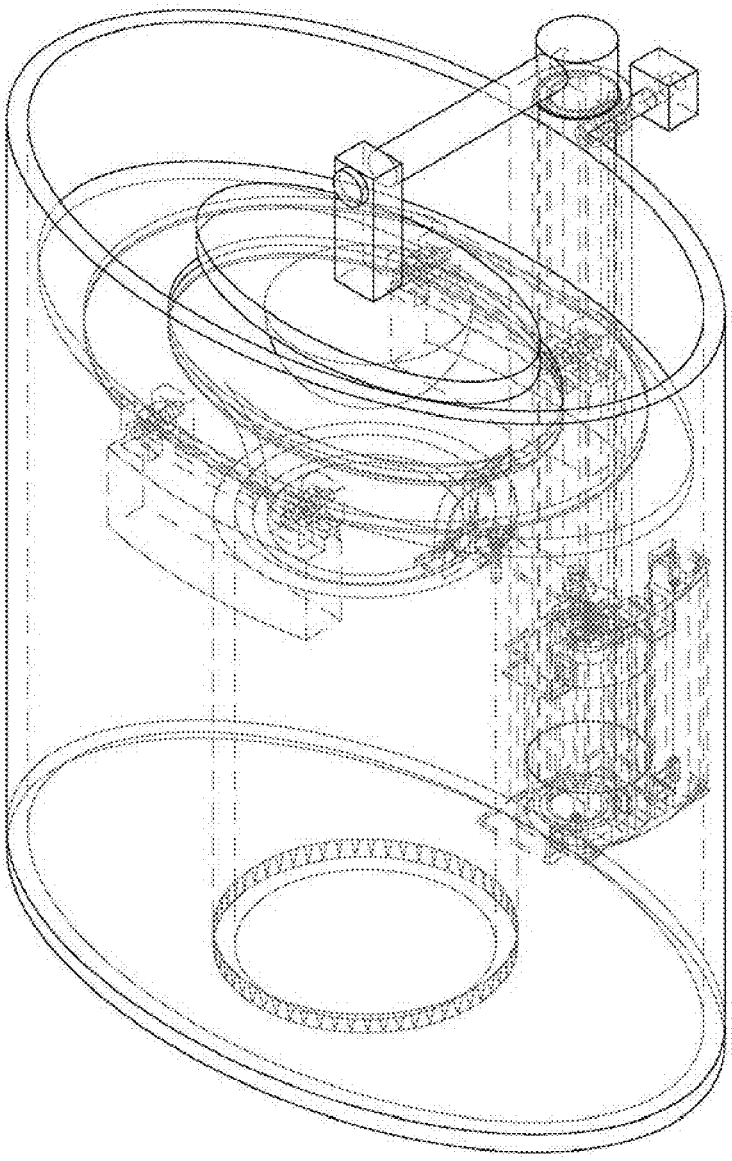
FIG. 9 shows the isometric drawing of the ninth alternate embodiment complete assembly.
Figure 9A:
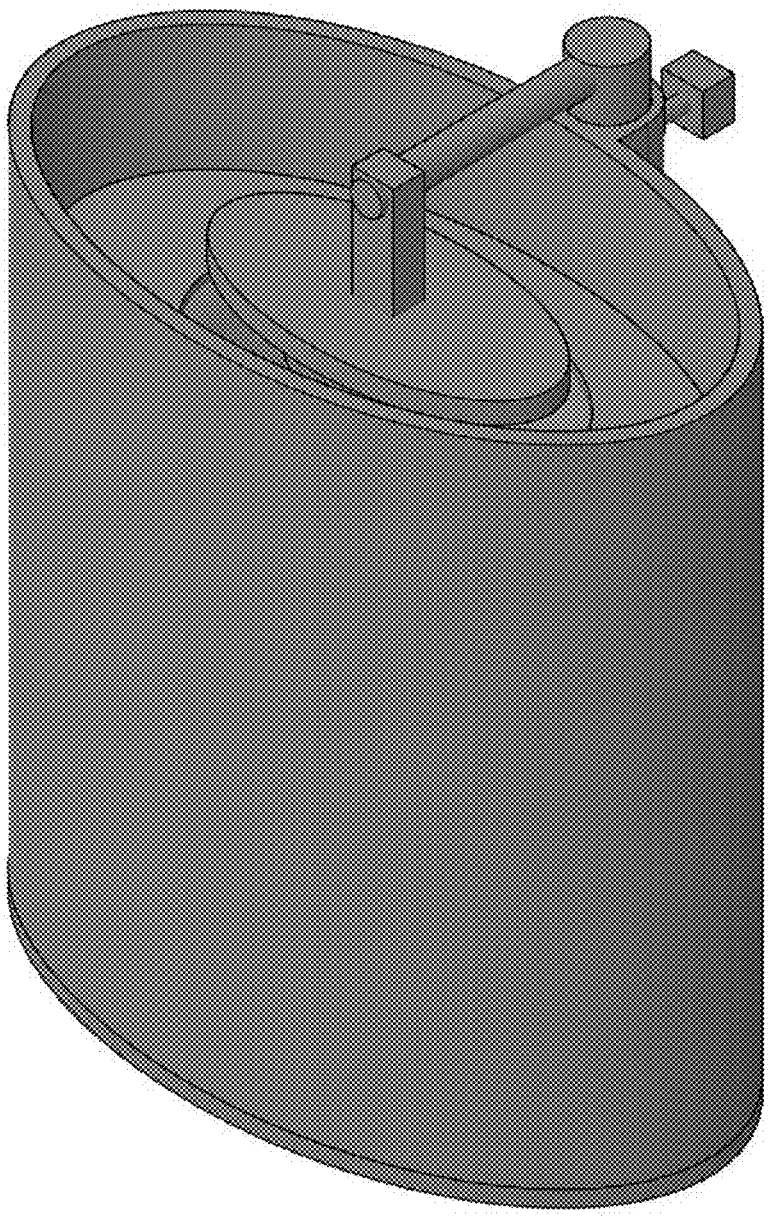
FIG. 9A shows the conceptual isometric drawing of the ninth alternate embodiment complete assembly.

Ninth Alternative Embodiment—FIGS. 9-9*a*

FIG. 9 shows the isometric view of the ninth alternate embodiment. This ninth alternate embodiment is similar to the first embodiment in function and components. The only change is the embodiment is much smaller with the sole purpose of being used for tiny containers such as makeup or small lotions.

FIG. 9A shows the conceptual isometric view of the ninth alternate embodiment for visual purposes.

Operation

Ninth Alternative Embodiment—FIGS. 9-9A

The operation of this ninth alternate embodiment is similar to the first embodiment.

Description

Figure 10:
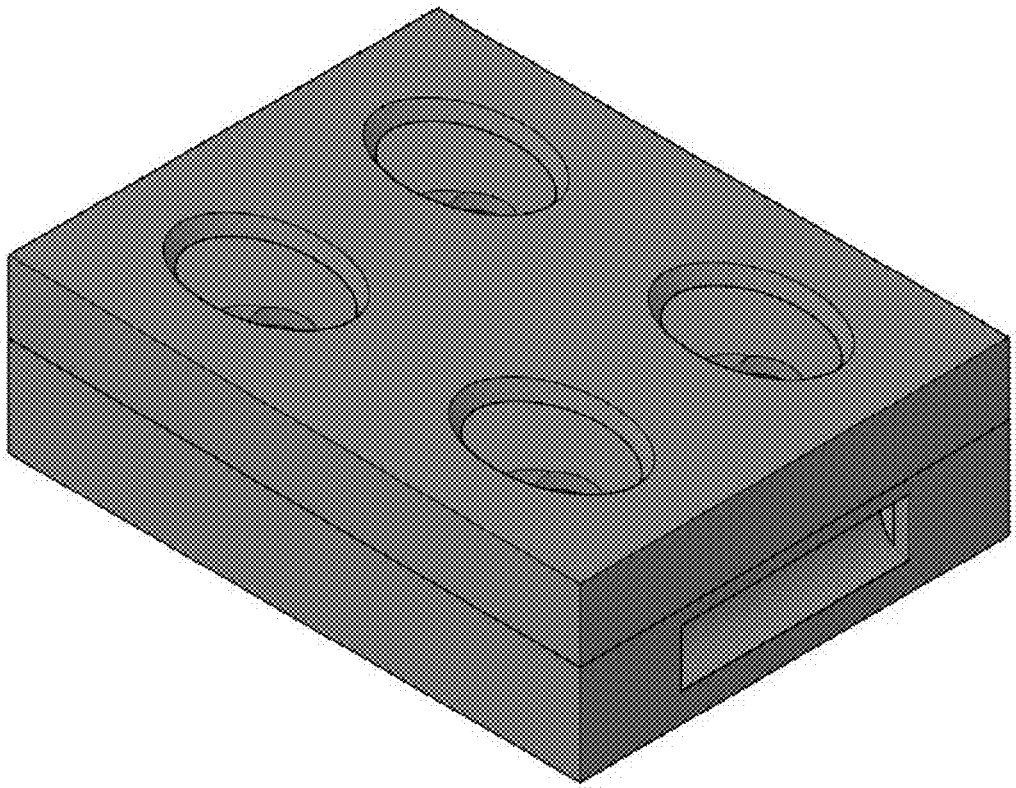
FIG. 10 shows the conceptual isometric drawing of the tenth alternate embodiment assembly.

Tenth Alternative Embodiment—FIG. 10

FIG. 10 shows the isometric view of the tenth alternate embodiment. This tenth alternate embodiment is simply to show a larger unit using the drive/cam method of the first embodiment may be used for multiple container capacity. The funnels/openings would all be one component driven by a larger motor than the single container model. The hold down necessary to hold down all the containers has not been designed.

Operation

Tenth Alternative Embodiment—FIG. 10

The operation of this tenth alternate embodiment is similar to the first embodiment.

Description

Figure 11:
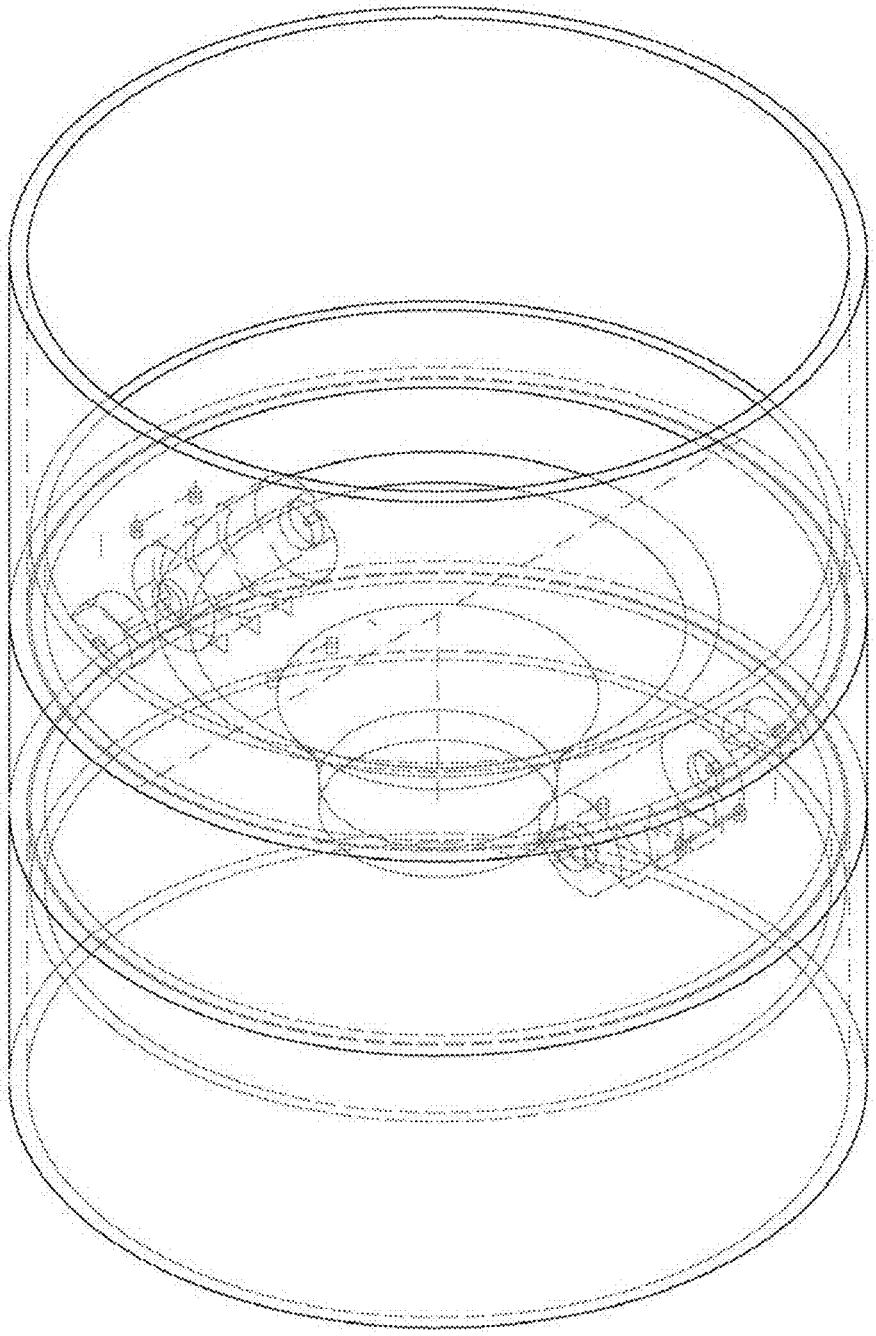
FIG. 11 shows the isometric drawing of the eleventh alternate embodiment complete assembly.
Figure 11A:
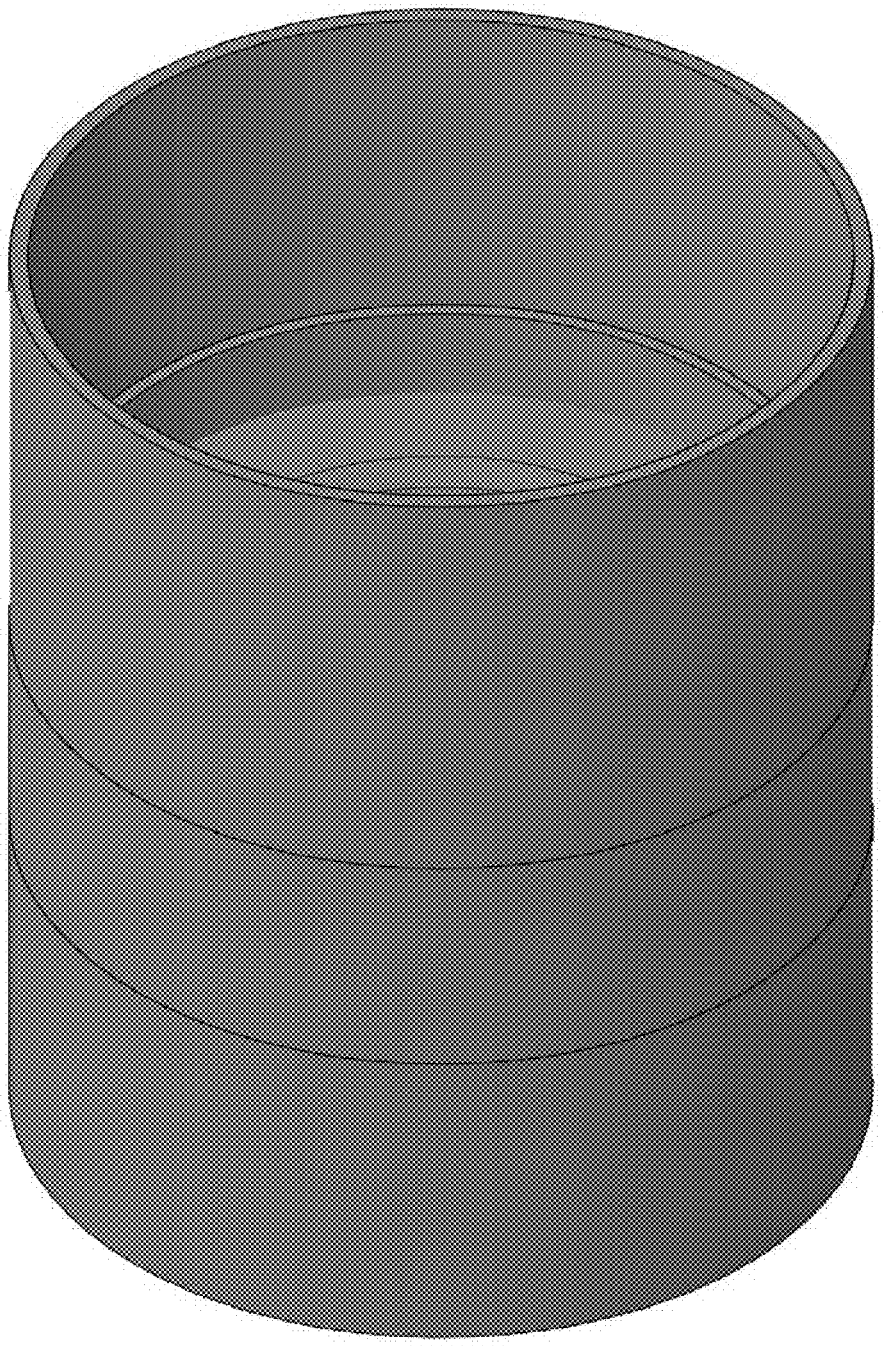
FIG. 11A shows the conceptual isometric drawing of the eleventh alternate embodiment complete assembly.

Eleventh Alternative Embodiment—FIGS. 11-11A

FIG. 11 shows the isometric view of the eleventh alternate embodiment. This eleventh alternate embodiment is similar to the first embodiment in function and components. The only change is this embodiment is has a round housing and the funnel/opening is more rounded. The purpose for this embodiment would be more for jars or cans rather than the dressings or ketchups.

FIG. 11A shows the conceptual isometric view of the eleventh alternate embodiment for visual purposes.

Operation

Eleventh Alternative Embodiment—FIGS. 11-11A

The operation of this eleventh alternate embodiment is similar to the first embodiment.

Description

Figure 12:
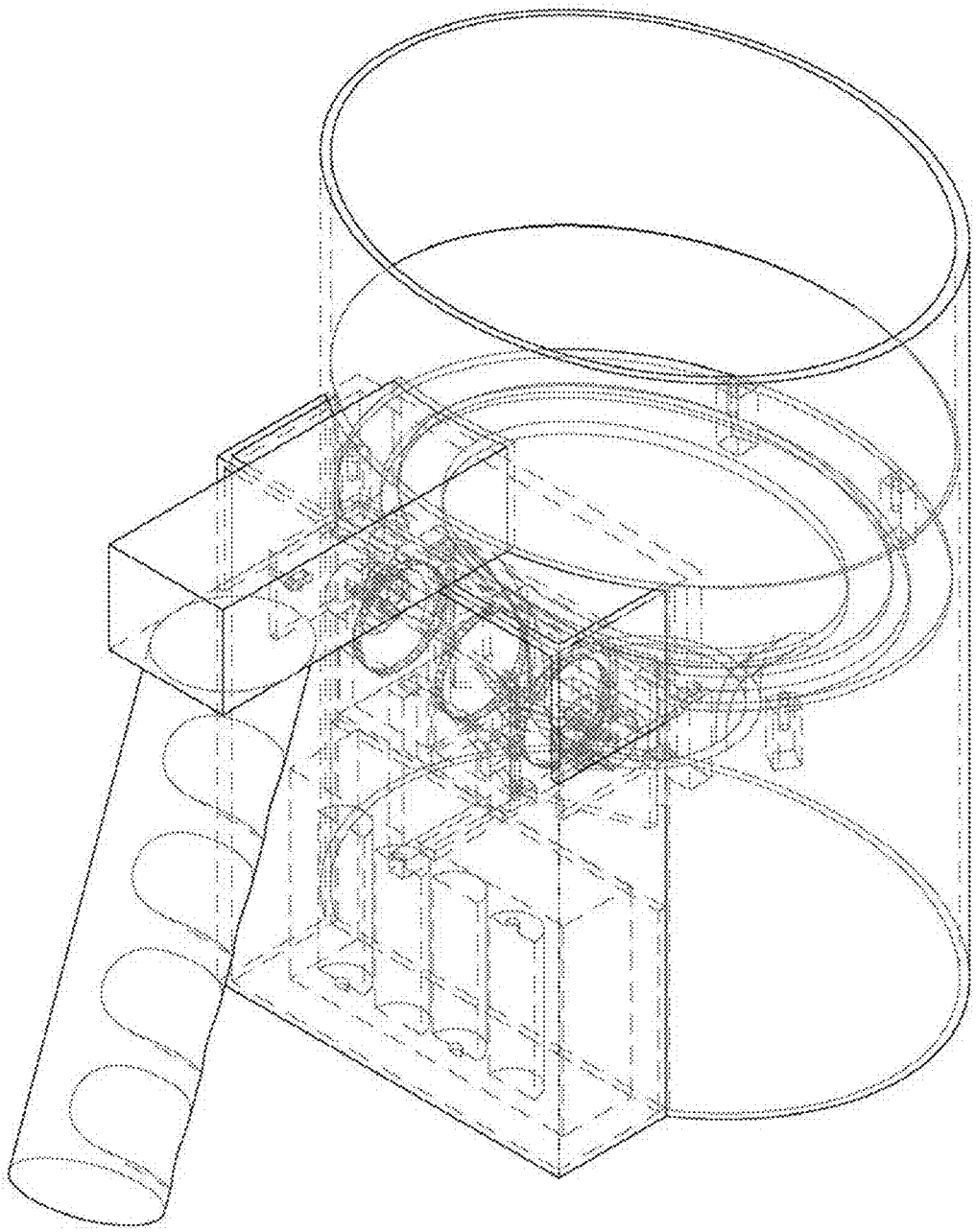
FIG. 12 shows the rear isometric drawing of the twelfth alternate embodiment complete assembly.
Figure 12A:
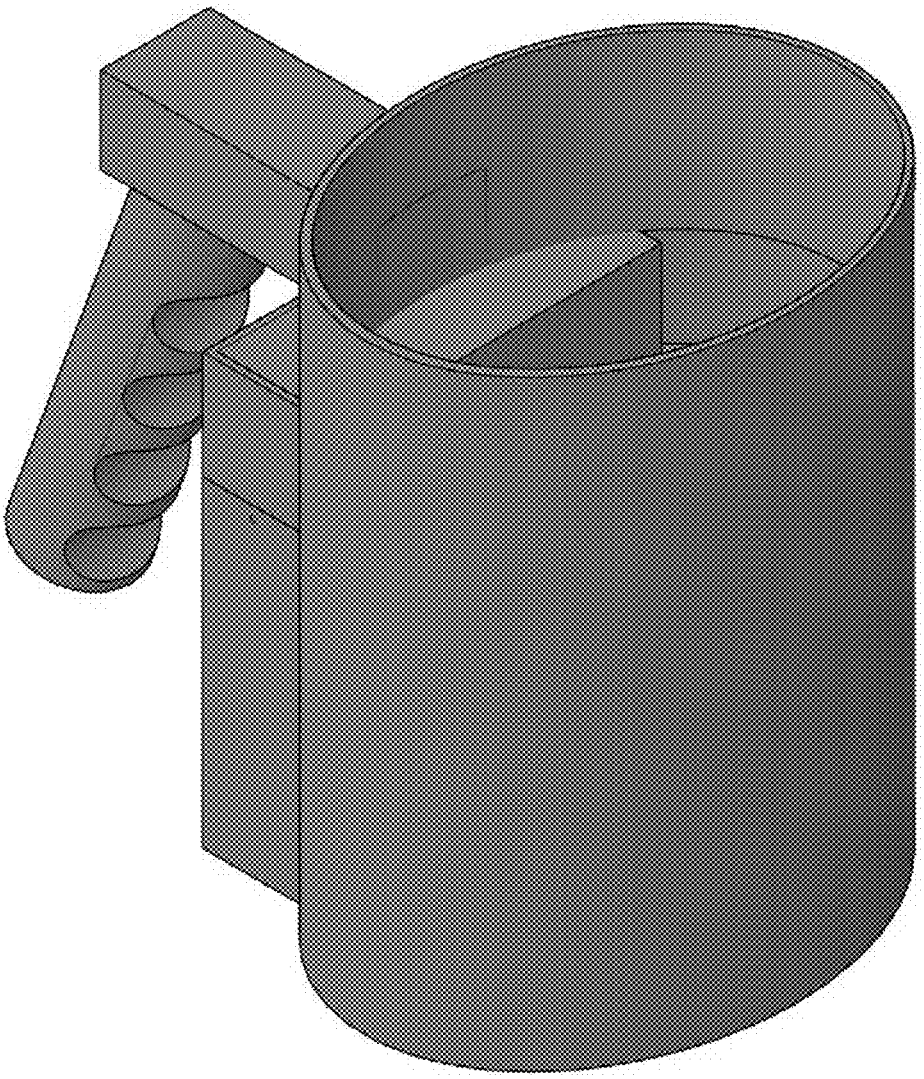
FIG. 12A shows the front, conceptual isometric drawing of the twelfth alternate embodiment complete assembly.

Twelfth Alternative Embodiment—FIGS. 12-12A

FIG. 12 shows the isometric view of the twelfth alternate embodiment. This twelfth alternate embodiment is similar to the sixth alternate embodiment in function and components. The only change is this embodiment is hand held and battery powered and has no hold down. It is smaller than the sixth alternate embodiment and will not be able to hold large containers. It is for the convenience of a portable shaking and vibration unit that can be used anywhere. It is designed to run on four standard batteries which are located below the motor in the bottom of the motor compartment. It also has a grip handle for the user to hold while a shaking and vibration cycle is in process. It will use a trigger (not shown) near the forefinger on the handle to initiate a shaking and vibration cycle. There is no top cover design for this and the user would simply have to hold the container in place. If this proves to be a problem, a hold down or clamping device will be added and the embodiment should not be limited to no hold down.

FIG. 12A shows the conceptual isometric view of the twelfth alternate embodiment for visual purposes.

Operation

Twelfth Alternative Embodiment—FIG. 12-12A

The operation for the twelfth alternate embodiment would be for a user to invert and insert the container and rest the unit on a platform or table. They would then hold the container securely and squeeze the trigger (not shown) at the handle and run a shaking and vibration cycle for as long as they desired. When the batteries are low power, the user must replace them for continued operation.

CONCLUSION, RAMIFICATIONS, AND SCOPE

Accordingly the reader will see that, according to one embodiment of the invention, I have provided information pertaining to the embodiment that it is designed to maximize the extraction of the material contained inside diverse types of containers commonly sold and bought at shopping centers as well as those that are not. Too often containers are thrown away without using all of the extractable contents inside the container. This may be because the contents do not freely flow to the opening of the container due to their substance or viscosity or the design of the container thus a portion of the contents of containers are thrown away without ever being used. This embodiment will allow a user to extract more of the material content without physically cutting the container open and extracting the contents or diluting the material. Containers will be inserted into the embodiment and run through a vibration and shaking cycle which will shake and vibrate the contents of the container down to the opening of the container. This process will maximize the extraction of material from these containers.

With a working prototype of the first embodiment several products were tested. While testing this process, it was discovered that different size and shape containers with different substances in them range considerably from the amount of their contents that can be vibrated down to their opening. It has never been successfully demonstrated that one hundred percent of the contents can be extracted and no such claim is made. This embodiment will, however, maximize the amount of material that can be extracted from the diverse containers without cutting them open. The testing proved that, to different degrees during the vibration process, every container caused most of the remaining material to flow towards the opening. This embodiment has several advantages listed below.

- The embodiment is compact enough to take up little counter space and is sized to fit in standard cupboards when not in use.
- The embodiment prevents container material waste by allowing the user to extract the maximum material out of their container before discarding it.
- The embodiment can possibly give them enough material at the time they need it from the container.
- The embodiment over time will offer users financial savings due to maximizing the extraction of the contents of the containers causing them to purchase less containers of the desired products.
- By maximizing the amount of material extracted from the containers, the overall need for containers of different products will be reduced and ultimately the amount of discarded containers will be reduced saving landfill space.
- Although not designed as a material agitator or mixer, the shaking and vibration motion of the embodiments may allow a user to use them for agitating and mixing full containers where they are instructed, and which are labeled, to "shake well before use".

While the above description contains many specificities, these should not be construed as limitations on the scope, but rather as an exemplification of the one preferred embodiment thereof. Many variations are possible. The following is a list of several examples that are not shown in the drawings.

- The color of the plastic of this embodiment is white but other colors will be used such as black, gray, red, green, yellow and clear etc.
- The shape of the embodiment should not be limited to elliptical, square or round but may be polygonal or some design using a mixture of shapes, curves and angles.
- Components may be mounted differently by adding different mounting blocks and securing the components to them.
- The funnel/opening may be different sizes or shapes depending on final design which will best fit the maximum different types of containers. With the change in the funnel/opening, the inserts will also be changed to accommodate the change.
- Future embodiments may utilize batteries as a power source as opposed to having to plug the cord into a wall outlet for power.
- The top cover may use a different top cover with an alternative hold down method such as a ratchet type mechanism or a screw type handle. The size, shape and method of attachment to the main housing may change.
- A strap method hold down with either a soft or hard cover and will be attached to the rear of the embodiment and have flexible attaching on the front. Should this hold down method be utilized, the embodiments would have to have studs attached to them on the front and rear, near the top, to make this concept work. The hold down may also be a heavy net with the attachment straps.
- A rectangular bar hold down rather than the round bar hold down to extend upwards. The clamping method to hold it in place will be similar to the first embodiment. A clamp will be either a screw clamp or some other type of clamp. It also has a handle on top for easy lifting and adjusting.
- Total size and shape of the embodiment may be changed to allow for other sizes and shapes depending on the required application.
- Sound dampening materials may be added to the embodiment for quieter operation.
- Vibration deadeners may be added to reduce or direct the vibration forces going anywhere but into the funnel/opening and container.
- A different bottom cover may be used which will still protect the user from accessing any of the electrical components or moving parts but still allow a spilled container to be cleaned. This may change due to a different configuration of the main housing.

For commercial use, embodiments with several funnels/openings in one unit may be designed for higher volume material extraction similar to the ninth alternate embodiment but not necessarily limited to four as shown in FIG. 10. It may also be possible to place several containers next to each other in a common funnel/opening.

Rather than a sliding surface for the funnel/opening to ride on, a floating type design may be utilized where the funnel/opening would be elevated by springs, soft rubber pads, etc. and shaken without the need of rollers.

The mounting block for the cam arm on the funnel/opening may be centered rather than offset for an in line transfer of motion.

The transformer may be internal or external.

A concept for an up and down, diagonal or front to back shaking motion may be utilized rather than simply side to side.

A belt type handheld shaking unit may be used to reduce the weight of the handheld unit. The belt would be tightened around an inverted container and shake the inserted container until the contents moved to the cap.

A "moving floor" type unit may be developed where a container is inverted and placed on a platform and held in place by some method and the platform shakes and vibrates the contents of the container to the cap.

An embodiment similar to the first embodiment and/or the alternate embodiments with no hold down, cover, or other type of container holding mechanism present rather the user will hold a container in the opening.

In the case of a user held container where no hold down, cover, or other type of container holding mechanism is present, a pressure switch may be used which will initiate a vibration and shaking cycle while the user presses the container into the opening and ends when the user quits pressing the container into the opening.

Thus the scope of the invention should be determined by the appended claims and their legal equivalents, and not by the examples given.

The invention claimed is:

1. A machine for vibrating and/or shaking containers, comprising:

a. A funnel to hold said containers, said funnel having an upper opening and a lower opening which is smaller than said upper opening b. A motor, c. A housing to elevate the funnel and containers to allow movement, d. An adjustable hold down device to hold the containers in said funnel, e. A cam arm between the motor and the funnel to move the funnel and containers to shake and/or vibrate.

2. The machine of claim 1, further comprising a timer to turn off the motor after the motor is turned on.

* * * * *